US007249692B2

(12) United States Patent
Walters et al.

(10) Patent No.: US 7,249,692 B2
(45) Date of Patent: Jul. 31, 2007

(54) DISPENSER WITH LOCK

(75) Inventors: Peter J. Walters, Barrington, IL (US); Jason A. Ksiazk, Arlington Heights, IL (US); Sean H. Cho, South Elgin, IL (US); Paul E. Hallman, Lakewood, IL (US); Jonathan D. Werner, Algonquin, IL (US); Craig Braun, Elgin, IL (US)

(73) Assignee: SeaquistPerfect Dispensing Foreign, Inc., Crystal Lake, IL (US)

( * ) Notice: Subject to any disclaimer, the term of this patent is extended or adjusted under 35 U.S.C. 154(b) by 0 days.

(21) Appl. No.: 11/268,445

(22) Filed: Nov. 7, 2005

(65) Prior Publication Data

US 2006/0113327 A1 Jun. 1, 2006

Related U.S. Application Data

(63) Continuation-in-part of application No. 11/176,896, filed on Jul. 7, 2005, which is a continuation-in-part of application No. 29/218,428, filed on Nov. 29, 2004, now Pat. No. Des. 525,123.

(51) Int. Cl.
*B67B 5/00* (2006.01)

(52) U.S. Cl. ..... 222/153.11; 222/153.13; 222/182; 222/321.8; 222/383.1; 222/402.13; 222/402.15

(58) Field of Classification Search ..... 222/153.13, 222/153.14, 153.12, 153.1, 182, 321.8, 381, 222/383.1, 402.11, 402.13, 402.15, 321.7, 222/321.9, 402.1
See application file for complete search history.

(56) References Cited

U.S. PATENT DOCUMENTS

| | | | |
|---|---|---|---|
| 2,048,142 | A | 7/1936 | Santurello |
| 2,753,578 | A | 7/1956 | Lebet |
| 2,772,031 | A | 11/1956 | Roselund |
| 3,061,202 | A | 10/1962 | Tyler |
| 3,083,871 | A | 4/1963 | Jepson |
| 3,348,740 | A | 10/1967 | O'Donnell |
| 3,422,996 | A | 1/1969 | Lipman |
| 3,650,473 | A | 3/1972 | Malone |
| 3,664,556 | A | 5/1972 | Perry |
| 3,669,300 | A | 6/1972 | Thomas |

(Continued)

FOREIGN PATENT DOCUMENTS

EP 0 187 314 A2 7/1986

(Continued)

OTHER PUBLICATIONS

FIGS. 1-4.
FIGS. 1A, 2A, 3A, and 4A.

*Primary Examiner*—Frederick C. Nicolas

(57) ABSTRACT

A dispensing assembly is provided for a container of fluent material. A hand-operable dispenser cartridge is adapted to be mounted to the container. An actuator, which may include a nozzle or spout, is mounted on the cartridge. A locking sleeve is mounted around the cartridge and has an upper abutment edge and a recess. The locking sleeve can be rotated between a first rotated position preventing actuation of the dispensing assembly and a second rotated position permitting actuation of the dispensing assembly.

33 Claims, 35 Drawing Sheets

U.S. PATENT DOCUMENTS

D226,712 S 4/1973 Tada
3,770,206 A 11/1973 Tada
3,797,705 A 3/1974 Cooprider
3,797,749 A 3/1974 Tada
3,827,605 A 8/1974 Knickerbocker
3,827,606 A 8/1974 Knickerbocker
D239,372 S 3/1976 Brooks
D240,036 S 5/1976 Tada
3,970,221 A 7/1976 Fleischer
3,973,700 A 8/1976 Schmidt
D241,543 S 9/1976 Tada
3,986,644 A 10/1976 Grogan
D242,351 S 11/1976 Tada
3,995,774 A 12/1976 Cooprider
3,995,776 A 12/1976 Micallef
D243,180 S 1/1977 Federico
D243,333 S 2/1977 Tada
D244,531 S 5/1977 Klingaman
4,024,988 A 5/1977 Starrett
D244,991 S 7/1977 Weckman
D247,302 S 2/1978 Federico
D247,366 S 2/1978 Jones
4,077,548 A 3/1978 Beard
4,077,549 A 3/1978 Beard
4,101,057 A 7/1978 LoMaglio
4,120,430 A 10/1978 French
D251,381 S 3/1979 Reed
4,162,746 A 7/1979 Anderson et al.
D256,271 S 8/1980 Tada
D256,946 S 9/1980 Campbell
D258,800 S 4/1981 Halbeisen
D259,467 S 6/1981 Halbeisen
D259,541 S 6/1981 Halbeisen
4,278,187 A 7/1981 Luedtke
4,286,736 A 9/1981 Corsette
4,318,498 A 3/1982 Magers et al.
4,324,351 A 4/1982 Meshberg
4,340,158 A 7/1982 Ford et al.
4,343,417 A 8/1982 Corsette
4,355,962 A 10/1982 Magers
4,361,256 A 11/1982 Corsette
4,368,830 A 1/1983 Soughers
4,369,899 A 1/1983 Magers et al.
4,375,266 A 3/1983 Magers
4,384,660 A 5/1983 Palmisano et al.
D272,081 S 1/1984 Suhajda
4,424,919 A 1/1984 Knox et al.
4,427,134 A * 1/1984 Almouli ..... 222/153.11
4,434,917 A 3/1984 Saito
4,436,225 A 3/1984 Libit
4,441,633 A 4/1984 Bennett
4,449,647 A * 5/1984 Reed et al. ..... 222/153.09
D275,078 S 8/1984 Wassergord
D275,456 S 9/1984 Martin
4,479,589 A 10/1984 Ford
4,496,085 A 1/1985 Ford et al.
4,512,501 A 4/1985 Foster
4,538,748 A 9/1985 Ford et al.
4,589,574 A 5/1986 Foster
D285,713 S 9/1986 Garneau
4,865,228 A 9/1989 Landecker
D314,916 S 2/1991 Brooks
4,991,746 A 2/1991 Schultz
D321,315 S 11/1991 Halm
D327,222 S 6/1992 Fuchs
D332,392 S 1/1993 Foster
D332,652 S 1/1993 Foster
5,316,185 A * 5/1994 Meenan ..... 222/321.8
5,388,730 A 2/1995 Abbott et al.
5,445,299 A 8/1995 Harriman
D373,312 S 9/1996 Lin
D373,313 S 9/1996 Lin
5,615,806 A 4/1997 Grothoff
5,772,080 A 6/1998 de Pous
5,829,641 A 11/1998 Bartsch et al.
5,839,616 A 11/1998 Irwin
5,918,774 A 7/1999 Lund et al.
6,006,949 A 12/1999 Foster et al.
D421,718 S 3/2000 Durliat
6,053,371 A 4/2000 Durliat et al.
6,065,647 A 5/2000 Bliss, III et al.
6,119,902 A 9/2000 Shimada et al.
6,126,044 A 10/2000 Smith
D433,943 S 11/2000 Keung
D435,792 S 1/2001 Peloquin
6,168,050 B1 1/2001 Battegazzore
6,173,863 B1 1/2001 Brozell et al.
6,186,364 B1 2/2001 Dobbs
6,186,365 B1 2/2001 DeJonge
6,193,112 B1 2/2001 Santagiuliana
D446,721 S 8/2001 Kimble
6,299,032 B1 * 10/2001 Hamilton ..... 222/402.15
D456,262 S 4/2002 Cummings
6,364,171 B1 4/2002 Chalupsky et al.
D459,786 S 7/2002 Sweeton
D476,558 S 7/2003 Cho
6,601,735 B2 8/2003 Milian et al.
D481,305 S 10/2003 Walters
D525,123 S * 7/2006 Walters et al. ..... D9/448
2006/0006198 A1 * 1/2006 Lasserre et al. ..... 222/383.1

FOREIGN PATENT DOCUMENTS

EP 1 023 946 A2 8/2000
EP 1 317 963 A1 6/2003
EP 1 561 513 A1 8/2005
GB 2 238 088 A 5/1991
WO WO 97/02896 1/1997

* cited by examiner

LOCKED

LOCKED

UNLOCKED

UNLOCKED

UNLOCKED
AND
ACTUATED

UNLOCKED

UNLOCKED
AND
ACTUATED

LOCKED

UNLOCKED

UNLOCKED
AND
ACTUATED

DISPENSER WITH LOCK

CROSS REFERENCE TO RELATED APPLICATION

This application is a continuation-in-part of the U.S. utility patent application Ser. No. 11/176,896 filed Jul. 7, 2005, which is a continuation-in-part of the U.S. design patent application Ser. No. 29/218,428, filed Nov. 29, 2004 now U.S. Pat. No. D,525,123.

TECHNICAL FIELD

The present invention relates generally to a hand-operable dispensing package for fluent material, typically as a spray. The invention more particularly relates to an assembly of components for mounting a dispenser to a container in a way that can selectively permit or prevent actuation of the dispenser. The invention can be incorporated in a system employing either an aerosol dispensing valve or dispensing pump.

BACKGROUND OF THE INVENTION AND TECHNICAL PROBLEMS POSED BY THE PRIOR ART

Hand-operable or finger-operable dispensers (including, for example, both dispensing pumps and aerosol dispensing valves) are typically adapted to be mounted on hand-held containers that are commonly used for liquid products. Typically, some pumps and valves operate with a suitable discharge structure, such as a mechanical break-up unit, to produce a fine mist or atomized spray. Some pumps also operate to dispense a quantity of product in a liquid, cream, or paste form.

Some hand-operable pumps conventionally employ a pump cartridge having a chamber in which is disposed a pressurizing piston that can be actuated by the user's finger pressing down on an external actuator (e.g., button) which has a dispensing passage and which is connected to the piston with a hollow discharge tube or stem. The hollow stem establishes communication between the pump chamber and actuator from which the product is discharged. A spring acts against the piston or actuator to return the piston and actuator upwardly to the elevated, rest position when the finger pressing force is released.

Another type of hand-operable pump includes a trigger or lever which is pulled to move the actuator and discharge stem downwardly to actuate the pump. Such a system typically, but not necessarily, provides a mechanical advantage to the user to facilitate actuation.

Pump packages or dispensers are widely used for dispensing liquid products which may be cosmetic products, or other personal care products such as hair spray, body spray, sun care products, etc. Pump packages may also be used for institutional and household products, such as window cleaner, disinfectants, etc. For many of these types of products, the pump dispenser is provided with some sort of locking mechanism to render the actuator or button inoperable by latching the button in a particular position which must be released by the user performing a manipulation on the button or latch mechanism. This insures that the product is not dispensed accidentally during shipping or storage when the pump actuator button might be subjected to inadvertent impact.

Locking mechanisms can be used with fine mist pumps for products such as hair spray. The locking mechanism for such fine mist pumps can include a hood, overcap, or other cover that prevents the actuator form being actuated unintentionally during shipping or storage. However, even a hood can be knocked off of the package, and that would leave the actuator unprotected such that the actuator could be inadvertently bumped and perhaps partially depressed or actuated.

In those designs where a hood is employed, the disadvantages are that such a hood is an additional component that must be provided by the manufacturer, and the hood must subsequently be removed from the pump by the user (and perhaps retained by the user for subsequent replacement on the pump).

In some types of pump dispensers, whether or not a hood or overcap is provided, the button or actuator mounted to the dispensing pump stem might be relatively easily pulled off (after any hood is removed), or otherwise separated from, the dispensing pump stem. In many applications, it would be desirable to provide a system that would make the removal of the actuator or button from the stem more difficult while at the same time providing a locking system to prevent unintentional actuation.

It would further be desirable to provide a locking system that could be readily employed with a trigger pump. There are a number of conventional locking mechanisms for use with a trigger pump. One trigger pump locking mechanism is provided on the end of the discharge nozzle or spout and functions as a nozzle restrictor which can be rotated about the axis of the dispensing orifice to an "off" orientation that completely blocks the orifice, or to a second orientation that provides a "spray" stream, or to a third orientation that provides a "stream" discharge. Another type of locking mechanism that is suitable for trigger pumps is a clip-style lock that includes a removable clip which physically prevents actuation of the trigger when the clip is in place in the locking position. The clip must be removed to permit actuation of the trigger pump. When the clip is removed, it could possibly be lost or inadvertently discarded. Another type of locking mechanism suitable for use on trigger pumps is a removable plug that can be wedged into the trigger mechanism so that the trigger mechanism cannot be actuated. Such a removable locking plug also could be lost or inadvertently discarded, or even purposely stolen.

Like the above-discussed pump type dispensers, aerosol valve dispensers are typically mounted at the top of a container, such as a metal can containing a pressurized product. Conventional aerosol valve dispensing systems for a container include a hollow body which is open at the top and bottom ends and which is mounted in the top of the container. The bottom end of the hollow body is open to the pressurized contents in the container (usually through a dip tube connected to the bottom end opening in the aerosol valve body). A compression spring in the body biases a stem upwardly to project partly out of a body top end opening through an annular gasket at the top of the body. The upper part of the stem includes an internal, vertical discharge hole that is open at the upper end of the stem and that is connected to an external actuator button which has a dispensing passage from which the aerosol spray can be dispensed. Below the upper end of the stem, the stem has one or more lateral orifices which communicate with the vertical discharge hole inside the stem. Until the actuator button is pressed, the lateral orifices in the stem are located adjacent the inner cylindrical vertical surface of the annular gasket at the top of the valve body, and fluid inside the valve body is blocked by the gasket from flowing into the stem lateral orifices. When the actuator button is depressed, the stem is forced downwardly against the spring so as to locate the lateral orifices in the body below the gasket to permit the pressurized fluid in the valve body to flow through the stem lateral orifices, up the stem vertical hole, and through the actuator button.

It would be desirable to provide an improved dispensing assembly for a dispensing package which could be readily employed with pumps and aerosol valves, and which would include a locking mechanism to minimize the likelihood of unintended actuation.

Preferably, the improved assembly should accommodate a relatively robust design to prevent dislodgement of the locking mechanism and/or actuator from the package during impact, such as when the package is dropped or bumped.

It would also be desirable if such an improved locking mechanism could optionally accommodate designs that provide a tactile and/or audible indication to the user that the locked and unlocked positions are being reached as the components are manipulated by the user.

It would also be beneficial if an improved dispensing assembly for a dispensing package could optionally accommodate incorporation of various aesthetically pleasing designs.

The improved dispensing assembly should preferably also accommodate designs for use with standard containers, cans, or bottles.

It would also be desirable if the constituent components of such an improved assembly could be relatively easily molded or otherwise economically manufactured with high production quality, and could provide consistent operating parameters unit-to-unit with high reliability.

The present invention provides an improved system which can accommodate designs having one or more the above-discussed benefits and features.

SUMMARY OF THE INVENTION

The present invention provides dispensing assembly which is especially suitable for incorporation in either a pump dispensing package or an aerosol valve dispensing package.

According to the invention, a dispensing assembly for a container of fluent material includes a dispenser cartridge (e.g., an aerosol dispensing valve or dispensing pump cartridge) that has an upwardly projecting, reciprocatable, product-dispensing stem biased to an elevated, non-actuated, rest position and that is adapted to be installed in a mouth of a container. The assembly further includes an actuator (e.g., button) mounted on the dispenser cartridge stem for establishing fluid communication between the stem and the exterior of the actuator for dispensing fluent material from the container. The actuator includes a force-bearing actuation region that can be subjected to an actuation force to depress the actuator to urge the stem further into the dispenser cartridge to actuate the dispenser. The actuator may also include a lateral projection. In one form of the dispensing assembly, a lateral projection is provided in the form of a nozzle or spout having a dispensing passage that functions to define at least part of the fluid communication path between the dispenser cartridge stem and the exterior of the actuator.

A locking sleeve is rotatably mounted around both the stem and the actuator. According to one alternate form of the invention, the locking sleeve defines at least a first upper abutment edge for engaging an underside of the actuator lateral projection (which may be the dispensing nozzle in the preferred embodiment) to prevent downward movement of the actuator when the locking sleeve is in a first rotated position to lock the dispensing assembly from being actuated. The locking sleeve also defines at least a first recess for accommodating downward movement of the actuator lateral projection (which may be the nozzle or spout in the preferred embodiment) when the locking sleeve is in a second rotated position while the actuator is depressed to actuate the dispensing assembly.

In the preferred forms of the dispensing assembly of the present invention, the assembly includes a trigger mechanism for moving the actuator. A trigger is pivotally mounted to a trigger support that is carried by the assembly. The trigger extends over a portion of the actuator and defines an aperture in front of the actuator to accommodate dispensing of the fluent material from the actuator through the aperture. The trigger engages the top of the actuator and has a finger-grippable lever portion extending from the trigger aperture below the elevation of the aperture. In the preferred embodiment, the trigger provides the user with some mechanical advantage to move the actuator downwardly to actuate the dispensing assembly. The preferred form of the trigger also prevents removal of the actuator.

In a presently most preferred form of the invention, the actuator may have, but need not necessarily have, a lateral projection (e.g., a nozzle or spout). In the most preferred form of the invention, the actuator has a nozzle or spout, but the nozzle or spout does not engage the locking sleeve upper abutment edge in the locked or unlocked condition. Instead, the dispensing assembly includes a lock stop feature in the form of an engaging arm on the trigger, and the arm is engaged by the locking sleeve upper abutment edge to prevent actuation of the trigger when the dispensing assembly is in the locked condition.

In the preferred form of the dispensing assembly of the present invention, the locking mechanism is easily operable by rotation, such as through a 90 degree increment between the locked and unlocked conditions.

Further, in the most preferred form of the invention, the locking mechanism provides a tactile sensation of relieved resistance when the locking mechanism is rotated to the unlocked or locked positions.

Further, in the preferred embodiment, a click or similar sound is audible when the locking mechanism is moved into either the locked position or the unlocked position.

In the preferred embodiment, the locking mechanism will also provide a tactile sensation of increased resistance when the user attempts to rotate the locking mechanism away from the locked or unlocked positions.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 5 shows the dispensing pump assembly in an unactuated, but releasably locked, condition prior to use;

FIG. 12 is a fragmentary, cross-sectional view similar to FIG. 8, but FIG. 12 shows the package in the unlocked condition, whereas FIG. 8 shows the package in the locked condition;

FIG. 23 is a fragmentary, cross-sectional view similar to FIG. 21, but FIG. 23 shows the package in the unlocked condition corresponding to FIG. 22, whereas FIG. 21 shows the package in the locked condition;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of this invention and the container employed with the components of this invention are described in the normal (upright) operating position, and terms such as upper, lower, horizontal, etc., are used with reference to this position. It will be understood, however, that the components embodying this invention may be manufactured, stored, transported, used, and sold in an orientation other than the position described.

Figures illustrating the components of this invention and the container show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

Figure 1:
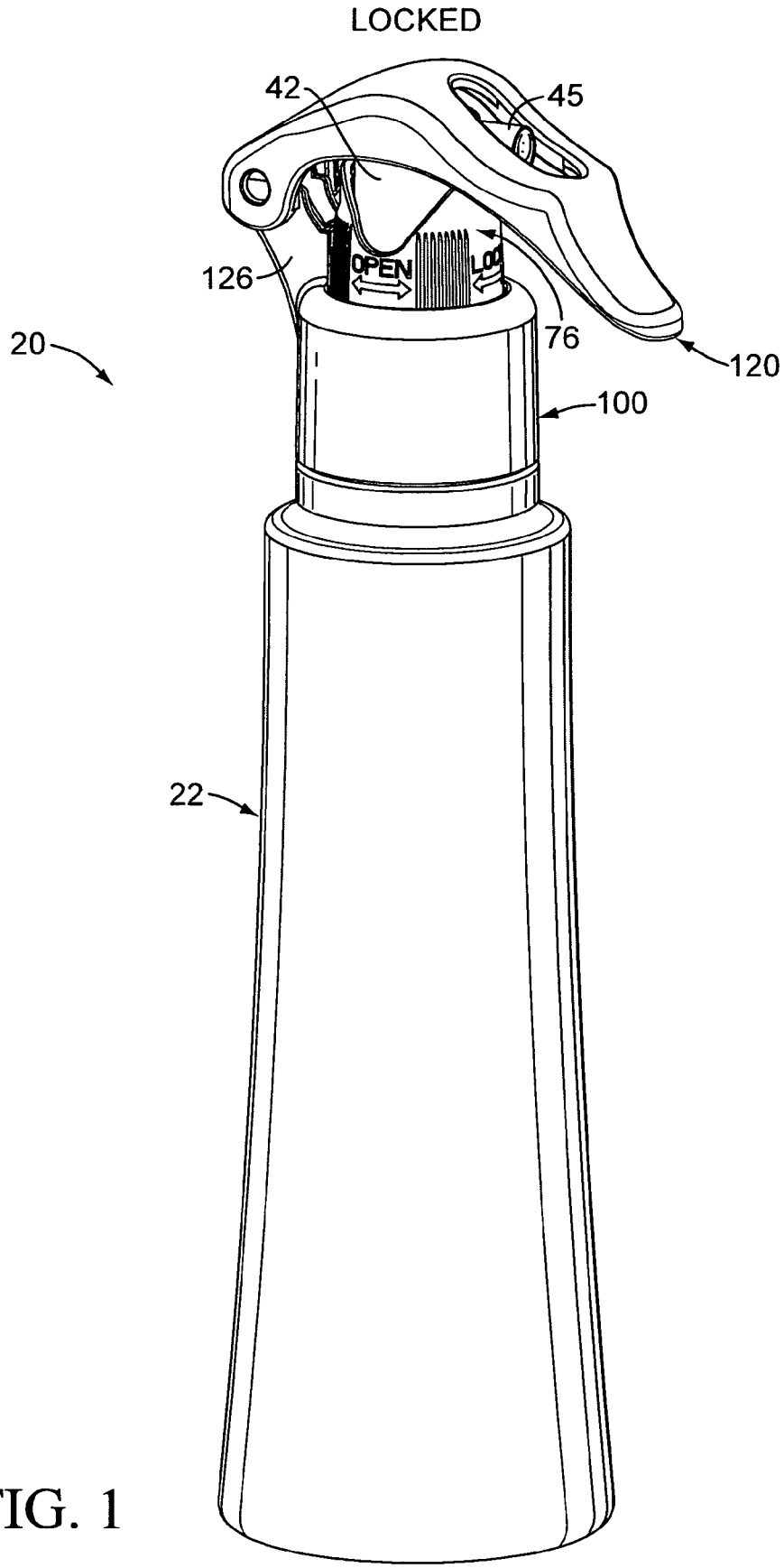
FIG. 1 is a perspective view of a preferred first embodiment of a hand-operable dispensing package incorporating the dispensing assembly of the present invention in the form of a dispensing pump assembly, and the package is shown with the dispensing pump assembly in an unactuated, but releasably locked, condition prior to use.
Figure 2:
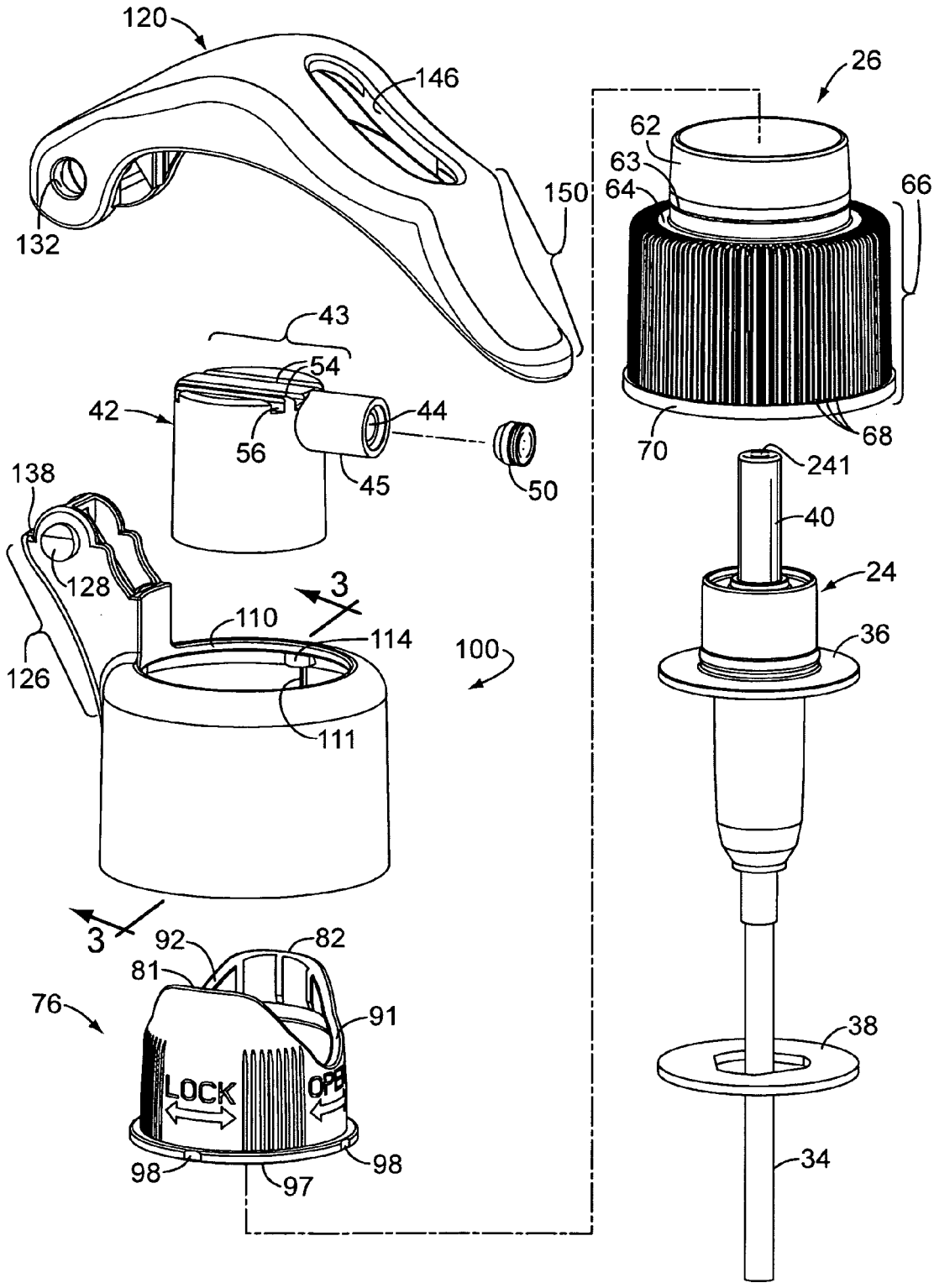
FIG. 2 is an exploded, perspective view of the dispensing pump assembly used in the package illustrated in FIG. 1.

FIG. 1 illustrates a package 20 employing a first embodiment of a hand-operable dispensing assembly of the present invention in which the assembly is in the form of a dispensing pump assembly installed on a container 22. FIG. 2 illustrates a typical pump or dispensing pump cartridge 24 that may be employed as part of the assembly on the container 22 and which is adapted to be mounted with a closure 26 in the mouth of the container 22.

The container 22 is adapted to hold a product (e.g., a liquid (not shown)) below the pump cartridge 24. Typically, the upper end of the container 22 and a portion of the pump assembly can be conveniently held in the user's hand.

Figure 6:
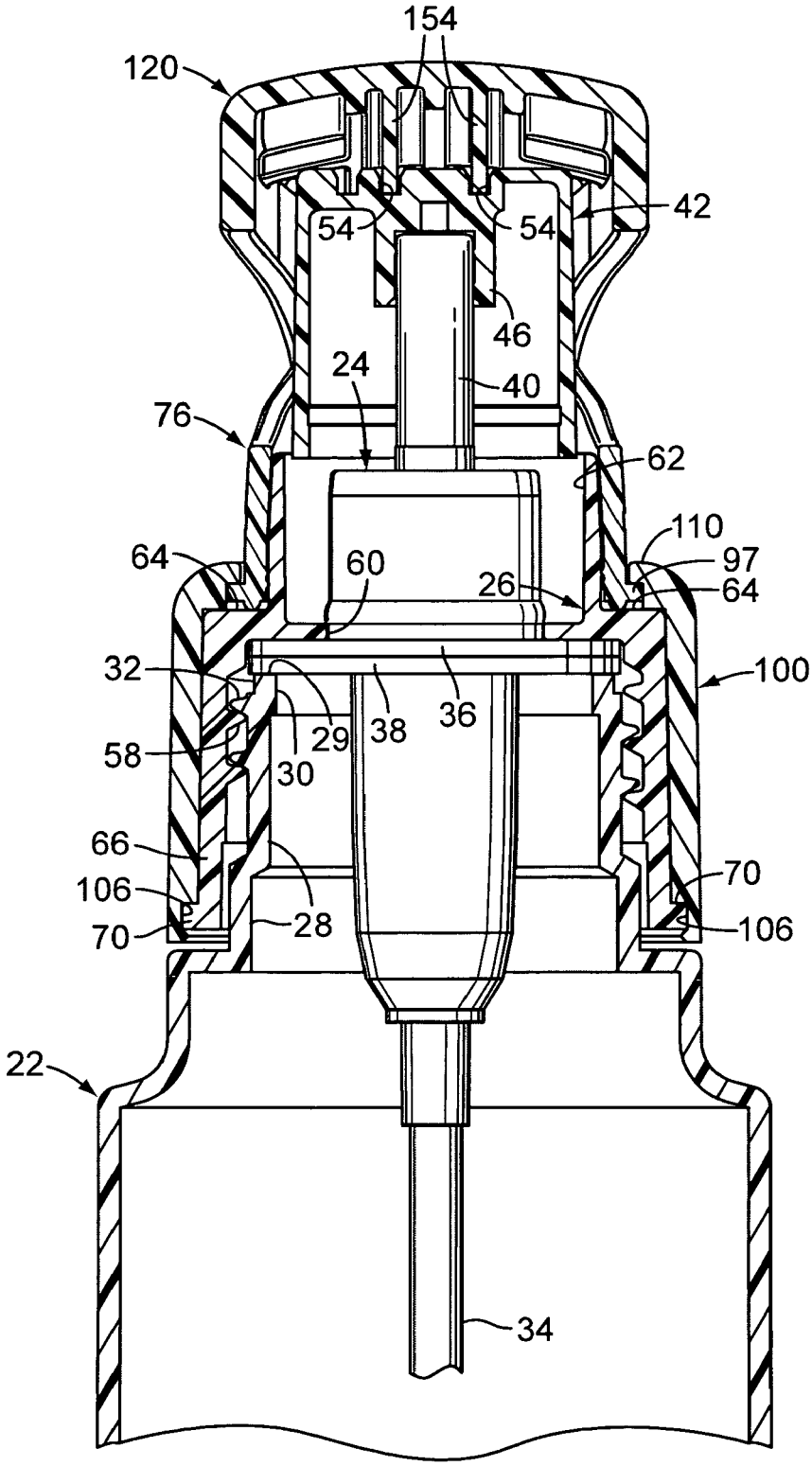
FIG. 6 is a fragmentary, cross-sectional view taken generally along the plane 6-6 in FIG. 5.
Figure 8:
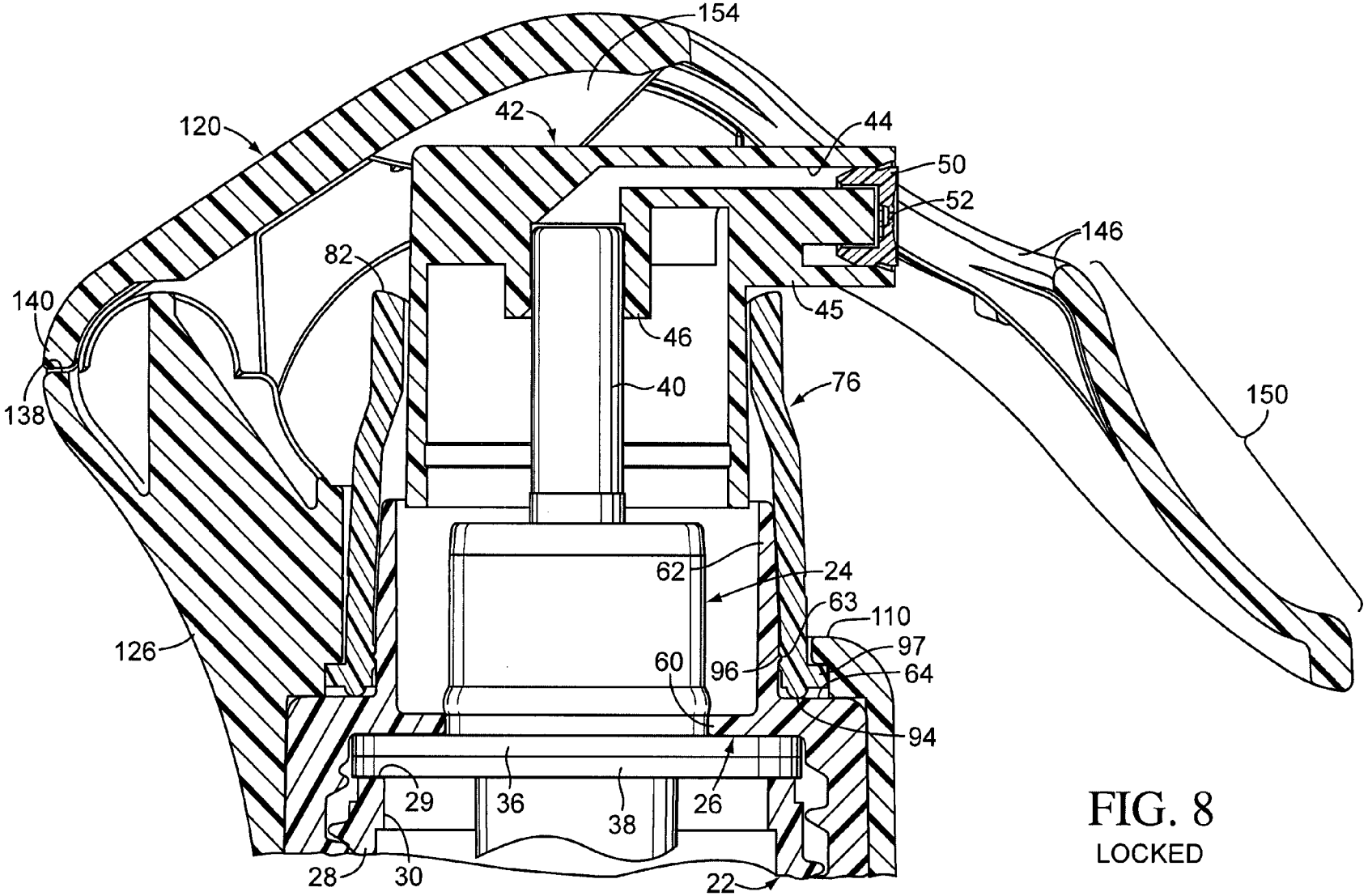
FIG. 8 is a fragmentary, cross-sectional view taken generally along the plane 8-8 in FIG. 7.

The container 22 may be made of any suitable material, such as metal, glass, or plastic. As shown in FIGS. 6 and 8, the container 22 can have a reduced diameter neck 28 (FIG. 6) with a rim 29 defining a mouth or opening 30 into which the pump cartridge 24 is inserted.

The exterior of the container neck 28 typically defines threads 32 (FIG. 6) for engaging the closure 26 as described in detail hereinafter. The threads 32 define a connection feature adjacent the container mouth 30. Other connection features may be employed in cooperation with mating or cooperating connection features on the closure 26, and such other connection features could be a snap-fit bead and groove arrangement or other conventional or special connection features, including non-releasable connection features such as adhesive, thermal bonding, staking, etc.

A part of the pump cartridge 24 typically extends into the container opening or mouth 30. The pump cartridge 24 may be of any suitable conventional or special type. With a typical conventional pump cartridge 24, the bottom end of the pump cartridge 24 is attached to a conventional dip tube or suction tube 34 (FIGS. 2 and 6), and the upper end of the pump cartridge 24 projects above the container neck 28 (FIG. 6). The pump cartridge 24 includes an outwardly projecting flange 36 for supporting the pump cartridge 24 on the container neck 28 over a conventional sealing gasket 38 (FIGS. 2 and 6) which is typically employed between the pump cartridge flange 36 and container neck rim 29.

The body of the pump cartridge 24 defines an interior chamber (not visible). In a typical pump cartridge 24, a pressurizing piston (not visible) is disposed in the upper end of the interior chamber, and a non-return check valve ball (not visible) is disposed in the lower end of the chamber to prevent back flow down the suction tube 34 when the interior chamber is pressurized by the piston during actuation of the pump. The pressurizing piston typically has an internal passage (not visible) which is connected to a hollow stem or discharge tube 40 (FIGS. 2 and 6) which extends out through the top of the pump cartridge 24. The hollow stem or tube 40 establishes communication between the pump chamber within the pump cartridge 24 and an actuator or button 42 (FIGS. 2 and 6) which is mounted to the upper end of the tube 40.

Figure 7:
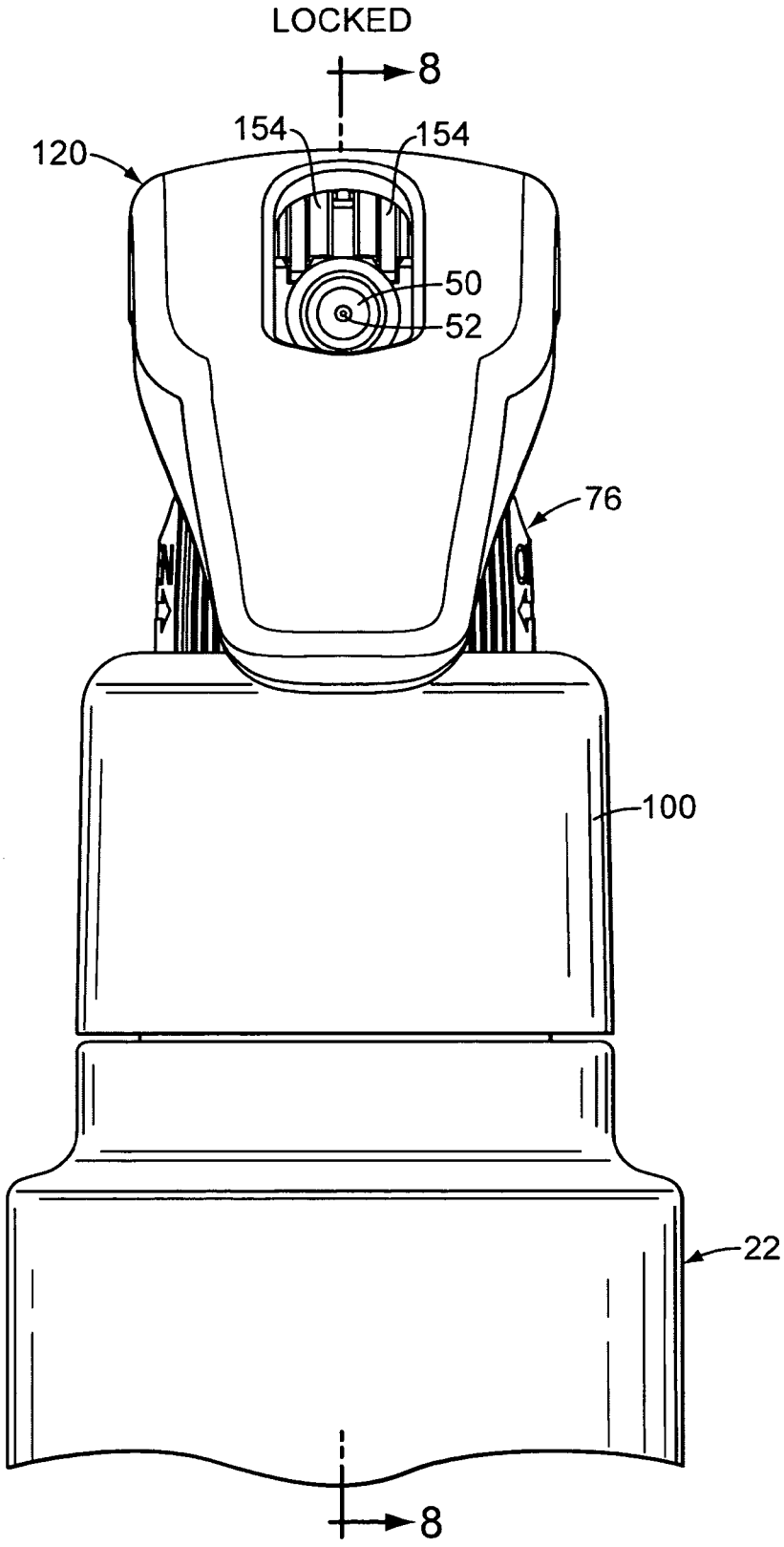
FIG. 7 is a fragmentary, front elevational view of the package as viewed along the plane 7-7 in FIG. 5.

The actuator or button 42 defines a discharge passage 44 (FIG. 8) through which the product from the stem or tube 40 is discharged. The discharge passage 44 extends from an internal sleeve 46 defining an inlet cavity into which the terminal end or distal end of the stem 40 can be press-fit. The outer portion of the discharge passage 44 is defined in a laterally projecting nozzle or spout 45 (FIGS. 2 and 8). The outer end portion of the discharge passage 44 has an annular configuration into which can be press-fit a conventional mechanical breakup unit or spray insert 50 (FIG. 8) which has an exit orifice 52 (FIGS. 7 and 8).

The actuator 42 has a top end defining a force-bearing actuation region 43 (FIG. 2) which includes two spaced-apart, linear, parallel grooves 54 located next to an assembly orientation groove 56. As explained in detail hereinafter, the two grooves 54 are adapted to receive portions of a trigger structure that is operated by the user to move the actuator (button) 42 and stem 40 downwardly in the pump cartridge 24 to dispense fluid from the pump cartridge 24. The fluid is pressurized in the pump chamber and exits as a fine mist spray from the nozzle orifice 52 in the nozzle or spout 45.

Inside the pump cartridge 24, there is typically a spring (not visible) which acts against the piston inside the pump cartridge 24 to bias the internal piston (with the attached stem 40 and actuator 42) upwardly to an elevated rest position (FIG. 1) when the actuating force (operating force) is released.

After the pump cartridge 24 is actuated to dispense a liquid product as an atomized spray, the user terminates the actuation operation so that the pump components are returned by the internal spring to the elevated, rest condition (FIGS. 1 and 5-12). As the spring moves the pump piston upwardly in the pump cartridge 24, the internal check valve opens, and the fluid in the container 22 is drawn up into the cartridge 24 through the suction tube 34. The suction tube 34 typically extends to near the bottom of the container 22. The bottom end of the suction tube 34 is normally submerged in the fluid when the container 22 is in a generally upright orientation as illustrated in FIG. 1.

It will be appreciated that the particular design of the pump cartridge 24 may be of any suitable design for pumping a product from the container 22 (with or without a suction tube 34) and out through the stem 40. The detailed design and construction of the pump cartridge 24 per se forms no part of the present invention except to the extent that the pump cartridge 24 includes an outwardly projecting stem for discharging product and except to the extent that the cartridge 24 is adapted to be suitably mounted and held on the container with a suitable mounting system.

While the present invention may be practiced with spray or liquid pumps of many different designs, the internal design configuration of one suitable pump is generally disclosed in U.S. Pat. No. 4,986,453, the disclosure of which is hereby incorporated herein by reference thereto. It should be understood, however, that the present invention is suitable for use with a variety of finger-operable pumps.

The closure 26 (FIGS. 2 and 6) has an internal female thread 58 (FIG. 6) defining a connection feature for mating with the container male thread 32 as shown in FIG. 6. The connection feature of the closure 26 may take other forms for mating with other forms of a connection feature on the container 22. For example, a snap-fit bead and groove arrangement could be employed, or some other suitable conventional or special connection arrangement could be employed.

The closure 26 includes an inwardly projecting flange 60 (FIG. 8) to define a retention feature wherein the flange 60 is adapted to overlie the pump cartridge flange 36 (FIG. 6) so as to clamp the pump cartridge flange 36 against the gasket 38 on the top of the container neck rim 29.

Radially inwardly of the closure flange 60 is an opening through which the pump cartridge 24 can project. The closure 26 extends upwardly from the flange 60 to define an annular wall or shroud 62 (FIGS. 2 and 8). The annular wall or shroud 62 extends laterally around a portion of the pump cartridge 24 and has a small circumferential bead 63 (FIG. 2).

The closure 26 also defines an annular shoulder 64 (FIGS. 2 and 6) outwardly of the shroud 62. The annular shroud 62 may be characterized as extending upwardly from the inner periphery of the annular shoulder 64.

The lower part of the closure 26 includes a skirt 66 (FIGS. 2 and 6). The exterior surface of the closure skirt 66 is defined by a plurality of radially outwardly extending, circumferentially spaced, vertical ribs 68 (FIG. 2).

The closure 26 has an open bottom end, and at the bottom of the ribs 68, the closure 26 has an annular retention bead 70 (FIG. 6) projecting radially outwardly adjacent the closure bottom end.

Mounted on the closure annular shoulder 64 is a lock or locking sleeve 76 (FIGS. 2 and 6). The locking sleeve 76 is rotatably mounted on the closure around both the pump cartridge stem 40 and actuator 42. The locking sleeve 76 defines a first upper engaging edge 81 and a second upper engaging edge 82. The locking sleeve also defines a first recess 91 and a second recess 92 (FIG. 2). In the preferred embodiment illustrated, the two upper abutment edges 81 and 82 are 180 degrees apart, and the two recesses 91 and 92 are 180 degrees apart. In an alternate embodiment (not illustrated), the locking sleeve 76 may have only one upper abutment edge and only one recess. In still another alternate embodiment (not illustrated), the locking sleeve 76 may have three or more upper abutment edges and three or more recesses.

In the preferred embodiment illustrated, the locking sleeve 76 has a bottom end defined by a rounded bead 94 (FIG. 8) which facilitates supporting the locking sleeve 76 for rotation on the shoulder 64 of the closure 26. The closure shroud 62 extends upwardly inside the locking sleeve 76 to locate the shroud bead 63 (FIG. 2) inside the locking ring 76. In the preferred embodiment, the inside cylindrical surface of the lower part of the locking sleeve 76 also defines a horizontally oriented groove 96 (FIG. 8) for matingly receiving the outwardly projecting bead 63 on the closure shroud 62 as shown in FIG. 8.

As can be seen in FIGS. 2 and 8, the locking sleeve 76 includes a radially outwardly extending peripheral flange 97 adjacent the locking sleeve bottom end. The flange 97 defines four circumferentially spaced arcuate notches 98 (FIG. 2).

Figure 3:
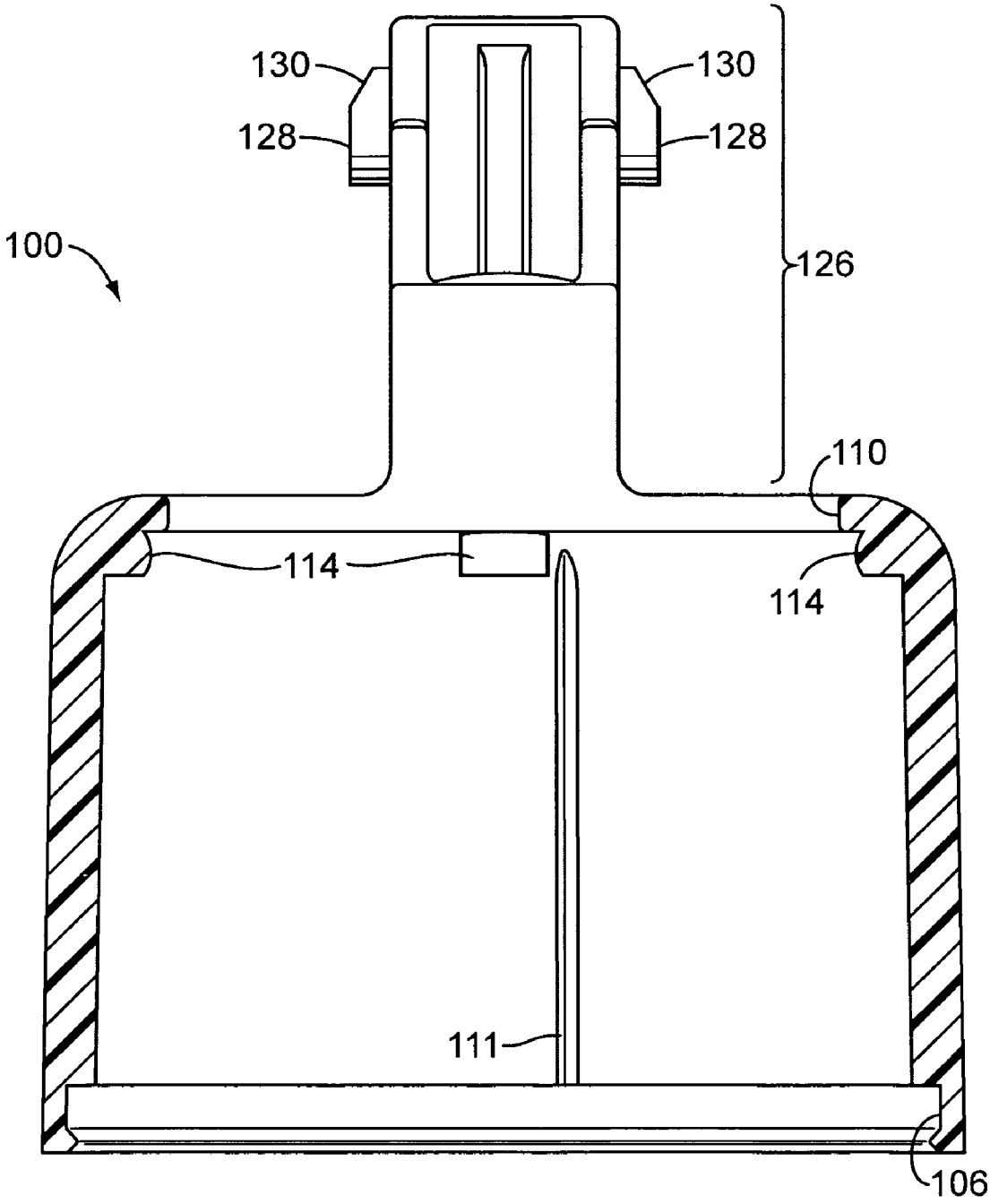
FIG. 3 is a greatly enlarged, cross-sectional view of the exterior fixed sleeve (i.e., housing) of the dispensing pump assembly taken generally along the plane 3-3 in FIG. 2.
Figure 4:
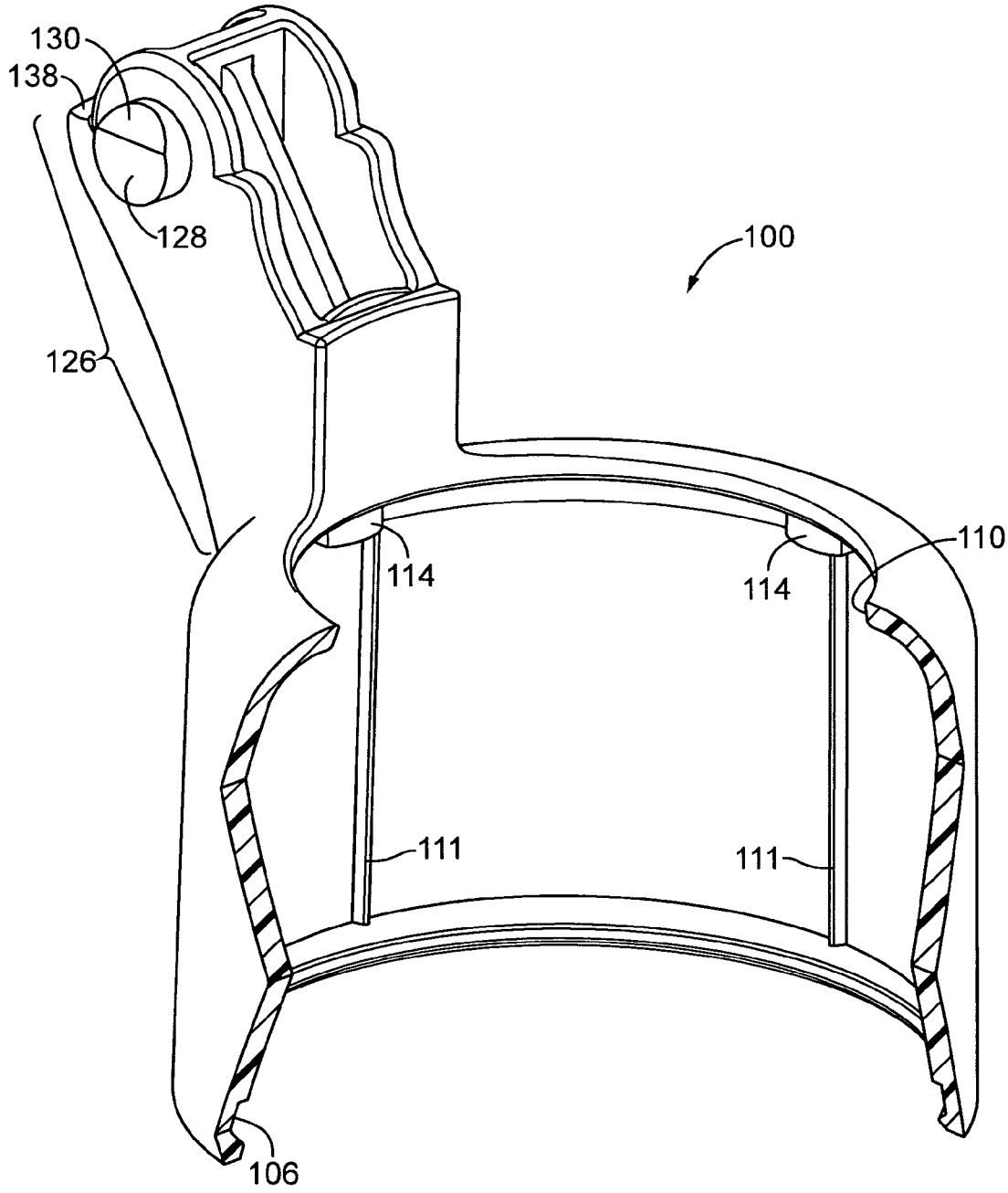
FIG. 4 is a perspective view of the exterior fixed sleeve (i.e., housing) of the dispensing pump assembly shown in FIG. 1, but FIG. 4 shows a portion broken away to illustrate interior details.

The dispensing pump assembly includes a fixed exterior sleeve or housing 100 (FIGS. 2-4). As shown in FIG. 6, the fixed sleeve or housing 100 is adapted to be disposed around a lower portion of the locking sleeve 76 and closure 26.

The housing 100 has an open bottom end. The housing 100 defines an annular groove 106 (FIG. 3) that is adjacent the housing bottom end and that faces radially inwardly for receiving the closure retention bead 70 in a snap-fit engagement to retain the housing 100 on the closure 26 as shown in FIG. 6.

As can be seen in FIG. 6, the housing 100 has an open, upper end that receives the locking sleeve bottom end and the locking sleeve peripheral flange 97. As can be seen in FIGS. 2, 3, and 8, the upper end of the housing 100 has a radially inwardly projecting retention lip 110. As can be seen in FIG. 8, the housing lip 110 overlies and engages the locking sleeve outwardly extending peripheral flange 97 so as to retain the locking sleeve 76 around the closure shroud 62 and to maintain the locking sleeve bottom end bead 94 on the closure annular shoulder 64 to accommodate rotation of the locking sleeve 76 around the closure shroud 62.

With reference to FIGS. 3 and 4, it can be seen that the interior of the housing 100 includes four spaced-apart arcuate tabs 114. Each tab 114 is convex and projects radially inwardly. Each tab 114 is adapted to be received in a notch 98 in the flange 97 of the locking sleeve 76 when the locking sleeve 76 is rotated to any of four possible alignment positions relative to the closure 26 and housing 100. The housing acuate tabs 114 and the locking sleeve flange arcuate notches 98 function together to provide interengageable features that define selected positions of relative rotational alignment between the locking sleeve 76 and the housing 100. The tabs 114 and notches 98 also permit or accommodate rotation of the locking sleeve 76 (relative to the closure 26 and housing 100) between (1) at least one unlocked actuatable position corresponding to a rotated position of the sleeve 76 and (2) at least one releasably locked position corresponding to another rotated position of the sleeve as explained in more detail hereinafter. Each sleeve notch 98 functions for releasably holding a housing tab 114 in a releasable detent engagement to releasably hold the locking sleeve 76 selectively in one of two or more rotated positions corresponding to locked and unlocked conditions relative to the operation of the dispensing pump assembly.

The interior of the housing 100 has at least one, and preferably four, radially inwardly projecting, internal, vertical ribs 111 which are each adapted to be received between any two adjacent ribs 68 on the exterior of the closure 26. This prevents relative rotation between the housing 100 and the closure 26.

The housing ribs 111 also function during installation of the entire dispensing pump assembly onto the container 22 by automatic capping equipment to prevent relative rotation of the housing 100 relative to the closure 26, and this permits the automatic installation equipment to grip and rotate the housing 100 to cause the entire dispensing pump assembly to be rotated so that the closure threads 32 are properly screwed on the container neck threads 58 (FIG. 6).

Figure 12:
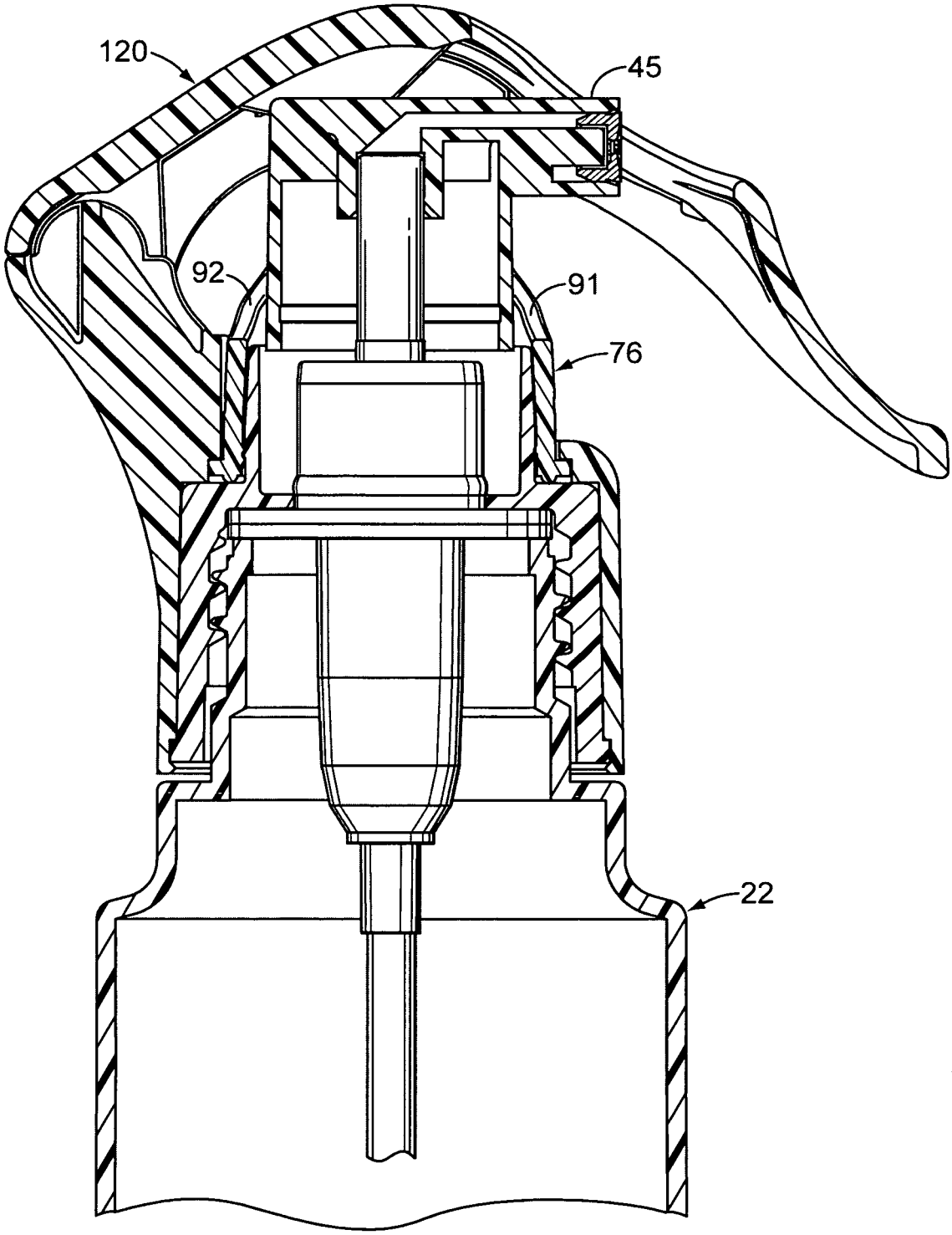
Figure 13:
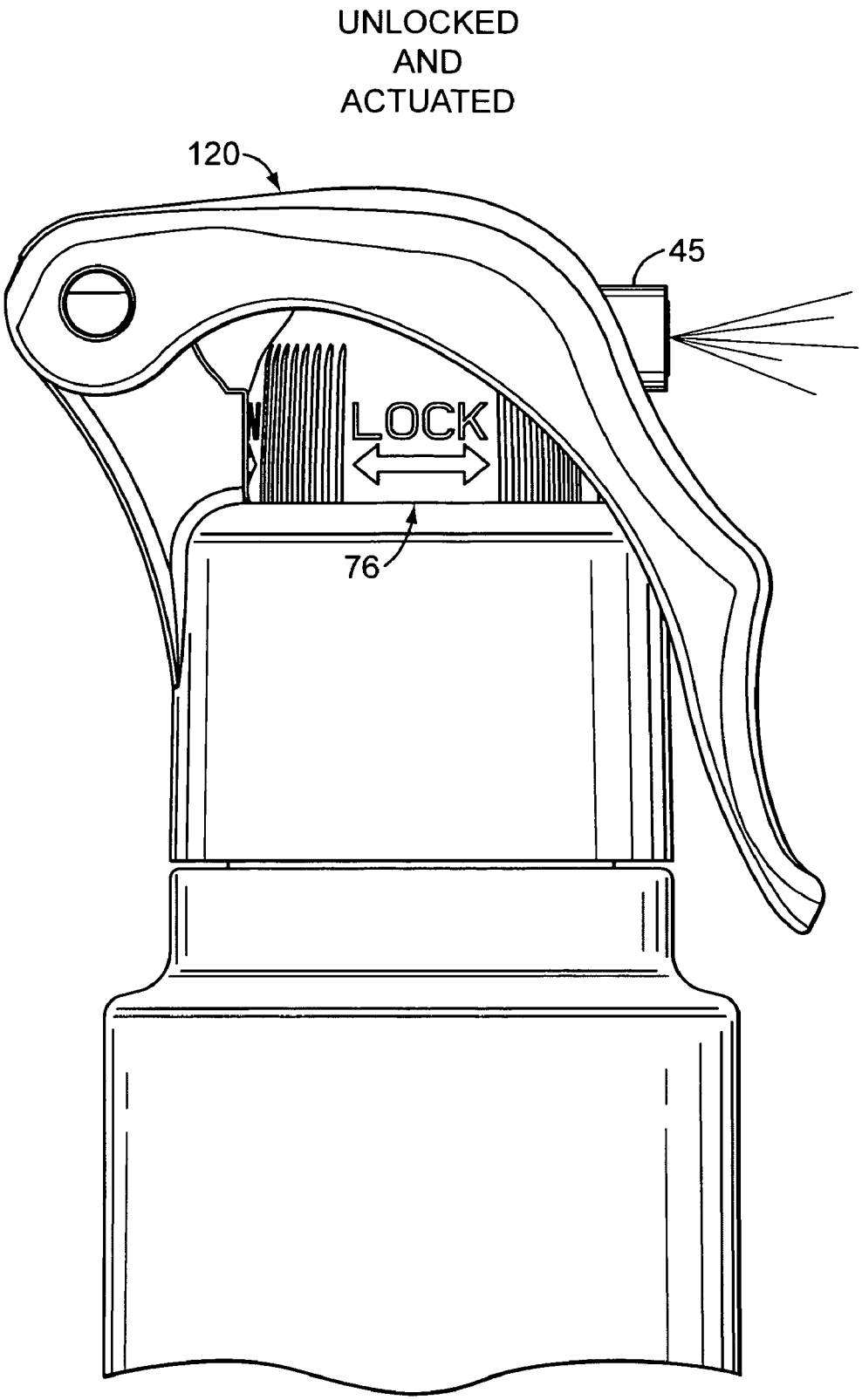
FIG. 13 is a fragmentary, side elevational view similar to FIG. 10, but FIG. 13 shows the trigger in a depressed position on the unlocked package to effect actuation of the dispensing pump assembly with consequent discharge of a spray of fluent material.
Figure 14:
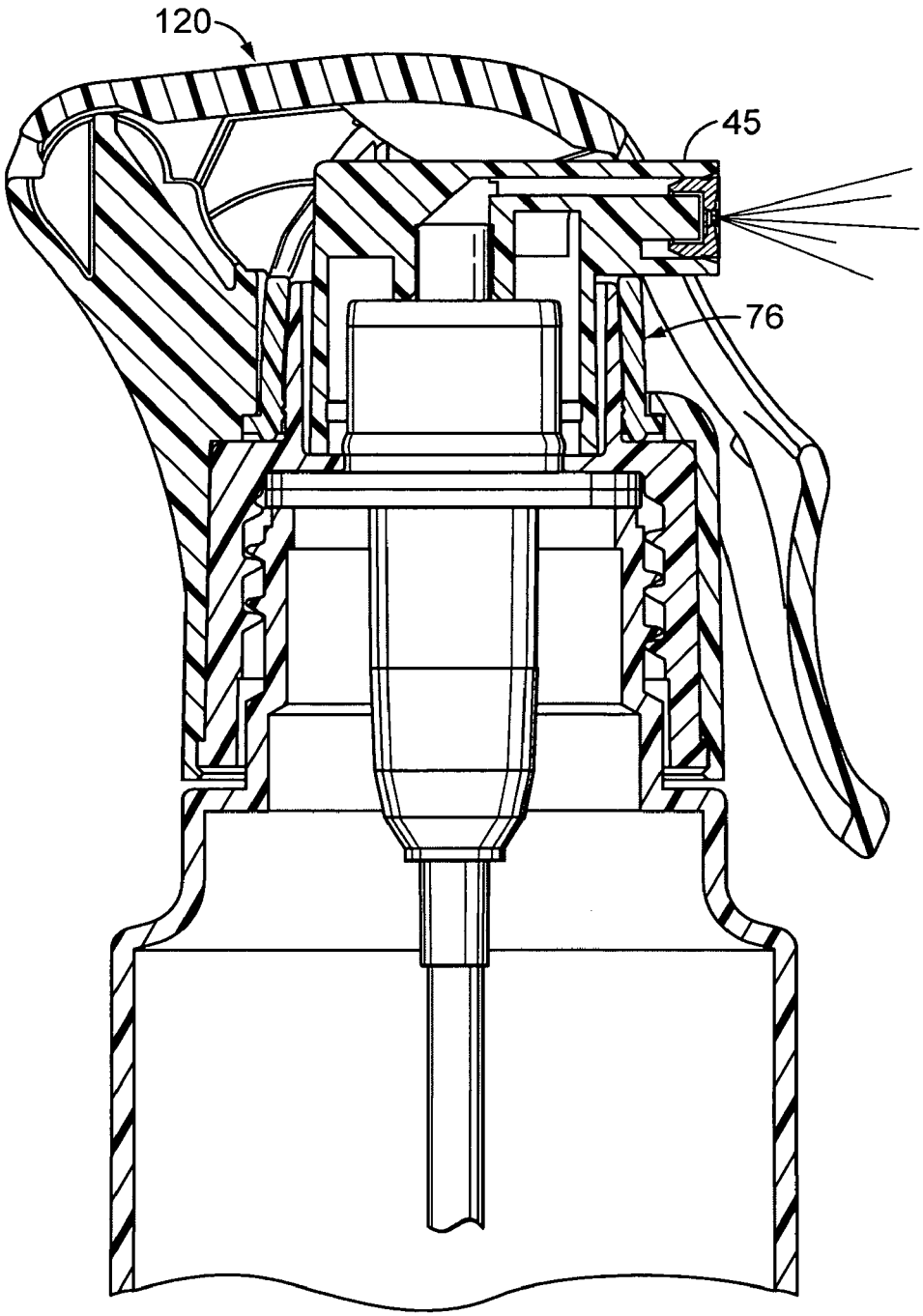
FIG. 14 is a fragmentary, cross-sectional view similar to FIG. 12, but FIG. 14 shows the trigger depressed as in FIG. 13 on the unlocked package to actuate the pump to dispense the fluent material in an atomized spray.

In the preferred form of the present invention, the actuator 42 is preferably operated by a lever or trigger 120 (FIGS. 1 and 2) which can be pulled by the user against the top of the actuator or button 42 to force the button downwardly (compare FIG. 12 and FIG. 14). To this end, the dispensing pump assembly includes a trigger support 126 (FIGS. 1 and 2) which projects from the housing 100 rearwardly of the actuator spout 45. The trigger support 126 includes a pair of spaced-apart, outwardly projecting stub shafts 128 (FIG. 3). Each stub shaft has a slanted upper surface 130 (FIG. 4) providing a chamfered design to accommodate installation of the trigger 120 on the trigger support 126.

As can be seen in FIG. 2, the trigger 120 has a rear end portion defining a pair of spaced-apart bores 132 (only one of which is visible in FIG. 2). Each bore 132 is adapted to receive one of the trigger support stub shafts 128 to provide a pivotal mounting of the trigger 120 on the trigger support 126. As can be seen in FIGS. 2 and 8, the upper end of the trigger support 126 defines a outwardly facing horizontal ledge or stop surface 138. As can be seen in FIG. 8, the ledge or stop surface 138 lies under, and adjacent, a rear wall 140 of the trigger 120 to prevent the trigger 120 from being rotated in a counter-clockwise direction beyond the position shown in FIG. 8.

The front portion of the trigger 120 defines an elongate opening, hole, or aperture 146 which is located partly around the actuator spout 45 to accommodate dispensing a fluent material from the spout 45 through the aperture 146.

As illustrated in FIGS. 2 and 8, the front end portion of the trigger 120 defines a finger-grippable lever portion 150 which can be grasped by the user's fingers for pulling or squeezing the trigger 120 downwardly against the top of the actuator or button 42.

The underside of the trigger 120 includes a structure for engaging the force-bearing actuation region 43 at the top end of the actuator or button 42. To this end, and with reference to FIGS. 6 and 8, the trigger 120 includes two spaced-apart, linear cam ribs 154 which are each aligned generally parallel to the actuator spout 45 and which are each adapted to be received in one of the grooves 54 in the top of the actuator 42.

Figure 5:
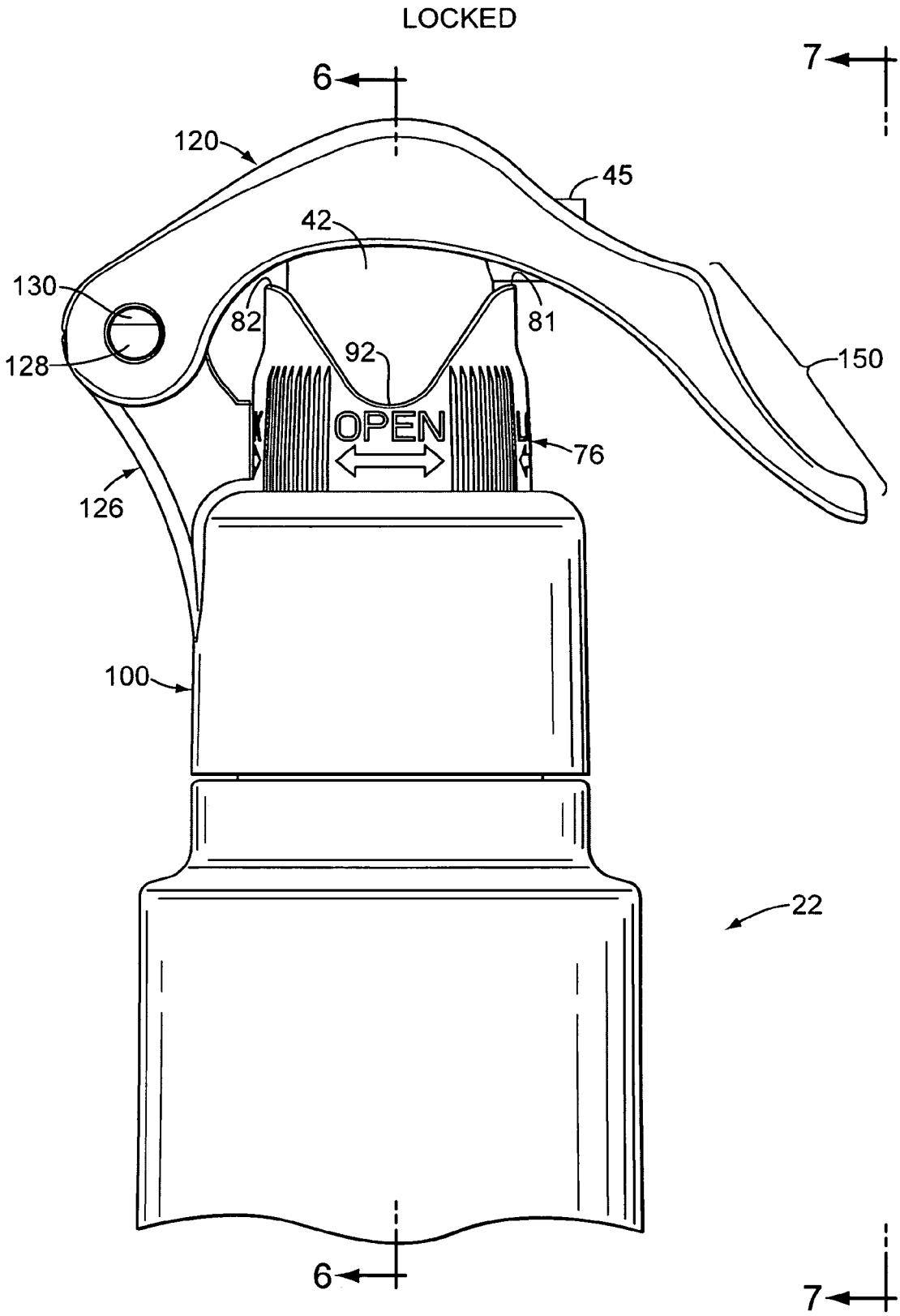
FIG. 5 is an enlarged, fragmentary, side elevational view of the hand-operable dispensing pump package illustrated in FIG. 1

FIGS. 1 and 5-8 show the dispensing pump assembly in an unactuated, but locked condition. As can be seen in FIG. 5, the user can look at the side of the pump to view the locking sleeve 76 which is preferably provided with appropriate indicia, such as the word "OPEN" over a double-headed arrow which is clearly visible and which prompts the user to rotate the locking sleeve 76 in either a clockwise or counter-clockwise direction in order to place the system in an "open" condition which will permit pump actuation by pulling down on the lever 150 of the trigger 120.

When the dispensing pump assembly is locked as shown in FIG. 5, one upper abutment edge (e.g., edge 81 in FIG. 5) is positioned directly under the laterally extending spout 45 which is at its maximum elevation as result of the actuator 42 being biased by the pump cartridge 24 (FIG. 8) to the upper, unactuated, rest position (the maximum height of which is determined by the engagement of the top of the actuator 42 with the trigger camming ribs 154 that are prevented from any further upward movement by the engagement of the trigger rear wall 140 with the trigger support restraint ledge 138 (FIG. 8)).

If the user tries to pull the trigger 120 downwardly, the underside of the actuator spout 45 engages the upper abutment edge (edge 81 in FIG. 5) to prevent downward movement of the trigger 120, and hence, to prevent actuation of the dispensing pump assembly.

Figure 9:
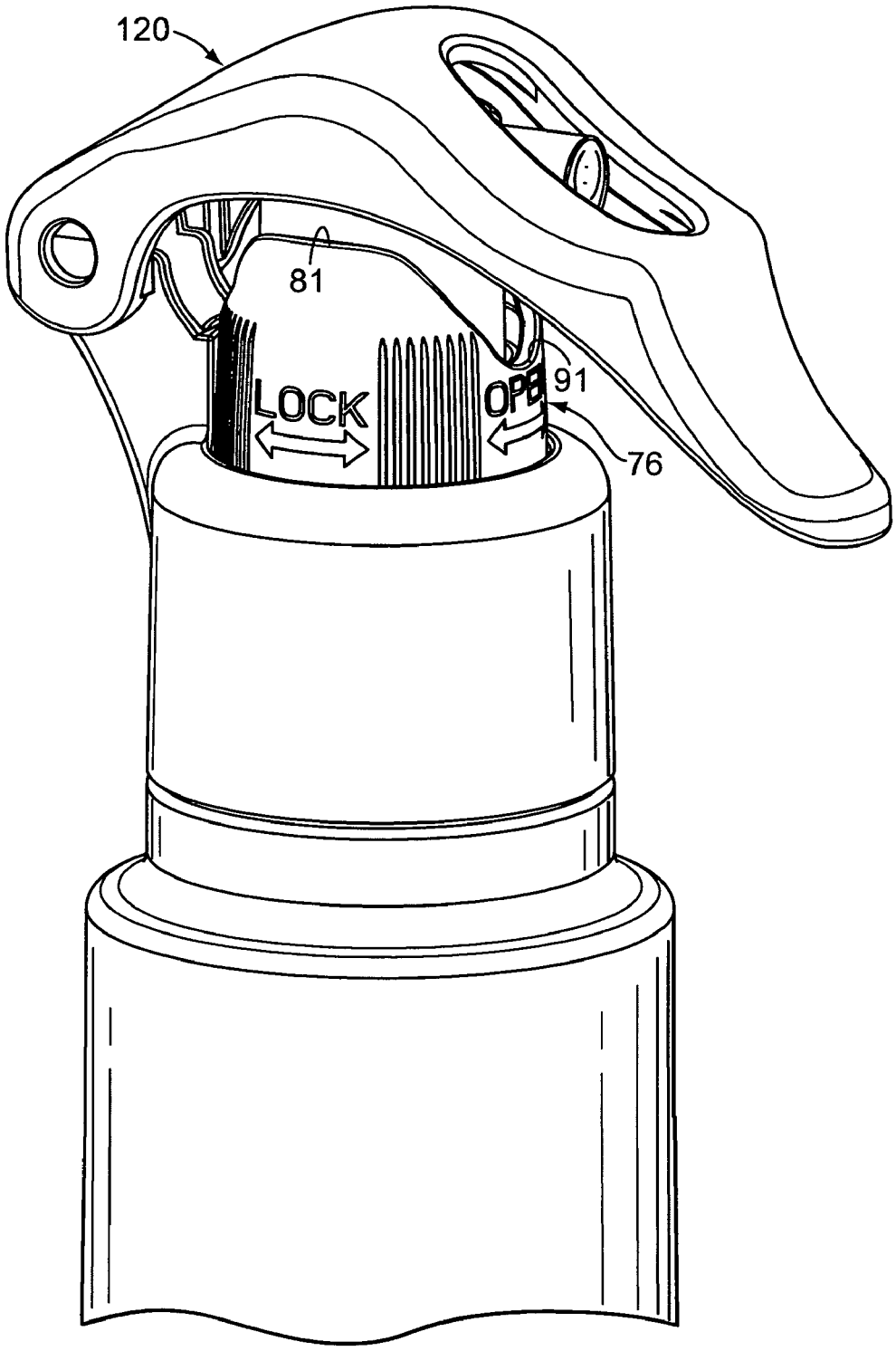
FIG. 9 is a fragmentary, perspective view of the package with the locking sleeve of the dispensing pump assembly rotated to an unlocked, actuatable position which permits the pump to be actuated.
Figure 10:
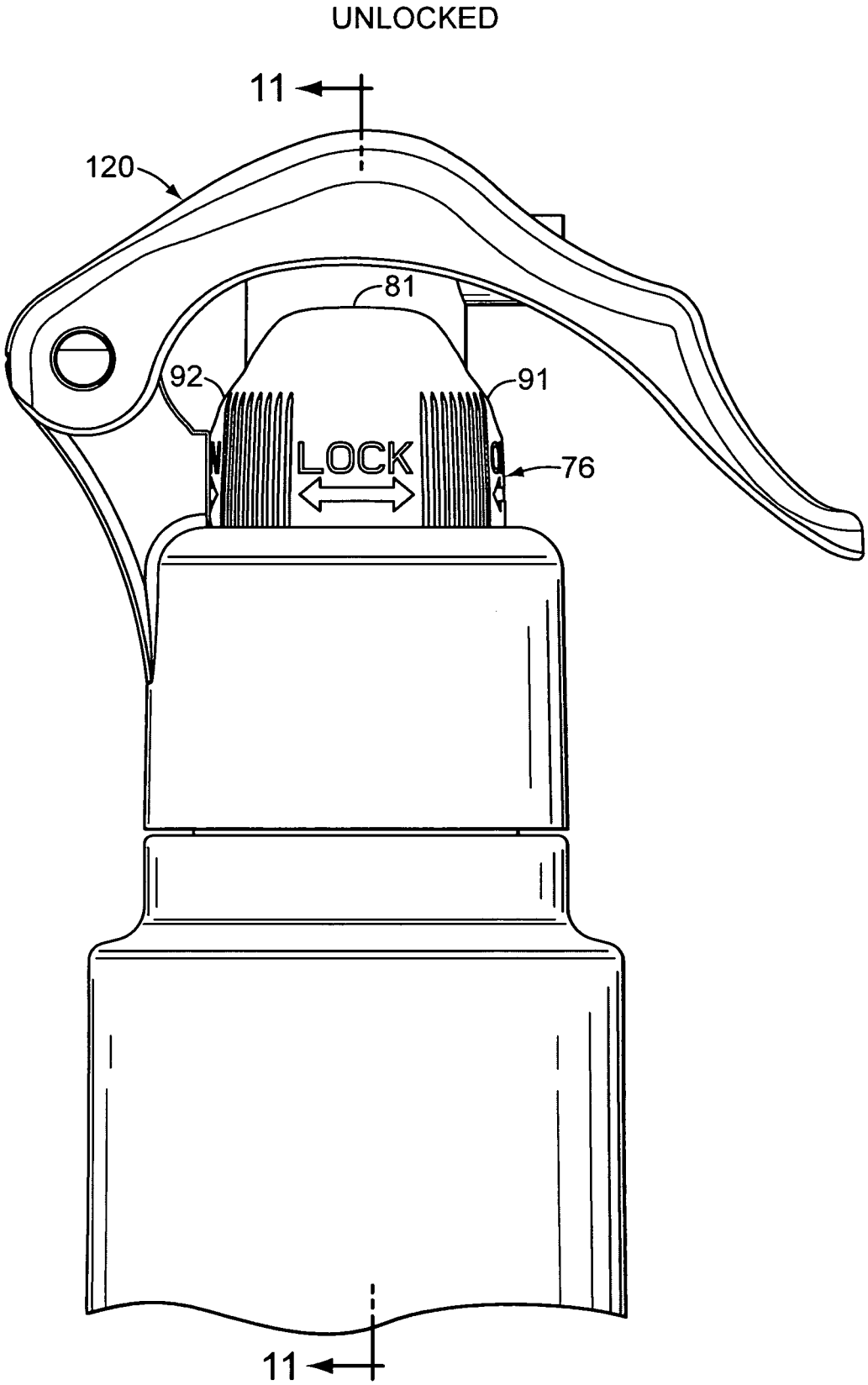
FIG. 10 is a fragmentary, side elevational view of the package in the unlocked condition as shown in FIG. 9.
Figure 11:
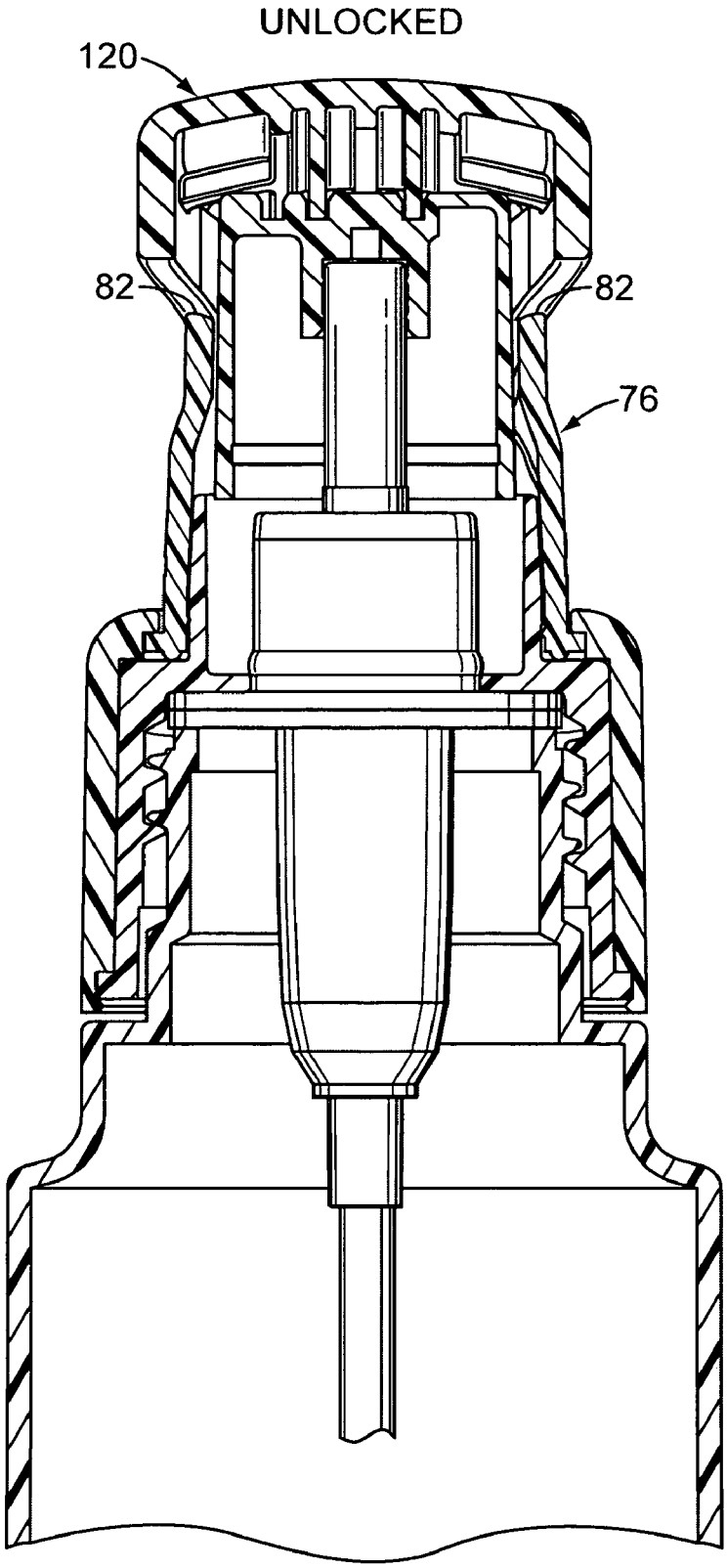
FIG. 11 is a fragmentary, cross-sectional view taken generally along the plane 11-11 in FIG. 10.

The locking sleeve 76 is releasably held in a locking orientation by engagement of the locking sleeve flange concave notches 98 (FIG. 2) with the housing interior tabs 114 (FIGS. 2-4). When the user wants to operate the pump to dispense the fluent material, the user simply needs to rotate the locking sleeve 76 in either the clockwise or counter-clockwise direction to bring one of the two locking sleeve recesses 91 and 92 (FIG. 2) underneath the actuator spout 45 to establish an unlocked condition (FIGS. 9-12). FIGS. 9, 10, and 12 show the recess 91 located in alignment below the actuator spout 45. As the user starts to rotate the locking sleeve 76 from the locked position (FIGS. 1 and 5) to the unlocked position (FIGS. 9 and 10), the user will note an initial tactile sensation of resistence as the user applies sufficient force to disengage the locking sleeve notches 98 (FIG. 2) from the housing tabs 114 (FIG. 2). When the locking sleeve 76 has been rotated 90 degrees to bring the locking sleeve notches 98 into engagement again with the housing tabs 114, the user will sense a decrease in resistance as the notches 98 receive the tabs 114.

In a preferred embodiment of the dispensing pump assembly, the user will hear an audible snapping or clicking sound as an indication that the unlocked (or locked) position has been reached. The tactile sensations of increased or decreased resistance, and the audible click or snap, can be achieved by manufacturing the dispensing pump assembly components (or at least one or both of the locking sleeve 76 and housing 100) from suitable materials that provide the necessary local, temporary, elastic deformation. Such materials are preferably those in the olefin family (e.g., polypropylene, polyethylene, etc.) or in the engineering grade plastics family (i.e., nylon, acetyl, etc.).

The preferred embodiment of the locking sleeve 76 preferably includes indicia that is located below each upper abutment edge 81 and 82, such as the word "LOCK" over a double headed arrow, to indicate to the user that the user can subsequently place the assembly into a locking, non-actuatable condition by rotating the locking sleeve 76 either clockwise or counter-clockwise.

In the illustrated preferred embodiment of the dispensing pump assembly of the present invention, the locking sleeve 76 has four rotational positions—a first rotated position for locking the pump, a second rotated position (90 degrees in a selected direction of rotation beyond the first rotated position) for unlocking the pump, a third rotated position (90 degrees beyond the second rotated position in the selected direction of rotation) for again locking the pump, and a fourth rotated position (90 degrees beyond the third rotated position in the selected direction of rotation) for again unlocking the pump.

In an alternate embodiment (not illustrated), the locking sleeve could be provided with only two rotated positions—a first rotated position for locking the pump assembly, and a second rotated position for unlocking the pump assembly. In such an alternate embodiment, the locking sleeve need be provided with only one upper abutment edge for engaging the underside of the spout 45 to prevent downward movement of the actuator 42, and need be provided with only one recess for accommodating downward movement of the actuator spout 45.

In yet another alternative embodiment (not illustrated), the locking sleeve 76 could be provided with more than four rotated positions if the locking sleeve 76 is modified to provide additional recesses and upper abutment edges.

In the preferred embodiment illustrated, the locking sleeve 76 provides the recesses (recesses 91 and 92) and the upper abutment edges (edges 81 and 82) in the upper periphery of the locking sleeve at equal, a 90 degree increments. However, In an alternate embodiment (not illustrated), the incremental spacing of the upper abutment edges 81 and 82 and of the recesses 91 and 92 need not be equal—although an unequal spacings and unequal rotational increments might be less "user friendly" if the package does not include clear markings or indicia identifying the various positions that could be selected.

Figure 15:
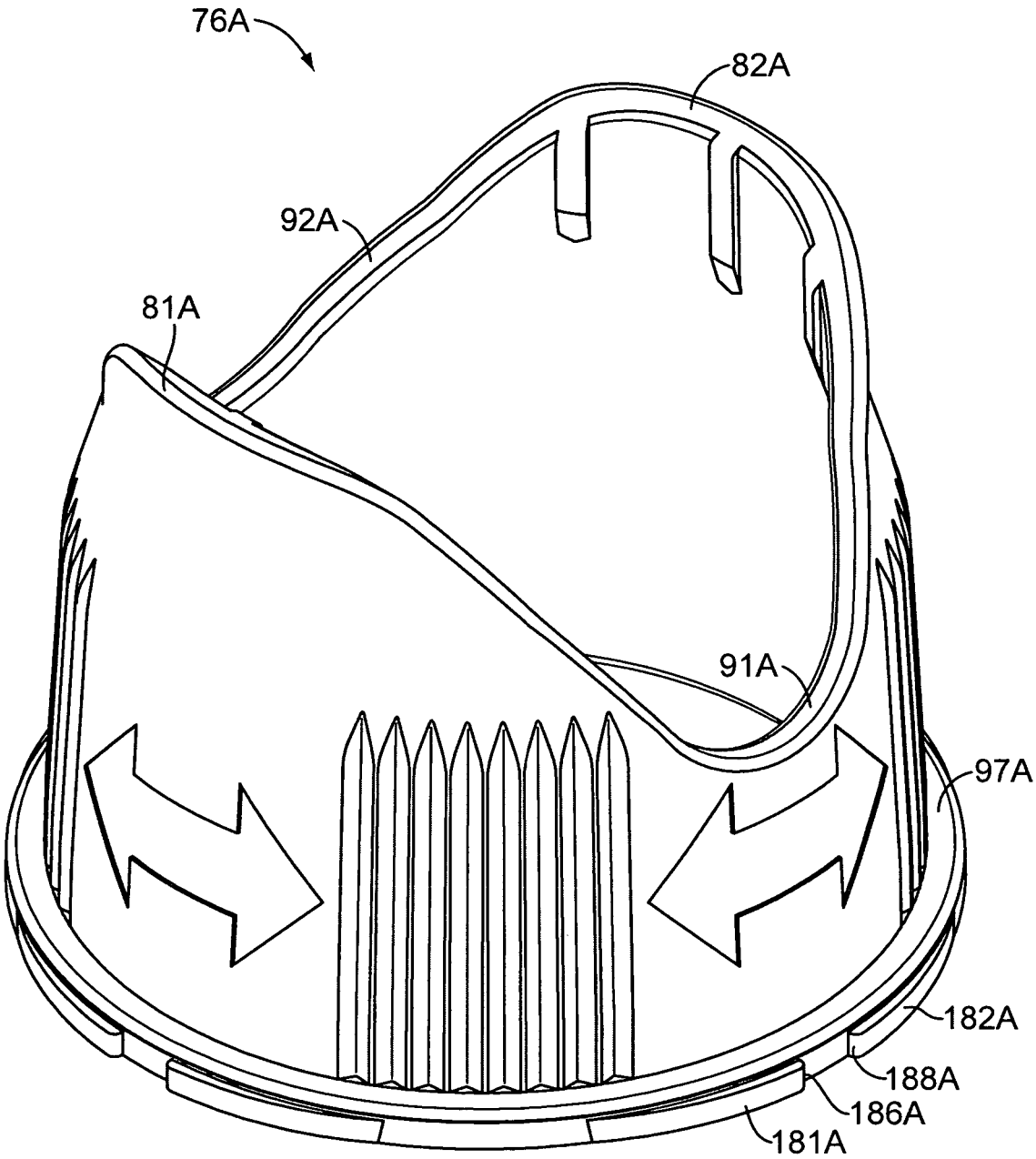
FIG. 15 is a perspective view of a modified form of the locking sleeve of a second embodiment of the dispensing assembly of the invention.
Figure 16:
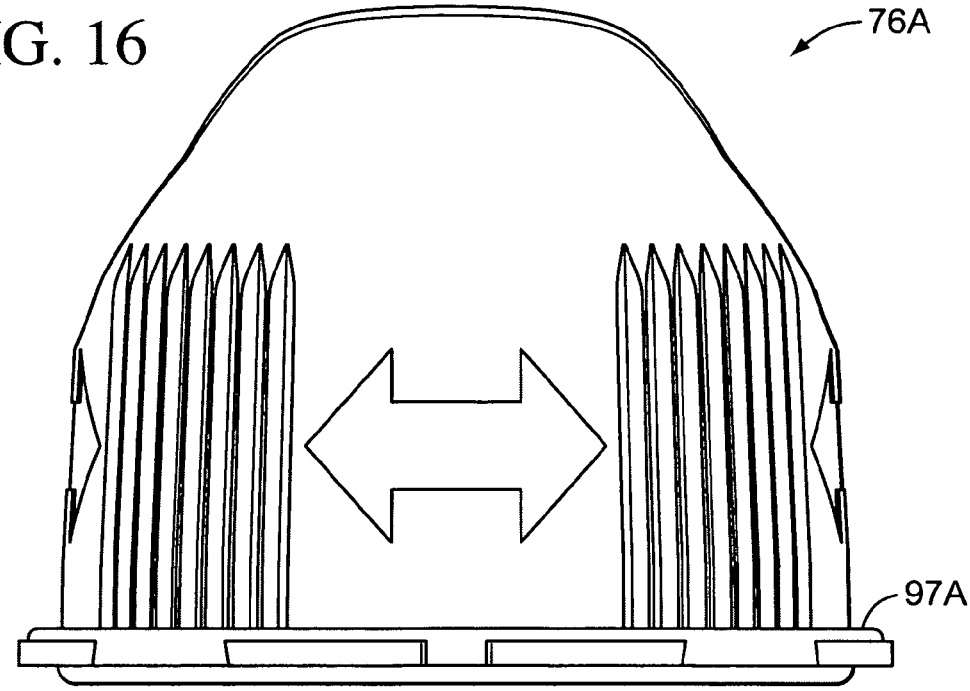
FIG. 16 is a side elevational view of the modified locking sleeve shown in FIG. 15.
Figure 17:
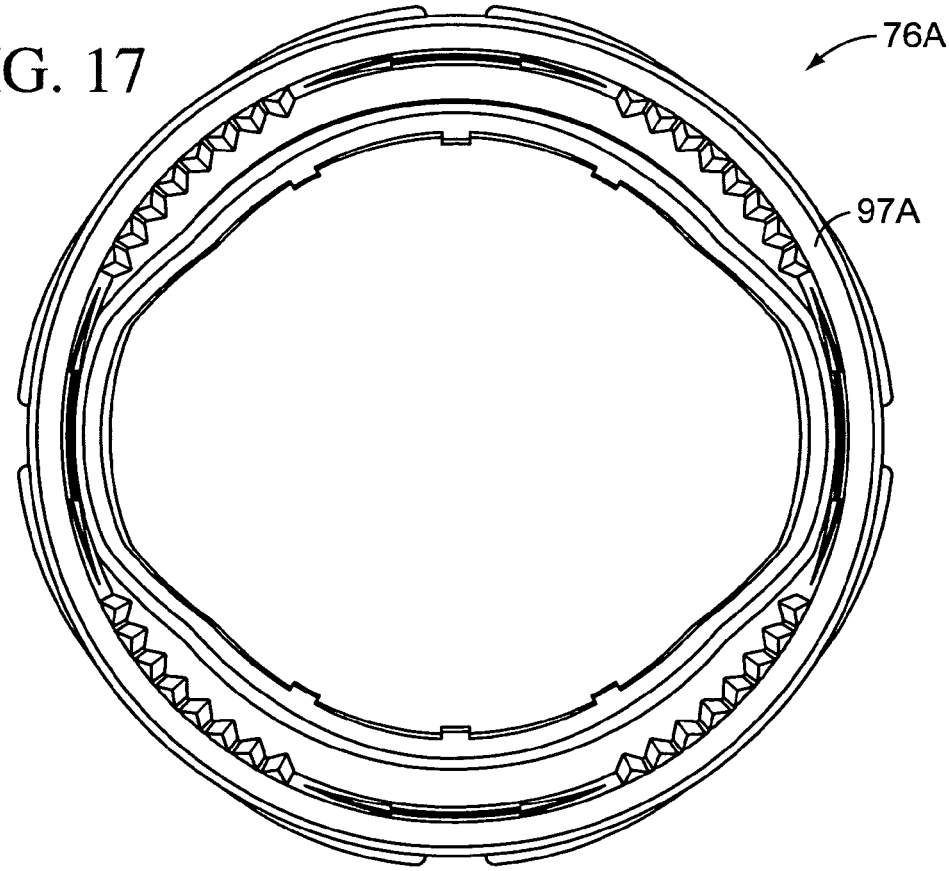
FIG. 17 is a top plan view of the modified locking sleeve shown in FIGS. 15 and 16.

FIGS. 15-17 illustrate a modification of the invention that can be advantageous in some applications. Specifically, this alternate design more readily accommodates small differences in dimensions of the locking sleeve 76 and/or housing 100 as the dimensions might vary from unit to unit. As previously described, in the first embodiment of the dispensing pump assembly, the locking sleeve flange notches 98 receive the housing tabs 114 (FIG. 2) at selected positions of relative rotation. As the user begins rotating the locking sleeve 76 to a next rotated position, the housing tabs 114 are moved out of the sleeve notches 98 and bear against the greater diameter surface of the locking sleeve bottom peripheral flange 97. This increases the engagement force between the housing 100 and the locking sleeve 76 compared to when the housing tabs 114 are received within the locking sleeve notches 98. With such a design, it is generally desirable to provide a substantially constant, predetermined engagement force between the housing tabs 114 and the cylindrical surface of the flange 97 between the notches 98. This can be generally achieved by providing an appropriate design relationship between the diameter of the exterior surface of the locking sleeve flange 97 and the diameter of the circle defined by the innermost tangent points of the convex surfaces of the housing tabs 114. That is, the housing tabs 114 should desirably have a radially innermost tangent point defining a circle that is slightly smaller than the diameter of the exterior surface of the locking sleeve flange 97.

However, it can be difficult to manufacture the locking sleeve 76 and the housing 100 with sufficiently small dimensional tolerances if the same manufacturing mold dimensions are used for the components regardless of the materials from which they are molded. For example, the manufacturer may wish to manufacture two or more styles of the dispensing pump assembly wherein one style has the locking sleeve 76 and/or housing 100 molded from one type of thermoplastic material, and wherein another style has the locking sleeve 76 and/or housing 100 molded form a second, different thermoplastic material.

The different thermoplastic materials may have different post-molding shrinkage characteristics. It has also been found that different post-molding shrinkage characteristics can be caused merely by using a different colorant in the same thermoplastic molding material. Some colorants cause more post-molding shrinkage than others. Thus, after the molded components have cooled, the final dimensions of a component molded from one material might differ from the final dimensions of the component molded from a different material. A greater or lesser shrinkage of the locking sleeve 76 and/or housing 100 molded from the first material compared to the shrinkage when molded from a second material can cause the force of engagement between the housing tabs 114 and the cylindrical surface of the locking sleeve flange 97 (between the notches 98) to be different (smaller or greater).

Thus, if the same mold is used to mold a particular component regardless of the type of molding material, the resulting post-molding dimensions can vary depending on the material, and this will result in a greater or lesser force of engagement between the locking sleeve 76 and housing tabs 114 as the locking sleeve is rotated between the "LOCKED" and "UNLOCKED" positions. Thus, a user of the components molded from one material might find that the force required to rotate the locking sleeve 76 is greater or smaller than the force required to rotate the locking sleeve 76 in an assembly wherein the components have been molded from a different material. Indeed, although the torque required by the user to rotate the locking sleeve 76 when molded from one material may well within a desired torque range, the torque required to rotate the locking sleeve 76 when molded form a second, different material, might fall well outside of the desired torque range (i.e., too hard to rotate or too loose).

The manufacturer typically would like to use only one mold for molding the locking sleeve 76 and only one other mold for molding the housing 100. The manufacturer does not want to use a number of different size molds for the locking sleeve 76 depending upon the type of thermoplastic material being used or depending upon the colorant being added to the thermoplastic material. Similarly, the manufacturer typically wants to use only one mold for molding the housing 100—regardless of the type of thermoplastic material being used or the type of colorant being added to the thermoplastic material.

The alternate embodiment illustrated in FIGS. 15-17 permits the manufacturer to mold the locking sleeve 76 from different thermoplastic materials (having different shrinkage characteristics) by using only one mold, and to mold the housing 100 from different thermoplastic materials (having different shrinkage characteristics) with only one mold. The alternate embodiment provides a unique structure for accommodating the varying shrinkage characteristics while still providing an assembly wherein larger and smaller diameters of the engaging portions of the components can be accommodated without adversely affecting the user's operation of the locking sleeve.

In the alternate embodiment illustrated in FIGS. 15-17, a locking sleeve 76A has a modified design compared to the locking sleeve 76 described above with reference to the first embodiment illustrated in FIGS. 1-14. The modified locking sleeve 76A is intended to be used with the housing 100 and other components described above with reference to the first embodiment illustrated in FIGS. 1-14. The modified locking sleeve 76A is similar to the first embodiment locking sleeve 76. The modified locking sleeve 76A includes a first upper engaging edge 81A, a second upper engaging edge 82A, a first recess 91A, and a second recess 92A. These features function in the same manner as corresponding features on the first embodiment locking sleeve 76 as described above.

The modified locking sleeve 76A includes a radially outwardly extending peripheral flange 97A adjacent the locking sleeve bottom end. Unlike in the first embodiment locking sleeve 76, the modified locking sleeve 76A does not have notches per se formed as recesses within the flange 97A. Rather, the locking sleeve 97A includes four pairs of spaced-apart ramps, and FIG. 15 shows one of the pairs of ramps comprising a first ramp 181A and a second ramp 182A. Each ramp has a long sloping, slightly curved surface. The first ramp 181A also includes a shorter, steeper, slanted retention wall 186A, and the second ramp 182A also includes a shorter, steeper, slanted retention wall 188A. The retention wall 186A is spaced from the retention wall 188A.

The space between the walls 186A and 188A is designed to accommodate an inwardly projecting, convex tab 114 (FIG. 4) on the inside of the housing 100 when the locking sleeve 76A is rotated to one of the two, predetermined, locked positions or two, predetermined, unlocked positions. The outer, peripheral, cylindrical surface of the flange 97A between the two retention walls 186A and 188A is designed to have a sufficiently small diameter that will accommodate the inward projection of a housing tab 114. The innermost point on the convex tab 114 may slightly engage the outer surface of the flange 97A between the retention walls 186A and 188A, but need not actually contact the outer surface of the flange 97A.

Significant dimensional tolerances can be accommodated. That is, the locking sleeve 76A could be molded from a variety of materials having different shrinkage rates wherein the exterior peripheral diameter of the cylindrical surface of the flange 97A can vary somewhat depending on the material from which the locking sleeve 76A is molded (including depending upon the colorant material which could be added to the molding material). Each retention wall 186A and 188A projects radially outward a significant amount, and each housing tab 114 projects radially inwardly a significant amount. When the components are in one of the two "locked" positions or one of the two "unlocked" positions, there is sufficient interference between the inwardly projecting tabs 114 and the outwardly projecting retention walls 186A and 188A so as to provide a significant resistance to rotation in one direction or the other. The user must apply a sufficient torque to the locking sleeve 76A (in one direction or the other) in order to move one of the retention walls (186A or 188A, depending on the direction of rotation) past the engaged housing tab 114.

When sufficient torque is exerted by the user, the sleeve locking 76A and/or housing 100 will undergo temporary, elastic deformation so that the locking sleeve retention wall (186A or 188A) can move past the housing tab 114. The long sloping side of the ramp (181A or 182A) will then engage the innermost point of the adjacent housing tab 114 as the locking sleeve 76A is rotated further away from the initial locked or unlocked position.

Upon further rotation of the locking sleeve 76A, the exterior cylindrical surface of the flange 97A adjacent the two tapered, merging ends of the long ramps moves adjacent the housing tab 114. Depending upon the diameter of the flange 97A (as determined by the final shrinkage of the thermoplastic molding material from which the locking sleeve 76A has been molded), the adjacent housing tab 114 may or may not engage the exterior cylindrical surface of the flange 97A. Whether or not there is any engagement resistance, the user will clearly notice that the resistance torque is markedly decreased from the resistance torque experienced when initially rotating the locking sleeve 76A to move the steep retention wall (186A or 188A) and long, sloping ramp past the housing tab 114. As the user continues to rotate the locking sleeve 76A further in the same direction of rotation, the next long ramp begins to engage, or more forcefully engage, the housing tab 114. The engagement resistance increases until the housing tab 114 again snaps into the space between the next pair of ramp retention walls. This tactile sensation is an indication to the user that the next predetermined rotational position (locked or unlocked) has been reached. In the most preferred embodiment, the components snap into the predetermined position with an audible click to further signify that the next predetermined position has been reached.

The above-described modified locking sleeve 76A thus can accommodate diametrical differences in the locking sleeve flange 97A and/or in the diameter of the housing 100. The amount of dimensional tolerance that can be accommodated is determined, in large part, by the distance that the housing tabs 114 project inwardly and by the distance that the ramp retention walls (186A and 188A) project radially outwardly.

Figure 18:
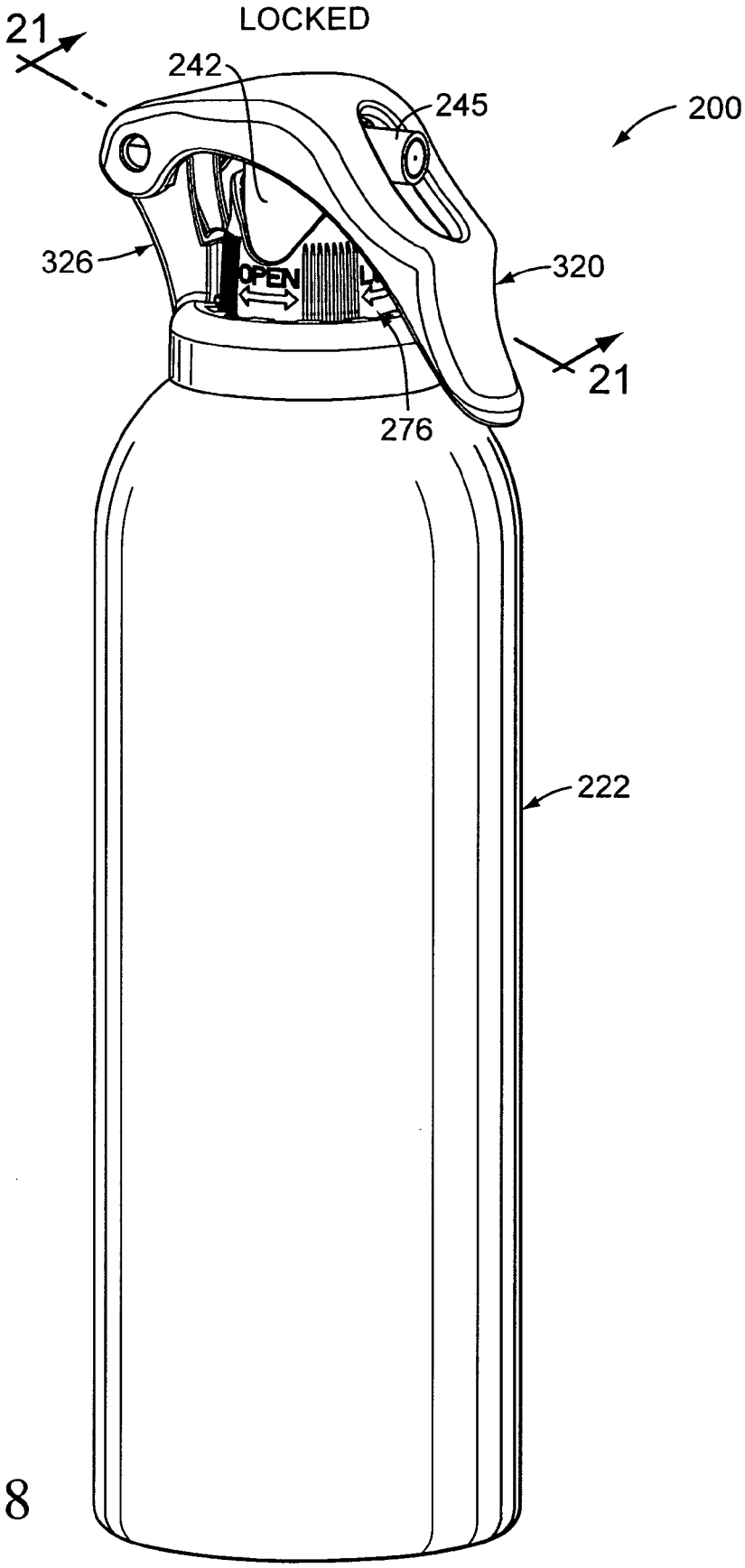
FIG. 18 is a perspective view of a preferred third embodiment of a hand-operable dispensing package incorporating the dispensing assembly of the present invention in the form of an aerosol dispensing assembly (i.e., including an aerosol dispensing valve), and the package is shown with the aerosol dispensing assembly in an unactuated, but releasably locked, condition prior to use.
Figure 19:
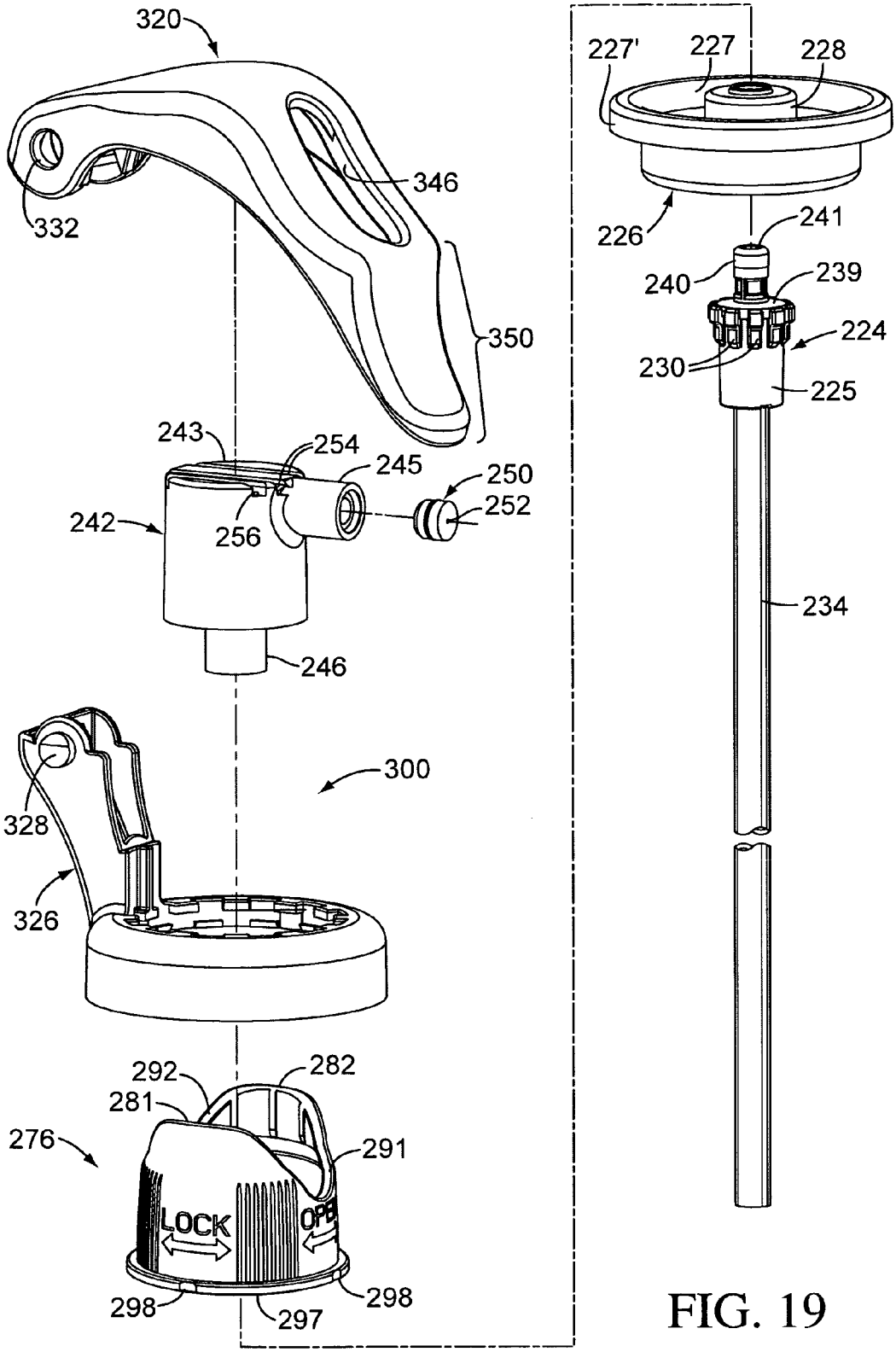
FIG. 19 is an exploded, perspective view of the aerosol dispensing valve assembly used in the package illustrated in FIG. 18.
Figure 21:
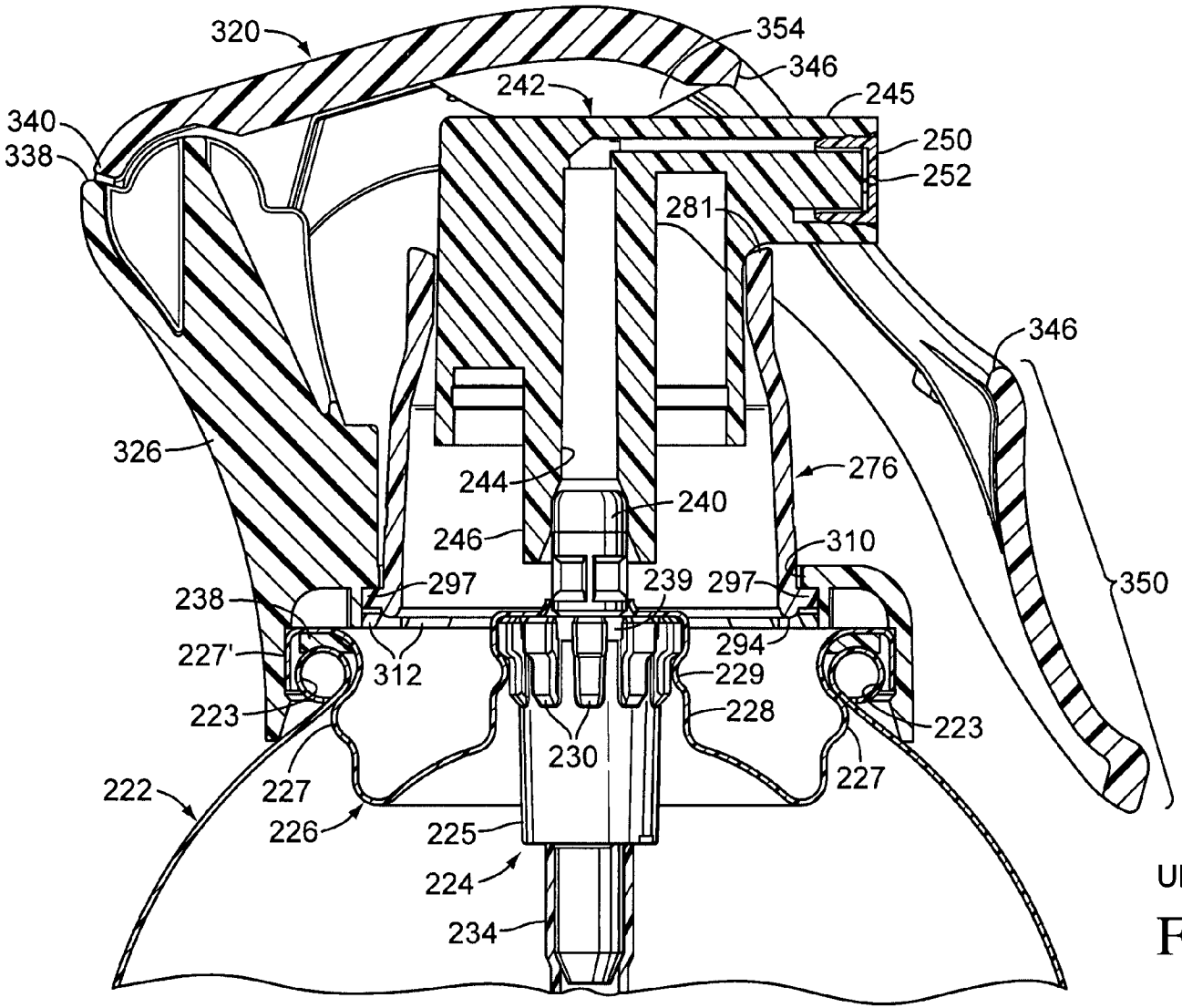
FIG. 21 is a fragmentary, cross-sectional view taken generally along the plane 21-21 in FIG. 18.

The above-described locking system may be adapted for use with a package that has an aerosol dispenser cartridge (i.e., an aerosol dispensing valve) rather than a pump dispenser (e.g., the pump dispenser 24 described above with reference to FIGS. 1-17). FIG. 18 illustrates a package 200 employing an embodiment of the hand-operable dispensing assembly of the present invention in which the assembly is in the form of an aerosol dispensing assembly that includes an aerosol dispenser cartridge in the form of an aerosol dispensing valve 224 (FIGS. 19 and 21) installed on a container 222 (FIGS. 18 and 21). FIG. 19 illustrates a typical aerosol dispensing valve 224 that may be employed as part of the assembly on the container 222 and which is adapted to be mounted in the mouth of the container 222.

The container 222 is typically a metal can having an upper edge rolled into a mounting bead 223 (FIG. 21). The container 222 is adapted to hold a product (e.g., a liquid (not shown)) below the aerosol dispensing valve 224. The aerosol dispensing valve 224 has a body 225 (FIGS. 19 and 21). A part of the aerosol dispensing valve body 225 typically extends into the container opening.

The aerosol dispensing valve 224 (i.e., aerosol dispenser cartridge) may be of any suitable conventional or special type. With a typical conventional aerosol dispensing valve 224, the bottom end of the aerosol dispensing valve body 225 is attached to a conventional dip tube 234 (FIGS. 19 and 21), and the upper end of the aerosol dispensing valve 224 projects above the top of the container 222 (FIG. 21).

The aerosol dispensing valve 224 is mounted to the container 222 by suitable means. One such suitable means is a conventional valve mounting cup 226 (FIGS. 19 and 21) which has a mounting flange 227 with an outer peripheral portion 227' (FIG. 19) which can be crimped about the container mouth bead 223 and an overlying gasket 238 as shown in FIG. 21 to provide a secure attachment of the mounting cup 226 to the top of the container 222.

The mounting cup 226 includes an annular inner wall 228 (FIG. 21) which defines an opening through which a portion of the aerosol dispensing valve 224 projects. The mounting cup annular inner wall 228 includes crimp 229 (FIG. 21) for engaging an exterior portion of castellations or ribs 230 on the exterior of the body 225 of the aerosol dispensing valve 224.

The valve mounting cup 226 may be more generally characterized as a fitment or closure for securing the aerosol dispensing valve 224 in the container 222, and the more general term "closure" is used in some of the appended claims wherein it may be understood that the term "closure" has a meaning broad enough to encompass, inter alia, either an aerosol dispensing valve mounting cup (e.g., the cup 226) or a dispensing pump cartridge closure (e.g., the closure 26 for mounting a dispensing pump cartridge to a container described above with reference to FIGS. 2 and 6).

The body 225 of the aerosol dispensing valve or dispenser cartridge 224 defines an interior chamber (not visible). In a typical aerosol dispensing valve 224, the body 225 of the cartridge or valve 224 is hollow and has a bottom end which is open (through the attached dip tube 234) to the pressurized contents in the container 222. The container 222 typically holds a liquid product which is pressurized by a propellent gas.

Projecting out of the top end of the aerosol dispensing valve body 225 is a stem 240. A compression spring (not visible) in the aerosol dispensing valve body 225 biases the stem 240 upwardly to project out of the opening defined at the inside of an annular gasket 239 (FIGS. 19 and 21) at the top of the body 225 of the aerosol valve 224. The upper part of the stem 240 includes an internal vertical discharge hole 241 (FIG. 19) that is open at the upper end of the stem 240 and that is connected to an external actuator button 242 (FIGS. 19 and 21) which is mounted on the upper end of the stem 240. Below the upper end of the stem 240, the stem 240 has one or more lateral orifices (not visible) which communicate with the vertical discharge hole 241 in the upper part of the stem 240. Until the actuator button 242 is depressed, the lateral orifices (not visible) in the stem 240 are located adjacent the inside surface of the annular gasket 239 (FIGS. 19 and 21) at the top of the body 225 of the aerosol dispensing valve 224. When the actuator button 242 is depressed, the stem 240 is forced downwardly against the spring (not visible inside the aerosol valve body 225) so as to re-position the lateral orifices (not visible) into the body below the gasket 239 (FIGS. 19 and 25), and this permits the pressurized fluid from the container 222 to flow up the dip tube 234, through the body 225 of the aerosol valve 224, through the orifices into the bore 241 in the stem 240, and out of the actuator button 242.

After the aerosol dispensing valve 224 is actuated to dispense product as atomized spray, the user terminates the actuation operation so that the aerosol dispensing valve components are returned by the internal spring (not visible) to the elevated, rest condition (FIGS. 1 and 21) wherein the valve 224 is closed.

It will be appreciated that the particular design of the aerosol dispenser cartridge (i.e., aerosol dispensing valve) 224 may be of any suitable design for dispensing a product from the container 222 (with or without a suction tube 234) and out through the stem 240. The detailed design and construction of the dispenser cartridge or aerosol dispensing valve 224 per se forms no part of the present invention except to the extent that the aerosol dispensing valve 224 is adapted to be suitably mounted and held on the container 222 with a suitable mounting system and to the extent that the valve 224 includes a outwardly projecting stem (e.g., stem 240) from which product is discharged when the valve 224 is actuated.

The actuator or button 242 defines a discharge passage 244 (FIG. 21) through which the product from the stem 240 is discharged. The discharge passage 244 extends from an internal sleeve 246 defining an inlet cavity into which the upper terminal end or distal end of the stem 240 can be press-fit. The outer portion of the discharge passage 244 is defined in a laterally projecting nozzle or spout 245 (FIGS. 18, 19, and 21). The outer end portion of the discharge passage 244 has an annular configuration into which can be press-fit a conventional mechanical breakup unit or spray insert 250 (FIGS. 19 and 21) which has an exit orifice 252 (FIGS. 19 and 21).

The actuator 242 has a top end defining a force-bearing actuation region 243 (FIG. 19) which includes two spaced-apart, linear, parallel grooves 54 located next to an assembly orientation groove 256. As with grooves 54 in the pump dispenser actuator 42 described above with reference to FIGS. 1-14, the two grooves 254 are adapted to receive portions of a trigger structure that is operated by the user to move the actuator 242 and stem 240 downwardly in the aerosol dispensing valve 224 to dispense fluid from the valve 224. The pressurized fluid in the container 222 exits as a fine mist spray from the nozzle orifice 252 in the nozzle or spout 245. Inside the aerosol dispensing valve 224, the spring (not visible) acts against the bottom end of the stem 240 inside the aerosol dispensing valve 224 to bias the stem 240, and upwardly to locate the actuator 242 at the elevated rest position (FIGS. 18 and 21) when the actuating force (operating force) on the actuator actuation region 243 is released. Thus, after the aerosol dispensing valve or cartridge 224 is actuated to dispense a liquid product as an atomized spray, the user terminates the actuation operation so that the components are returned by the internal spring to the elevated, rest condition (FIGS. 18 and 21).

A lock or locking sleeve 276 is rotatably mounted around both the aerosol dispensing valve stem 240 and actuator 242. The locking sleeve 276 is substantially identical with the first embodiment locking sleeve 76 described above with reference to FIGS. 1-14. The locking sleeve 276 defines a first upper engaging edge 281 and a second upper engaging edge 282. The locking sleeve also defines a first recess 291 and a second recess 292 (FIG. 19). In the preferred embodiment illustrated, the two upper abutment edges 281 and 282 are 180 degrees apart, and the two recesses 291 and 292 are 180 degrees apart. In an alternate embodiment (not illustrated), the locking sleeve 276 may have only one upper abutment edge and only one recess. In still another alternate embodiment (not illustrated), the locking sleeve 276 may have three or more upper abutment edges and three or more recesses.

In the preferred embodiment illustrated, the locking sleeve 276 has a bottom end defined by a rounded bead 294 (FIG. 21). As can be seen in FIGS. 19 and 21, the locking sleeve 276 includes a radially outwardly extending peripheral flange 297 adjacent the locking sleeve bottom end. The flange 297 defines four arcuate notches 298 (FIG. 19) which are spaced circumferentially at 90 degree increments.

Figure 20:
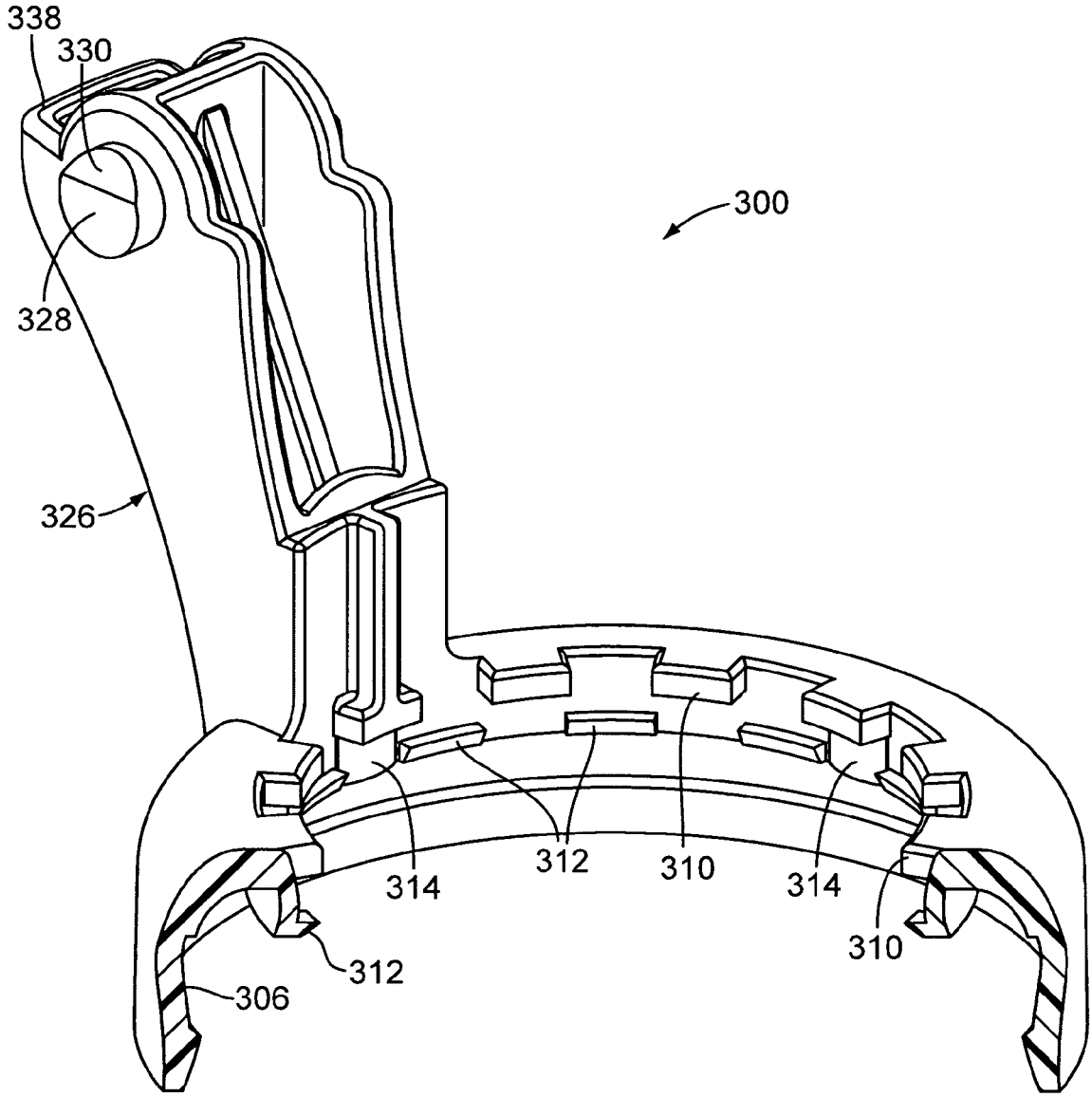
FIG. 20 is a perspective view of the exterior fixed sleeve (i.e., housing) of the aerosol dispensing assembly shown in FIG. 18, but FIG. 20 shows a portion broken away to illustrate interior details.

The aerosol dispensing valve assembly includes a fixed exterior sleeve or housing 300 (FIGS. 19, 20, and 21). As shown in FIG. 21, the fixed sleeve or housing 300 is adapted to be disposed around a lower portion of the locking sleeve 276. The housing 300 has an open bottom end. The housing 300 defines an internal annular groove 306 (FIG. 20) that is adjacent the housing bottom end and that faces radially inwardly for receiving the outer peripheral portion 227' of the valve mounting cup flange 227 in a snap-fit engagement to retain the housing 300 on the cup 226 as shown in FIG. 21.

As can be seen in FIG. 21, the housing 300 has an open, upper end that receives the locking sleeve bottom end and the locking sleeve peripheral flange 297. As can be seen in FIGS. 19 and 21, the upper end of the housing 300 has a plurality of spaced-apart, radially inwardly projecting upper retention lips 310. The housing 300 also as a plurality of inwardly projecting lower retention lips 312 (FIGS. 19 and 21) which are located at an elevation below the upper retention lips 310. The lower retention lips 312 define a segmented shelf, and the shelf segments or lips 312 are vertically aligned with the spaces between the upper retention lips 310. As can be seen in FIG. 21, the housing lips 310 and 312 engage the outwardly extending peripheral flange 297 of the locking sleeve 276 so as to retain the locking sleeve 276 around stem 240 and actuator 242.

With reference to FIG. 20, it can be seen that the interior of the housing 300 includes four spaced-apart arcuate tabs 314 (only two of which are visible in FIG. 20). Each tab 314 is convex and projects radially inwardly. Each tab 314 is adapted to be received in a notch 298 in the flange 297 of the locking sleeve 276 when the locking sleeve 276 is rotated to any of four possible alignment positions relative to the housing 300. The housing acuate tabs 314 and the locking sleeve flange arcuate notches 298 function together to provide interengageable features that define selected positions of relative rotational alignment between the locking sleeve 276 and the housing 300. The tabs 314 and notches 298 also permit or accommodate rotation of the locking sleeve 276 (relative to the housing 300) between (1) at least one unlocked actuatable position corresponding to a rotated position of the sleeve 276 and (2) at least one releasably locked position corresponding to another rotated position of the sleeve 276 as explained in more detail hereinafter. Each sleeve notch 298 functions for releasably holding a housing tab 314 in a releasable detent engagement to releasably hold the locking sleeve 276 selectively in one of two or more rotated positions corresponding to locked and unlocked conditions relative to the operation of the dispensing aerosol valve assembly.

Figure 22:
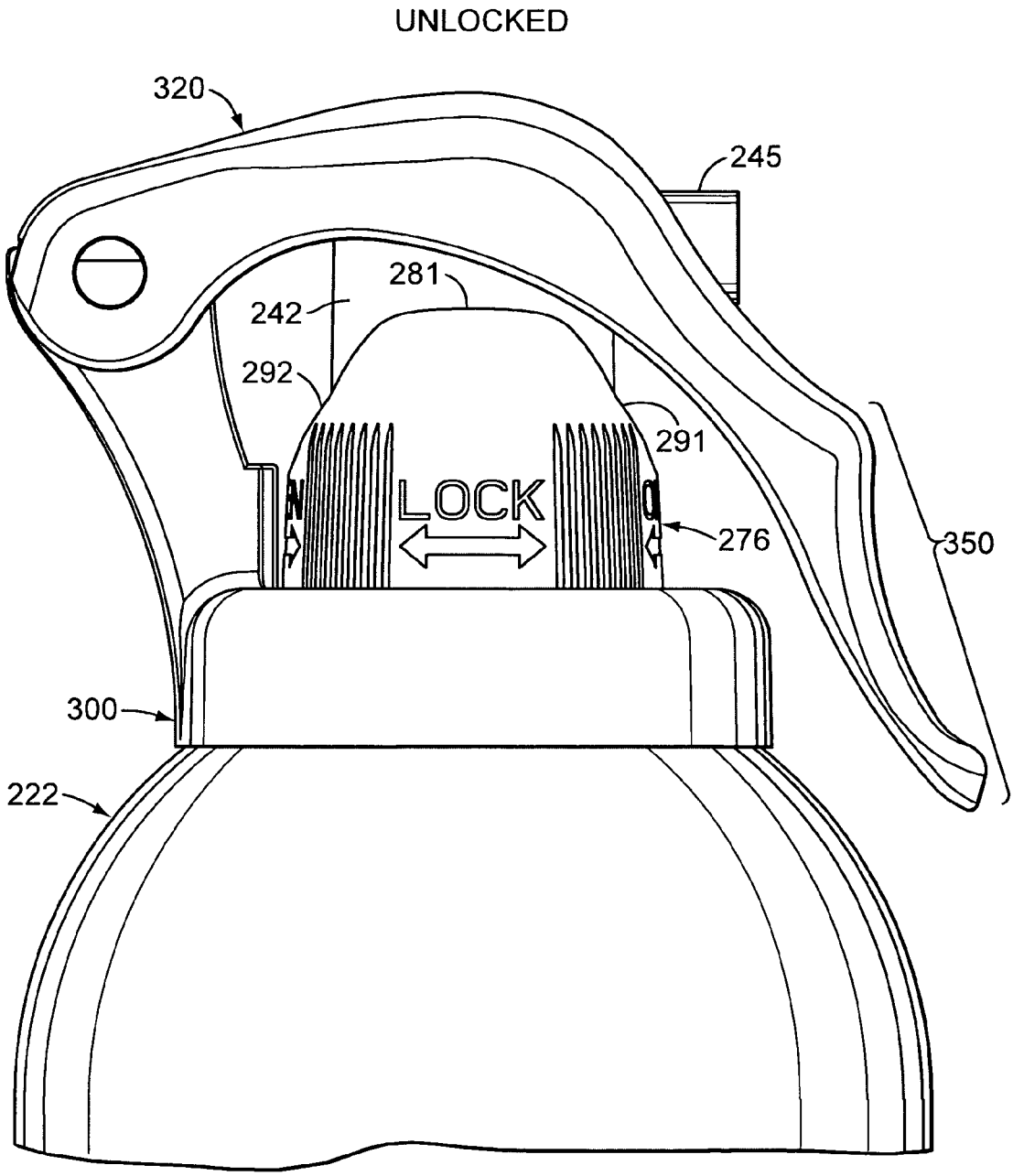
FIG. 22 is a fragmentary, side elevational view of the package in the unlocked condition.
Figure 24:
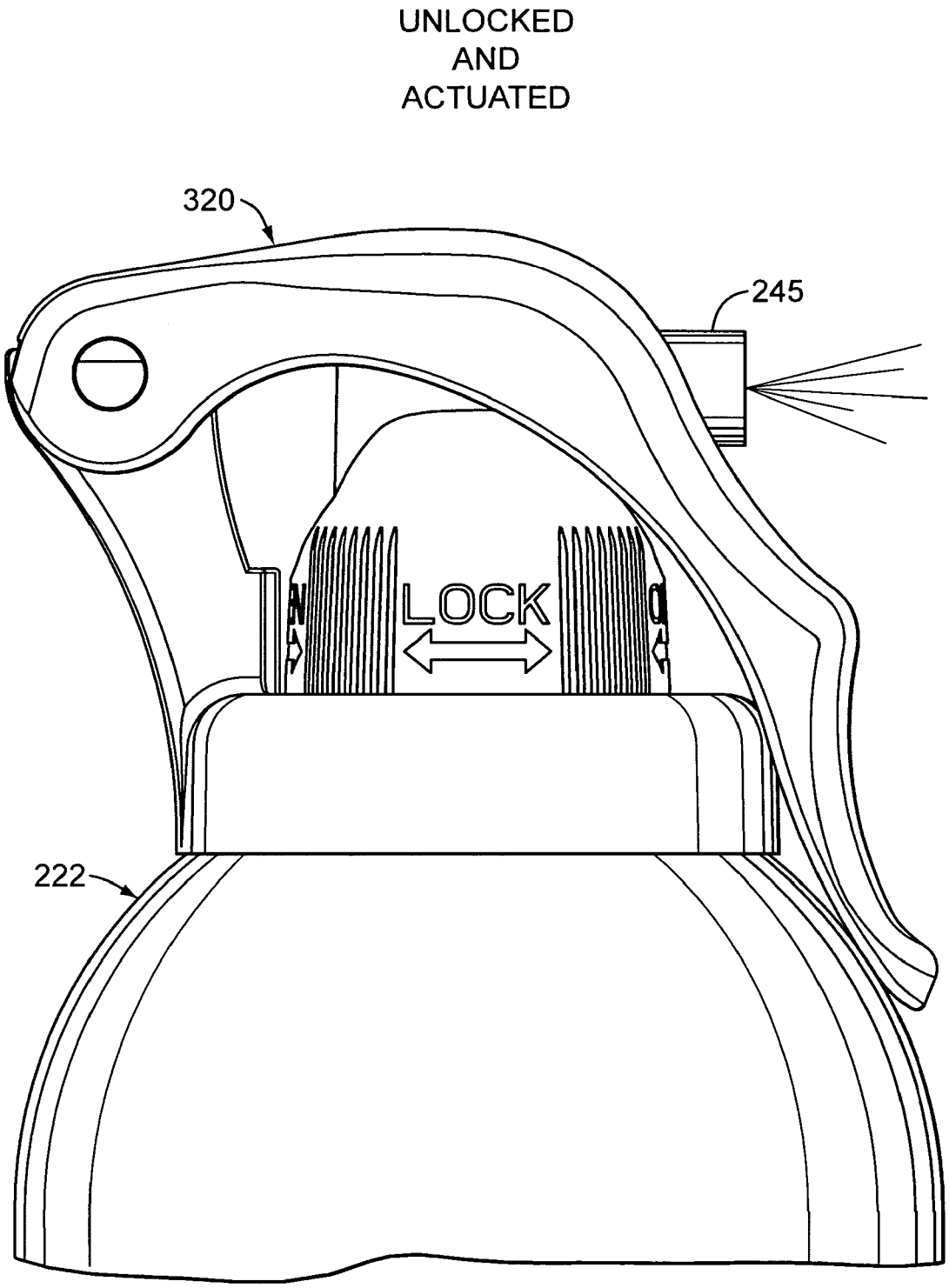
FIG. 24 is a fragmentary, side elevational view similar to FIG. 22, but FIG. 24 shows the trigger in a depressed position on the unlocked package to effect actuation of the aerosol dispensing assembly with consequent discharge of a spray of fluent material.

In the preferred form of the present invention, the actuator or button 242 is preferably operated by a lever or trigger 320 (FIGS. 18 and 21) which can be pulled by the user against the top of the actuator or button 242 to force the button 242 downwardly (compare FIG. 22 and FIG. 24). To this end, the aerosol dispensing valve assembly includes a trigger support 326 (FIGS. 18 and 19) which projects from the housing 300 rearwardly of the actuator spout 245. The trigger 320 and trigger support 326 have structures which are substantially identical with the first embodiment trigger 120 and trigger support 126, respectively, described above with reference to FIGS. 1-14. The trigger support 326 includes a pair of spaced-apart, outwardly projecting stub shafts 328 (one of which is visible in FIG. 19). Each stub shaft 328 has a slanted upper surface 330 (FIG. 20) providing a chamfered design to accommodate installation of the trigger 320 on the trigger support 326.

As can be seen in FIG. 19, the trigger 320 has a rear end portion defining a pair of spaced-apart bores 332 (only one of which is visible in FIG. 19). Each bore 332 is adapted to receive one of the trigger support stub shafts 328 to provide a pivotal mounting of the trigger 320 on the trigger support 326. As can be seen in FIGS. 20 and 21, the upper end of the trigger support 326 defines a upwardly facing horizontal ledge or stop surface 338. As can be seen in FIG. 21, the ledge or stop surface 338 lies under, and adjacent, a rear wall 340 of the trigger 320 to prevent the trigger 320 from being rotated in a counter-clockwise direction beyond the position shown in FIG. 21.

The front portion of the trigger 320 defines an elongate opening, hole, or aperture 346 which is located partly around the actuator spout 245 to accommodate dispensing a fluent material from the spout 245 through the aperture 346.

As illustrated in FIGS. 19 and 21, the front end portion of the trigger 320 defines a finger-grippable lever portion 350 which can be grasped by the user's fingers for pulling or squeezing the trigger 320 downwardly against the top of the actuator or button 242.

The underside of the trigger 320 includes a cam structure for engaging the force-bearing actuation region 243 at the top end of the actuator or button 242. This cam structure is substantially identical with the can structure employed in the first embodiment trigger 120 described above with reference to FIGS. 1-14. Specifically, and with reference to FIG. 21, the underside of the trigger 320 includes two spaced-apart, linear cam ribs 354 (only one of which is visible in FIG. 21). The cam ribs 354 are each aligned generally parallel to the actuator spout 245 and are each adapted to be received in one of the grooves 254 in the top of the actuator 242.

FIGS. 18 and 21 show the aerosol dispensing valve assembly in an unactuated, but locked condition. As can be seen in FIG. 18, the user can look at the side of the package to view the locking sleeve 276 which is preferably provided with appropriate indicia, such as the word "OPEN" over a double-headed arrow which is clearly visible and which prompts the user to rotate the locking sleeve 276 in either a clockwise or counter-clockwise direction in order to place the system in an "open" condition which will permit actuation of the aerosol valve by pulling down on the lever 350 of the trigger 320.

When the aerosol dispensing valve is locked as shown in FIG. 21, one upper abutment edge (e.g., edge 281 in FIG. 21 is positioned directly under the laterally extending spout 245 which is at its maximum elevation as result of the aerosol valve internal spring (not visible) biasing the stem 240 (FIG. 21) upwardly to locate the actuator 242 at the upper, unactuated, rest position (the maximum height of which is determined by the engagement of the top of the actuator 242 with the trigger camming ribs 354 that are prevented from any further upward movement by the engagement of the trigger rear wall 240 with the trigger support restraint ledge 338 (FIG. 21)).

If the user tries to pull the trigger 320 downwardly, the underside of the actuator spout 245 engages the upper abutment edge (edge 281 in FIG. 21) to prevent downward movement of the trigger 320, and hence, to prevent actuation of the aerosol dispensing valve assembly.

Figure 23:
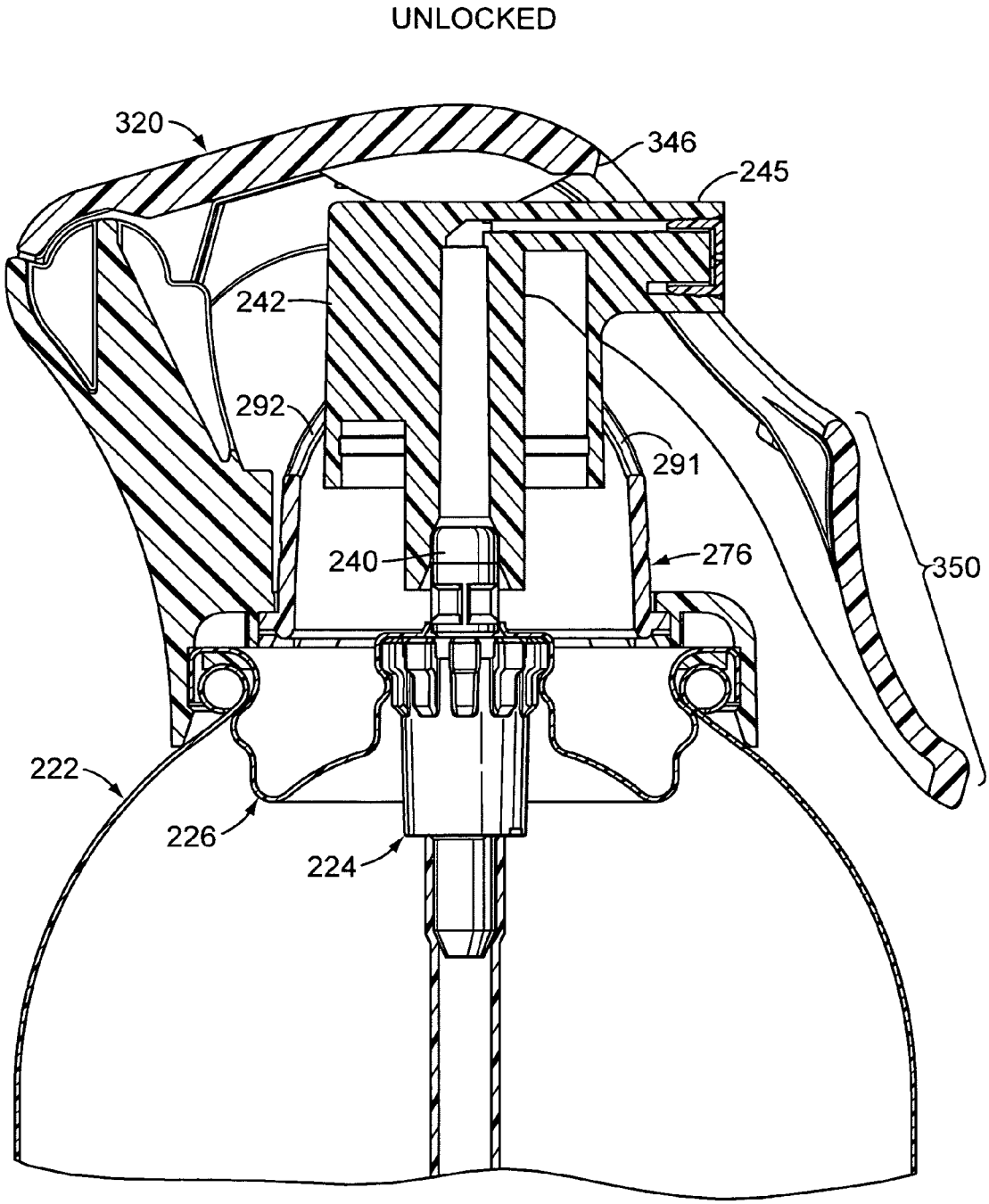
Figure 25:
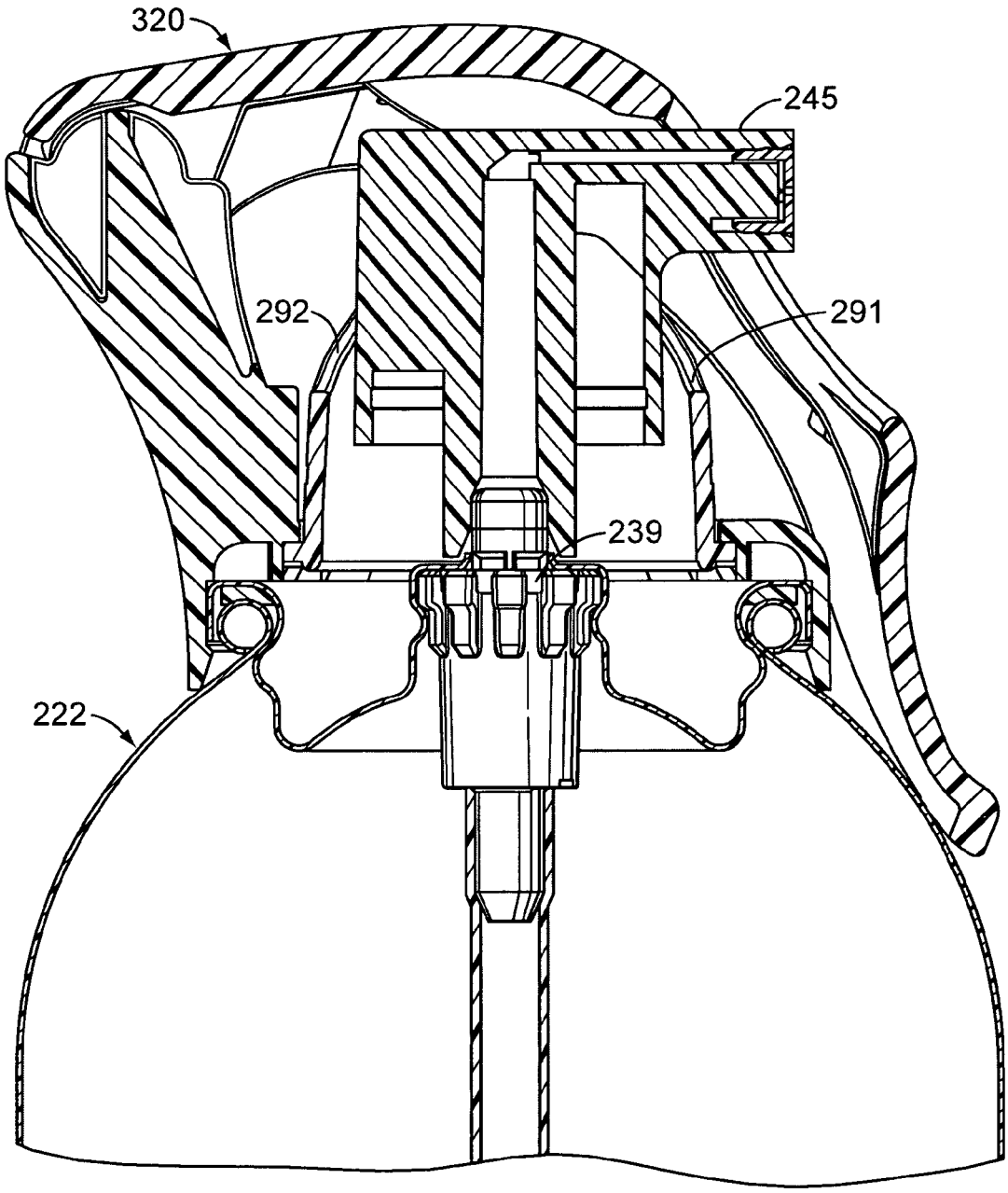
FIG. 25 is a fragmentary, cross-sectional view similar to FIG. 23, but FIG. 25 shows the trigger depressed as in FIG. 24 on the unlocked package to actuate the assembly to dispense the fluent material in an atomized spray.

The locking sleeve 276 is releasably held in a locking orientation by engagement of the locking sleeve flange concave notches 298 (FIG. 19) with the housing interior tabs 314 (FIG. 20). When the user wants to operate the aerosol valve to dispense the fluent material, the user simply needs to rotate the locking sleeve 276 in either the clockwise or counter-clockwise direction to bring one of the two locking sleeve recesses 291 and 292 (FIG. 19) underneath the actuator spout 245 to establish an unlocked condition (FIGS. 22-25). FIGS. 22, 23, and 25 show the recess 291 located in alignment below the actuator spout 245. As the user starts to rotate the locking sleeve 76 from the locked position (FIGS. 18 and 21) to the unlocked position (FIGS. 22 and 23), the user will note an initial tactile sensation of resistence as the user applies sufficient force to disengage the locking sleeve notches 298 (FIG. 19) from the housing tabs 314 (FIG. 19). When the locking sleeve 276 has been rotated 90 degrees to bring the locking sleeve notches 298 into engagement again with the housing tabs 314, the user will sense a decrease in resistance as the notches 298 receive the tabs 114.

In a preferred embodiment of the aerosol dispensing valve assembly, the user will hear an audible snapping or clicking sound as an indication that the unlocked (or locked) position has been reached. The tactile sensations of increased or decreased resistance, and the audible click or snap, can be achieved by manufacturing the aerosol dispensing valve assembly components (or at least one or both of the locking sleeve 276 and housing 300) from suitable materials that provide the necessary local, temporary, elastic deformation. Such materials are preferably those in the olefin family (e.g., polypropylene, polyethylene, etc.) or in the engineering grade plastics family (i.e., nylon, acetyl, etc.).

The preferred embodiment of the locking sleeve 276 preferably includes indicia that is located below each upper abutment edge 281 and 282, such as the word "LOCK" over a double headed arrow, to indicate to the user that the user can subsequently place the assembly into a locking, non-actuatable condition by rotating the locking sleeve 276 either clockwise or counter-clockwise.

In the illustrated preferred embodiment of the aerosol dispensing valve assembly of the present invention, the locking sleeve 276 has four rotational positions—a first rotated position for locking the valve assembly, a second rotated position (90 degrees in a selected direction of rotation beyond the first rotated position) for unlocking the valve assembly, a third rotated position (90 degrees beyond the second rotated position in the selected direction of rotation) for again locking the valve assembly, and a fourth rotated position (90 degrees beyond the third rotated position in the selected direction of rotation) for again unlocking the valve assembly.

In an alternate embodiment (not illustrated), the locking sleeve could be provided with only two rotated positions—a first rotated position for locking the valve assembly, and a second rotated position for unlocking the valve assembly. In such an alternate embodiment, the locking sleeve need be provided with only one upper abutment edge for engaging the underside of the spout 245 to prevent downward movement of the actuator 242, and need be provided with only one recess for accommodating downward movement of the actuator spout 245.

In yet another alternative embodiment (not illustrated), the locking sleeve 276 could be provided with more than four rotated positions if the locking sleeve 276 is modified to provide additional recesses and upper abutment edges.

In the preferred embodiment illustrated, the locking sleeve 276 provides the recesses (recesses 291 and 292) and the upper abutment edges (edges 281 and 282) in the upper periphery of the locking sleeve at equal, a 90 degree increments. However, In an alternate embodiment (not illustrated), the incremental spacing of the upper abutment edges 281 and 282 and of the recesses 291 and 292 need not be equal—although an unequal spacings and unequal rotational increments might be less "user friendly" if the package does not include clear markings or indicia identifying the various positions that could be selected.

Figure 26:
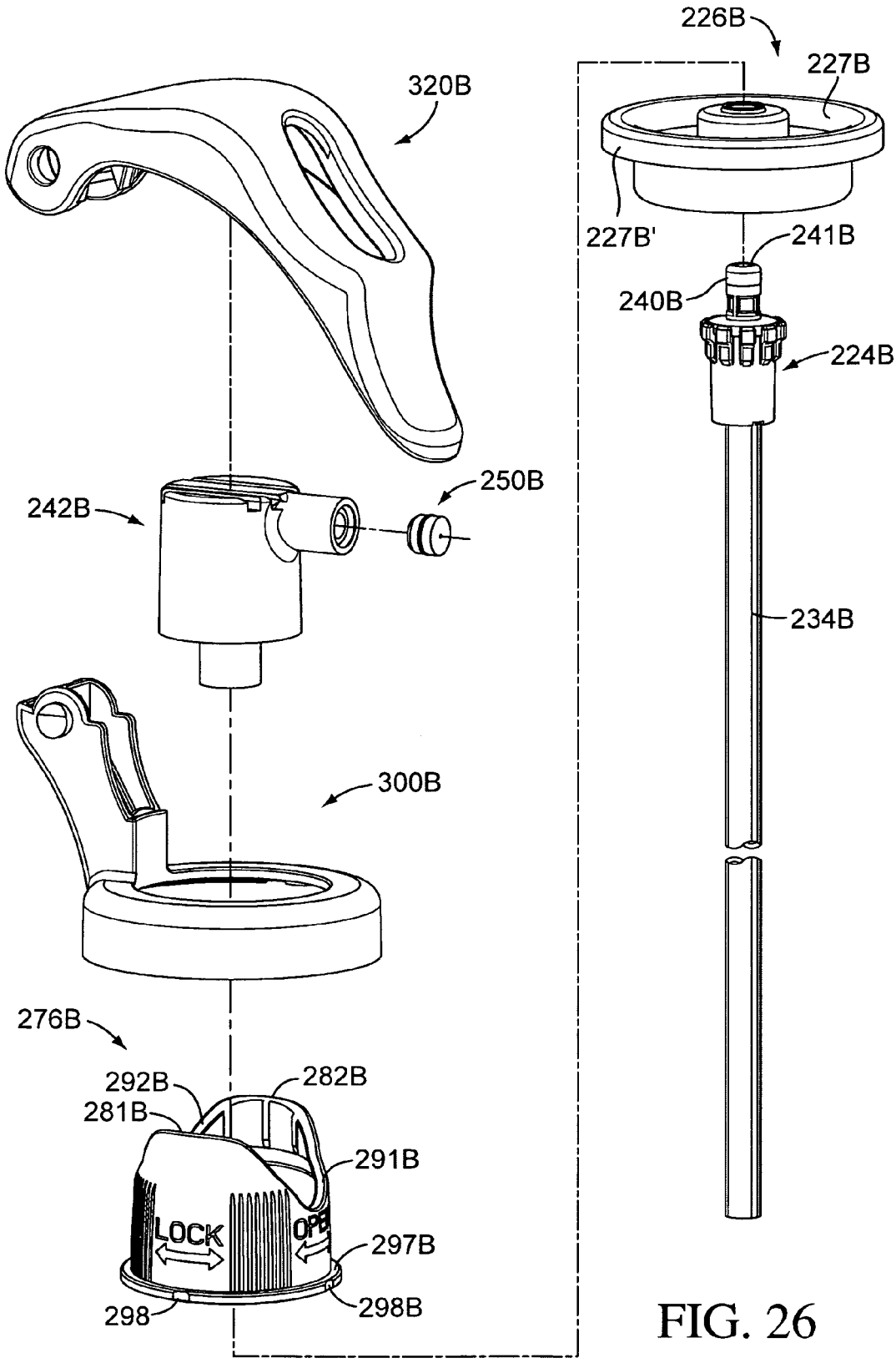
FIG. 26 is a view similar to FIG. 19, but FIG. 26 illustrates the components for a modified form of the aerosol dispensing assembly (i.e., a fourth embodiment of the dispensing assembly)
Figure 27:
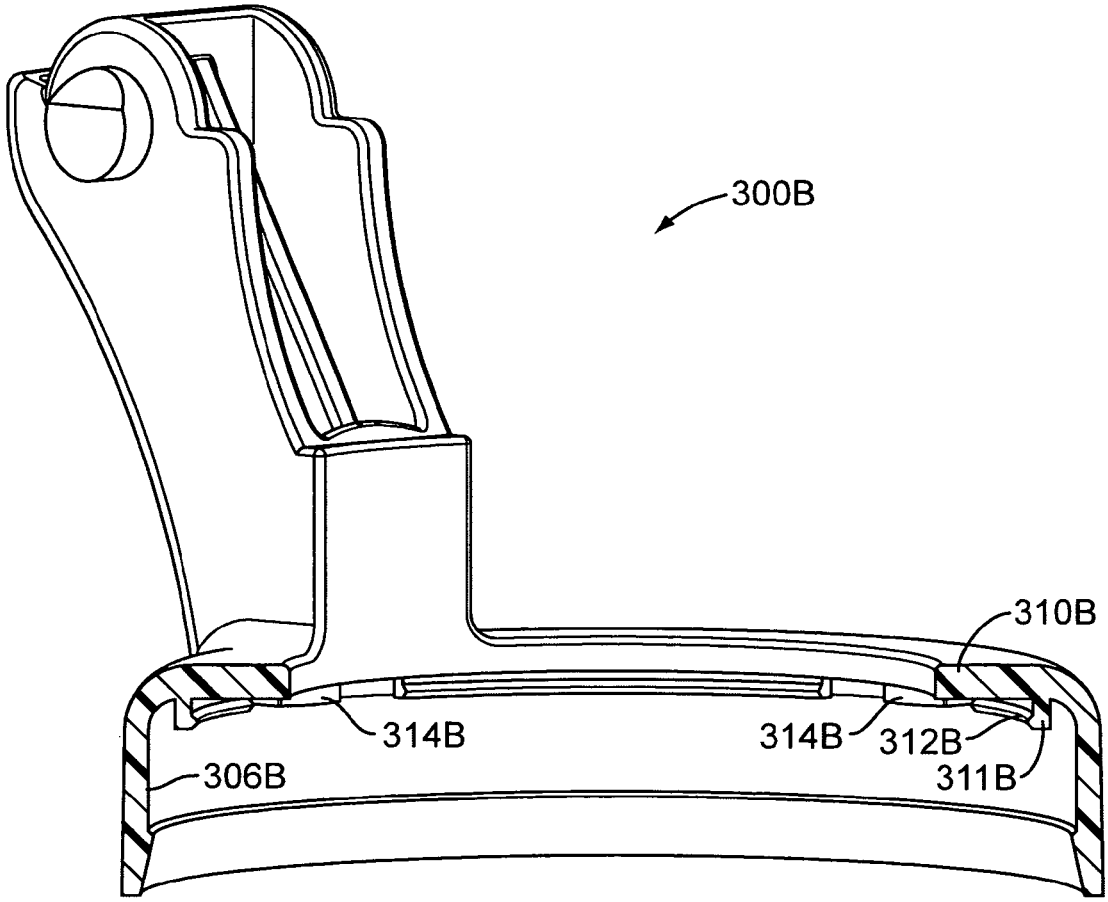
FIG. 27 is a view similar to FIG. 20, but FIG. 27 shows the modified form of the exterior fixed sleeve (i.e., housing) of the aerosol dispensing assembly.
Figure 28:
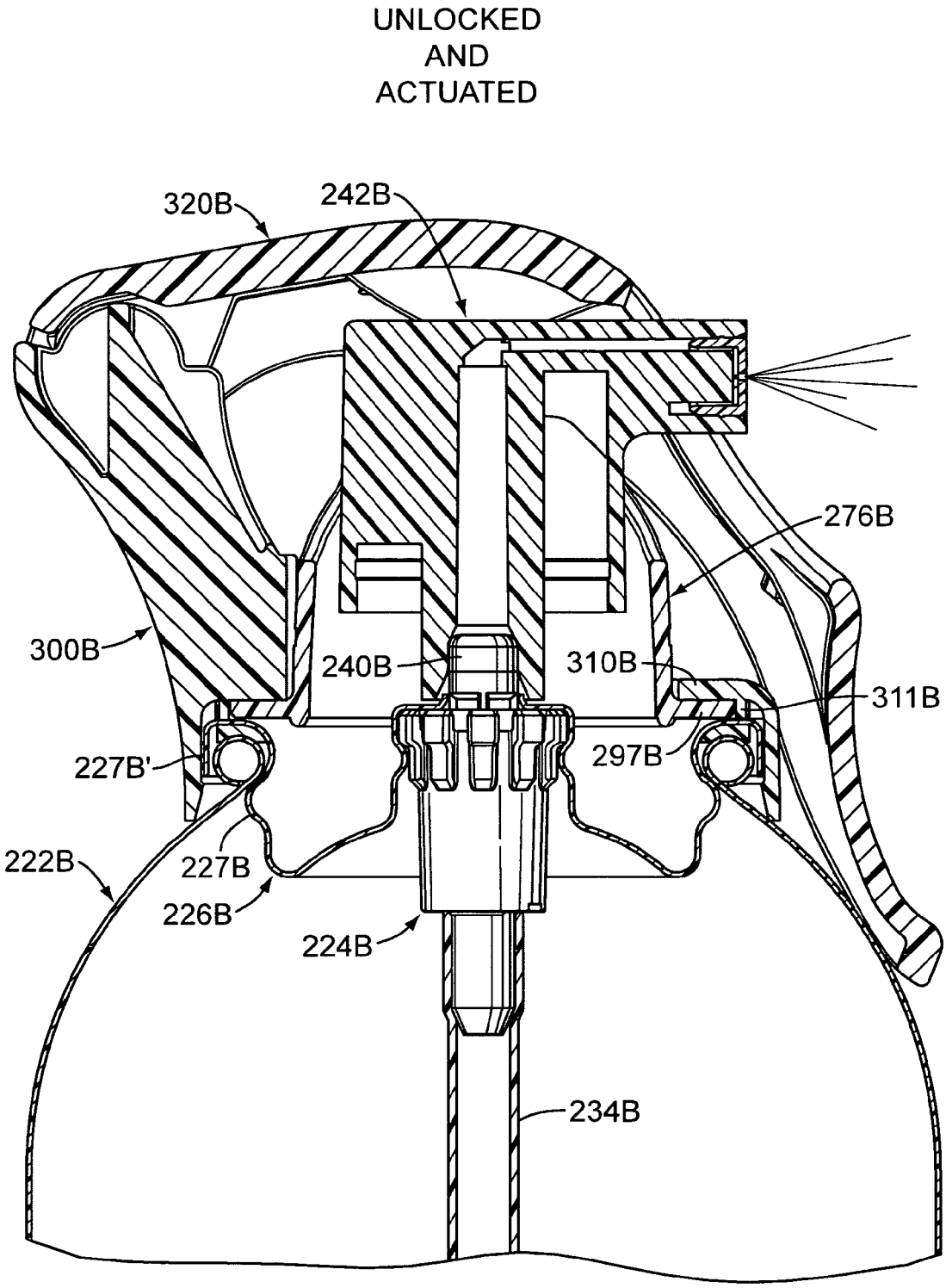
FIG. 28 is a view similar to FIG. 25, but FIG. 28 shows the assembly of the modified components illustrated in FIGS. 26 and 27 wherein such components are arranged in an unlocked condition and wherein the trigger is depressed to actuate the assembly to dispense fluent material in an atomized spray.

FIGS. 26-28 illustrate a modification of the aerosol dispensing package. In this modification, the assembly includes a modified locking sleeve 276B (FIG. 26) and a modified housing 300B (FIG. 26). The other components are unchanged and include the actuator 242B (with the mechanical breakup unit 250B), the trigger 320B, the aerosol valve 224B (with the upwardly projecting stem 240B having a discharge hole 241B), the dip tube 234B, and the valve mounting cup 226B which are identical to the previously described embodiment actuator 242 (with mechanical breakup unit 250), trigger 320, aerosol dispensing valve 224 (with the stem 240 having a discharge hole 241), dip tube 234, and valve mounting cup 226, respectively, as illustrated in FIGS. 18-25. The components illustrated in FIG. 26 are adapted to be mounted to a container 222B which is identical with the container 222 described above with respect to the previous embodiment illustrated in FIGS. 18-25.

As can be seen in FIG. 26, the modified locking sleeve 276B has an open bottom end and a flange 297B which extends radially outwardly adjacent the bottom end as shown in FIG. 26. The flange 297B supports the locking sleeve 276B on the top of the crimped mounting flange 227B of the valve mounting cup 226B (FIG. 28). This supports the locking sleeve 276B for rotation around the aerosol dispensing valve stem 240B and actuator 242B.

The locking sleeve 276B defines a first upper engaging edge 281B and a second upper engaging edge 282B. The locking sleeve 276B also defines a first recess 291B and a second recess 292B (FIG. 19). In the preferred embodiment illustrated, the upper abutment edges 281B and 282B are 180 degrees apart, and the two recesses 291B and 292B are 180 degrees apart. In an alternate embodiment (not illustrated), the locking sleeve 276B may only have one upper abutment and only one recess. In still another alternate embodiment (not illustrated), the locking sleeve 276B may have three or more upper abutment edges and three or more recesses.

The outer, cylindrical face of the locking sleeve flange 297B defines four arcuate notches 298B which are spaced circumferentially at 90 degree increments (FIG. 26).

The housing 300B has an open bottom end as illustrated in FIG. 27. The housing 300B defines an annular groove 306B (FIG. 27) that is adjacent the housing bottom end and that faces radially inwardly for receiving an outer peripheral portion 227B' of the valve mounting cup flange 227B in a snap-fit engagement to retain the housing 300B on the cup 226B as shown in FIG. 28.

As can be seen in FIG. 28, the housing 300B has an open, upper end that receives the bottom end of the locking sleeve 276B and locking sleeve peripheral flange 297B. As can be seen in FIGS. 27 and 28, the upper end of the housing 300B has a radially inwardly projecting upper retention flange or lip 310B for overlying the locking sleeve flange 297B as shown in FIG. 28. The housing 300B also includes a downwardly extending, segmented flange 311B (FIGS. 27 and 28), and the bottom end of each segment of the flange 311B has a small, radially inwardly projecting lip 312B (FIG. 27). The flange 311B and the lip 310B function to contain the locking sleeve flange 297B and accommodate rotation of the locking sleeve 276B.

As can be seen in FIG. 27, the housing 300B also includes four, uniformly spaced-apart arcuate tabs 314B (only two of which tabs 314B are visible in FIG. 27). Each tab 314B is convex and projects radially inwardly. Each tab 314B is adapted to be received in a notch 298B in the flange 297B of the locking sleeve 276B when the locking sleeve 276B is rotated to any of four possible alignment positions relative to the housing 300B. The housing arcuate to tabs 314B and the locking sleeve flange arcuate notches 298B function together to provide interengageable features that define selected positions of relative rotational alignment between the locking sleeve 276B and the housing 300B. The tabs 314B and notches 298B also permit or accommodate rotation of the locking sleeve 276B (relative to the housing 300B) between (1) at least one unlocked actuatable position corresponding to a rotated position of the sleeve 276B, and (2) at least one releasably locked position corresponding to another rotated position of the sleeve 276B in the same manner as described above with respect to the previous embodiment of the aerosol valve assembly illustrated in FIGS. 18-25.

It will be appreciated that in the two aerosol valve assembly embodiments described above (the embodiment illustrated in FIGS. 18-25 and the modified embodiment illustrated in FIGS. 26-28), the locking sleeve (either sleeve 276 or 276B) may be further modified to replace the arcuate notches (either notches 298 or 298B) with the structure of the ramps 181A and 182A described above with reference to the embodiment of the pump assembly locking sleeve 76A illustrated in FIGS. 15-17.

Figure 29:
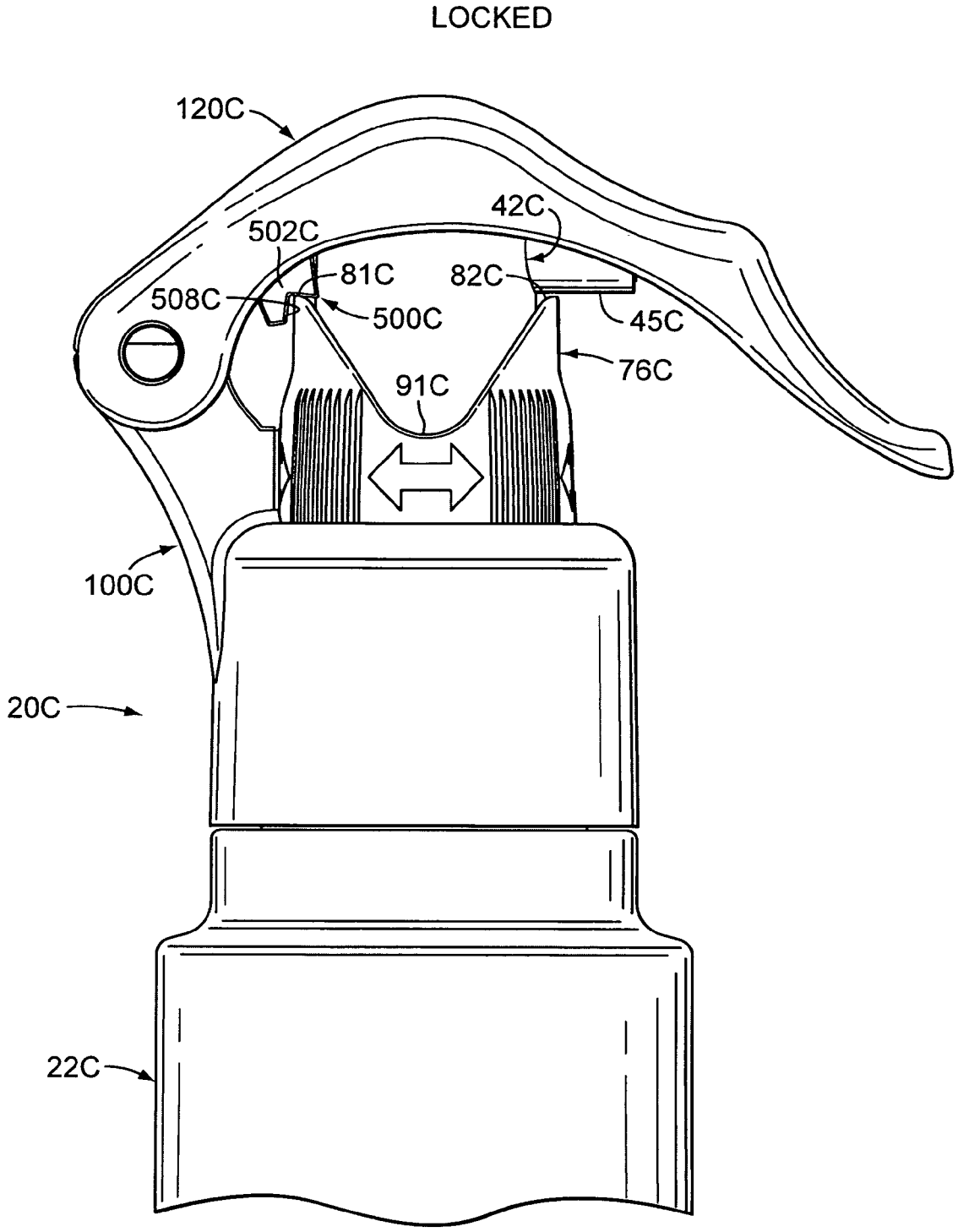
FIG. 29 is a view similar to FIG. 5, but FIG. 29 shows a fifth embodiment of the dispensing assembly.
Figure 30:
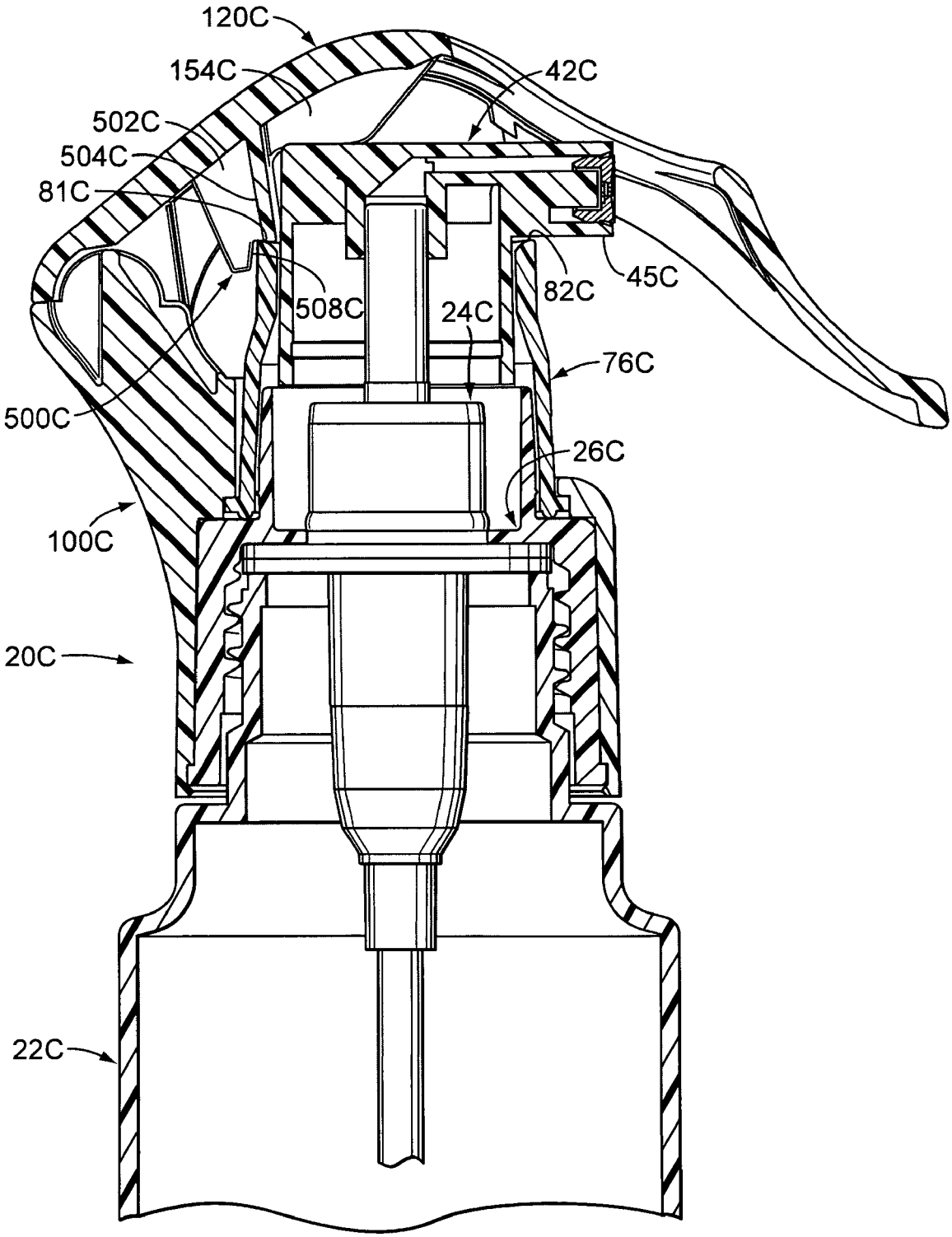
FIG. 30 is a cross-sectional view similar to FIG. 8, but FIG. 30 shows the fifth embodiment of the dispensing assembly in a locked condition prior to use.
Figure 31:
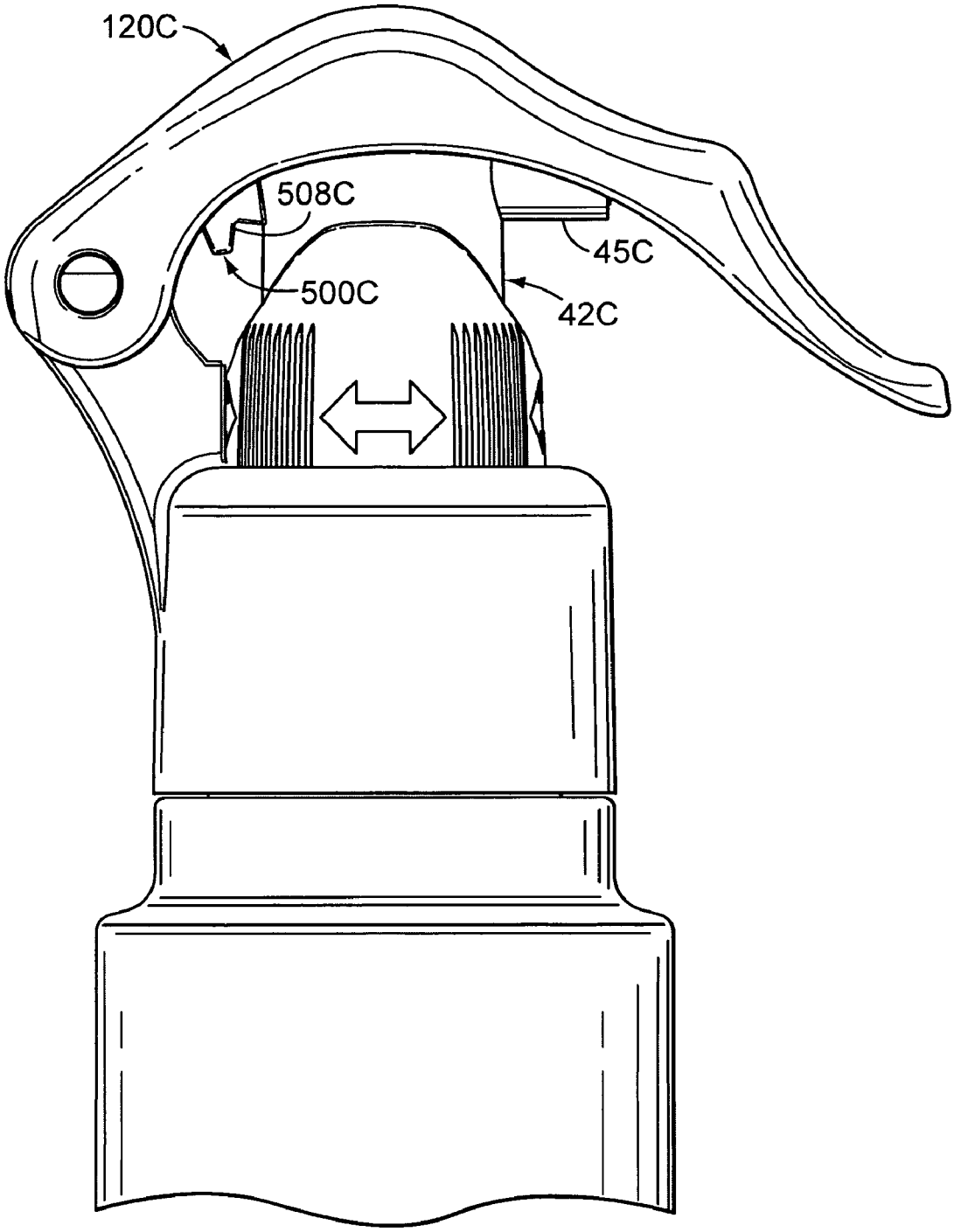
FIG. 31 is a view similar to FIG. 10, but FIG. 31 shows the fifth embodiment of the dispensing assembly in the unlocked condition.

A presently most preferred embodiment of a locking system is illustrated in FIGS. 29-37, and it may be adapted for use with a package that has an aerosol dispenser cartridge (i.e., an aerosol dispensing valve such as described above with reference to FIGS. 18-28) or a pump dispenser cartridge (e.g., the pump dispenser 24 described above with respect to FIGS. 1-17). FIGS. 29-37 illustrate a package 20C employing an embodiment of the hand-operable dispensing assembly of the present invention in which the assembly is in the form of a pump dispenser 24C installed on a container 22C (FIGS. 29 and 30).

The components of the package 22C include, in addition to the container 22C, a pump cartridge 24C, a closure 26C, an actuator or button 42C, a locking sleeve 76C, a housing 100C, and a trigger 120C. The container 22C, pump cartridge 24C, closure 26C, actuator 42C, locking sleeve 76C, and housing 100C are identical with the first embodiment container 22, pump cartridge 24, closure 26, actuator 42, locking sleeve 76, and housing 100, respectively, illustrated in FIGS. 1-14. The locking sleeve 76C may be identical to either the embodiment 76 shown in FIGS. 1-14 or the alternate embodiment 76A shown in FIGS. 15-17. The detailed features and operation of the container 22C, pump cartridge 24C, closure 26C, actuator 42C, locking sleeve 76C, and housing 100C are the same as the features and operation, respectively, of the first embodiment container 22, pump cartridge 24, closure 26, actuator 42, locking sleeve 76 (or 76A), and housing 100, respectively, described above with reference to FIGS. 1-17.

As can be seen in FIG. 29, the locking sleeve 76C has a first upper abutment edge 81C and a second upper abutment edge 82C. A first recess 91C (FIG. 29) is located between the two abutment edges 81C and 82C. A second recess 92C (FIG. 32) is located 180° from the first recess 91C and is also located between the two abutment edges 81C and 82C. The actuator 42C has a spout or nozzle 45C.

In the fifth embodiment illustrated in FIGS. 29-37, the trigger 120C is similar, but not identical, to the trigger 120 shown in FIG. 2 and described above with reference to the embodiment illustrated in FIGS. 1-14.

Figure 32:
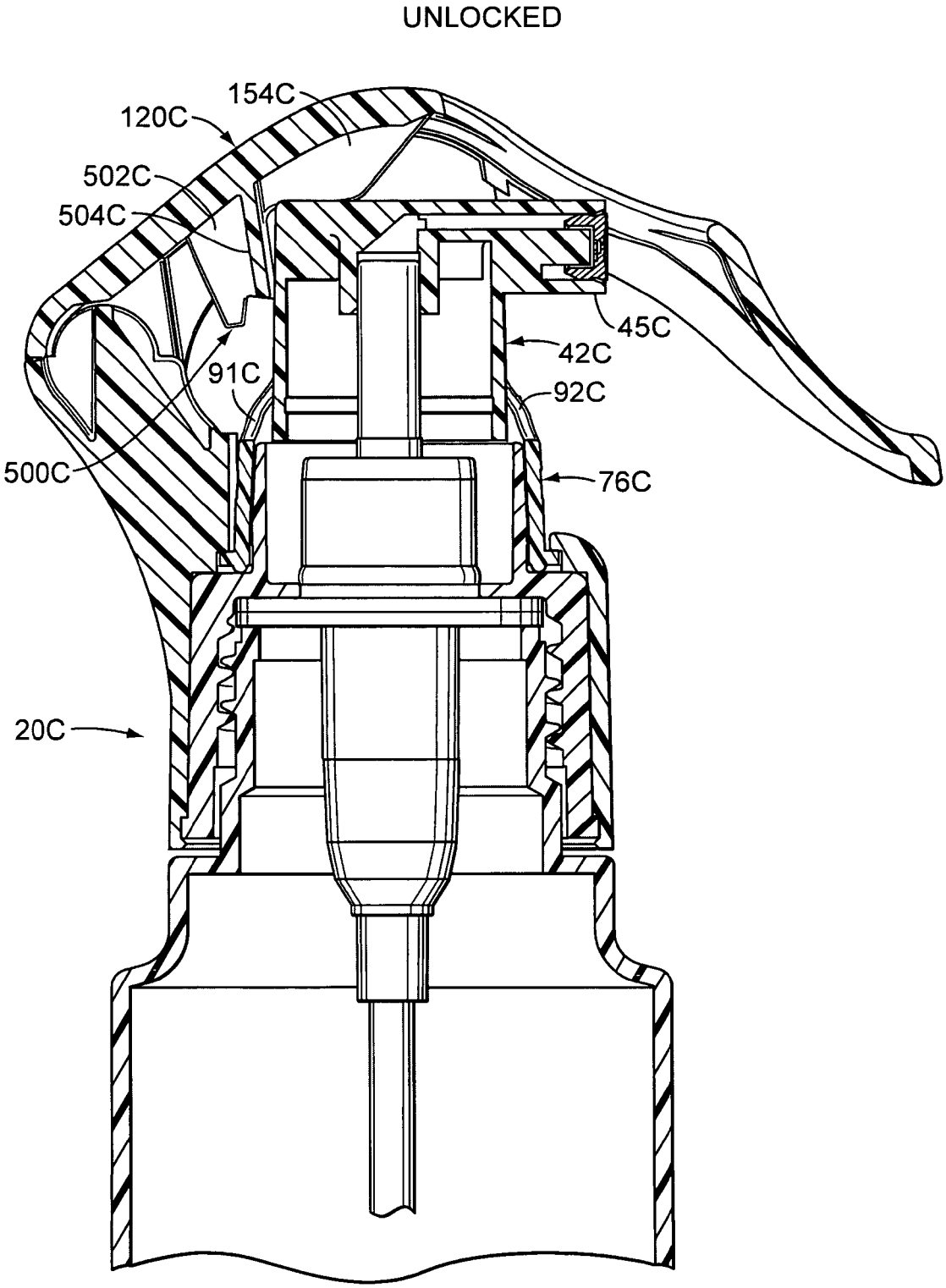
FIG. 32 is a cross-sectional view similar to FIG. 12, but FIG. 32 shows the fifth embodiment of the dispensing assembly in the unlocked condition.
Figure 36:
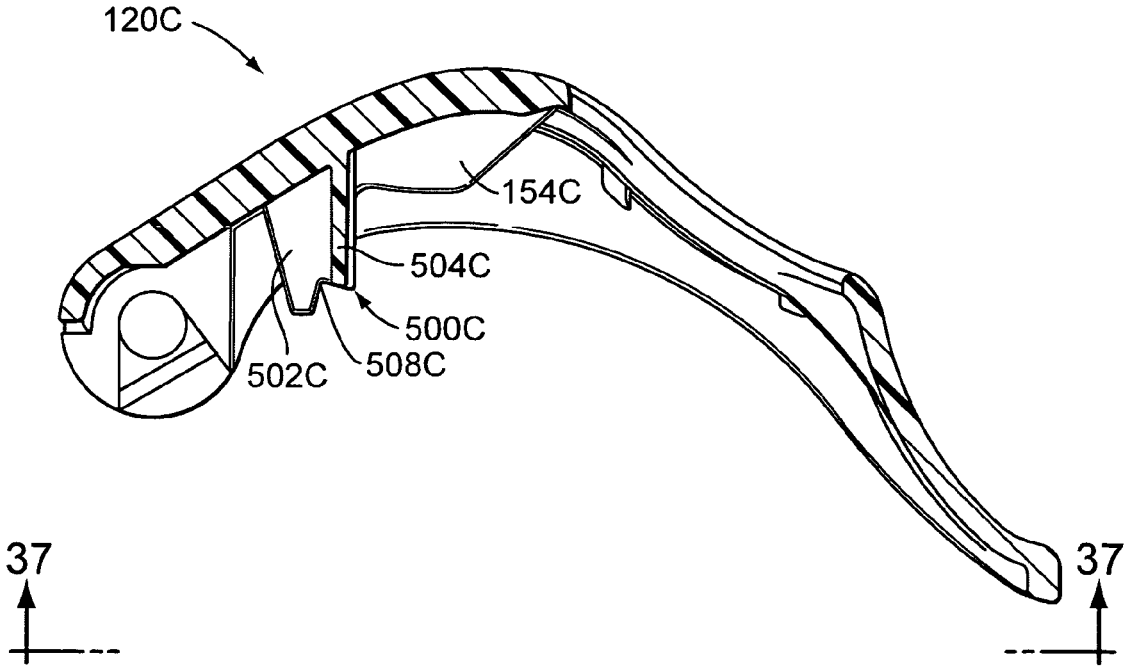
FIG. 36 is a longitudinal cross-sectional view taken through the middle of the trigger shown in FIG. 35.
Figure 37:
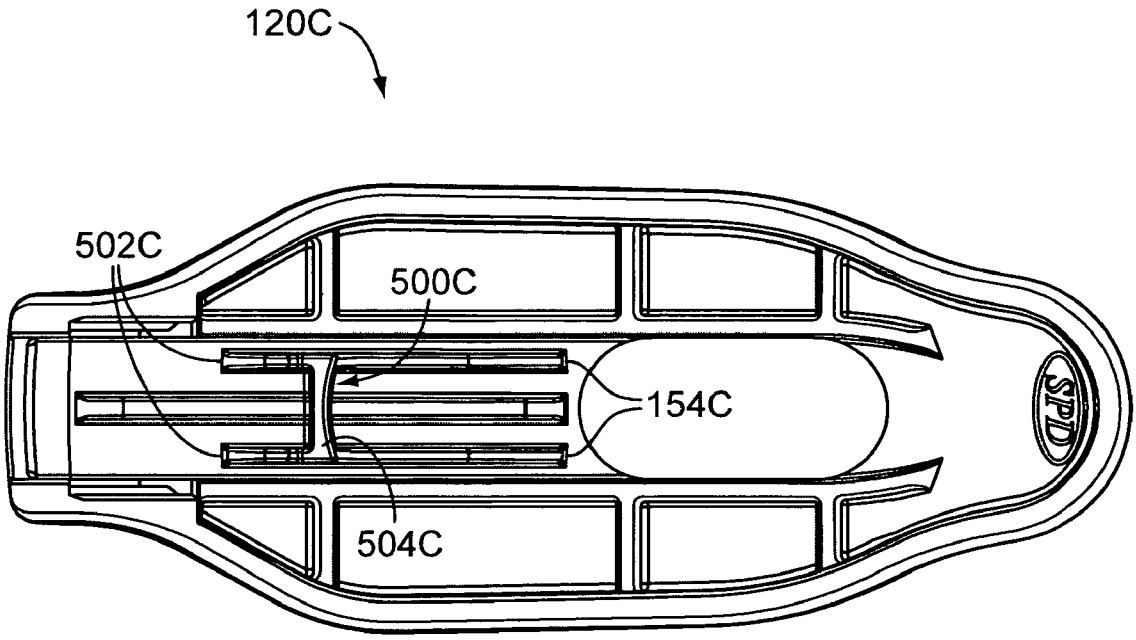
FIG. 37 is a bottom plan view of the trigger taken along the plane 37-37 in FIG. 35.

The fifth embodiment trigger 120C differs from the first embodiment trigger 120 in that the trigger 120C includes a trigger lock stop in the form of a downwardly extending arm 500C (FIG. 36). The arm 500C of the trigger 120C includes two spaced-apart sidewalls 502C joined by a cross wall 504C (FIGS. 32 and 37). As can be seen in FIG. 36, the arm 500C defines a generally right-angle notch 508C. As can be seen in FIG. 30, the notch 508C is adapted to receive either of the upper abutment edges of the locking sleeve 76C when the locking sleeve 76C is shown in a locking orientation (FIGS. 29 and 30). In FIG. 29, the locking sleeve 76C is in a first rotated position which defines a first locking orientation wherein the first abutment edge 81C is directly below, and engageable with, the trigger lock stop or engaging arm 500C. If the locking sleeve 76C is rotated 180 degrees (to a second locking orientation), then the locking sleeve 76C second upper abutment edge 82C engages the trigger arm 500C to prevent downward movement of the trigger 120C.

In the first locking orientation of the locking sleeve 76C as illustrated in FIG. 29, the second upper abutment edge 82C is spaced slightly below the actuator spout or nozzle 45C so that no force is applied to the nozzle 45C by the edge 82C—even if an attempt is made to depress the trigger 120C (because the engagement of the trigger arm 500C with the locking sleeve first upper abutment edge 81C prevents downward movement of the trigger 120C so that the actuator 42C cannot be depressed). In the second locking orientation where the first upper abutment edge 81C is located under the nozzle 45C, there likewise can be no force applied to the nozzle 45C because the abutment edge 81C also is spaced below the nozzle 45C, and the nozzle 45C cannot be lowered because the trigger arm 500C engages the second upper abutment edge 82C.

Figure 33:
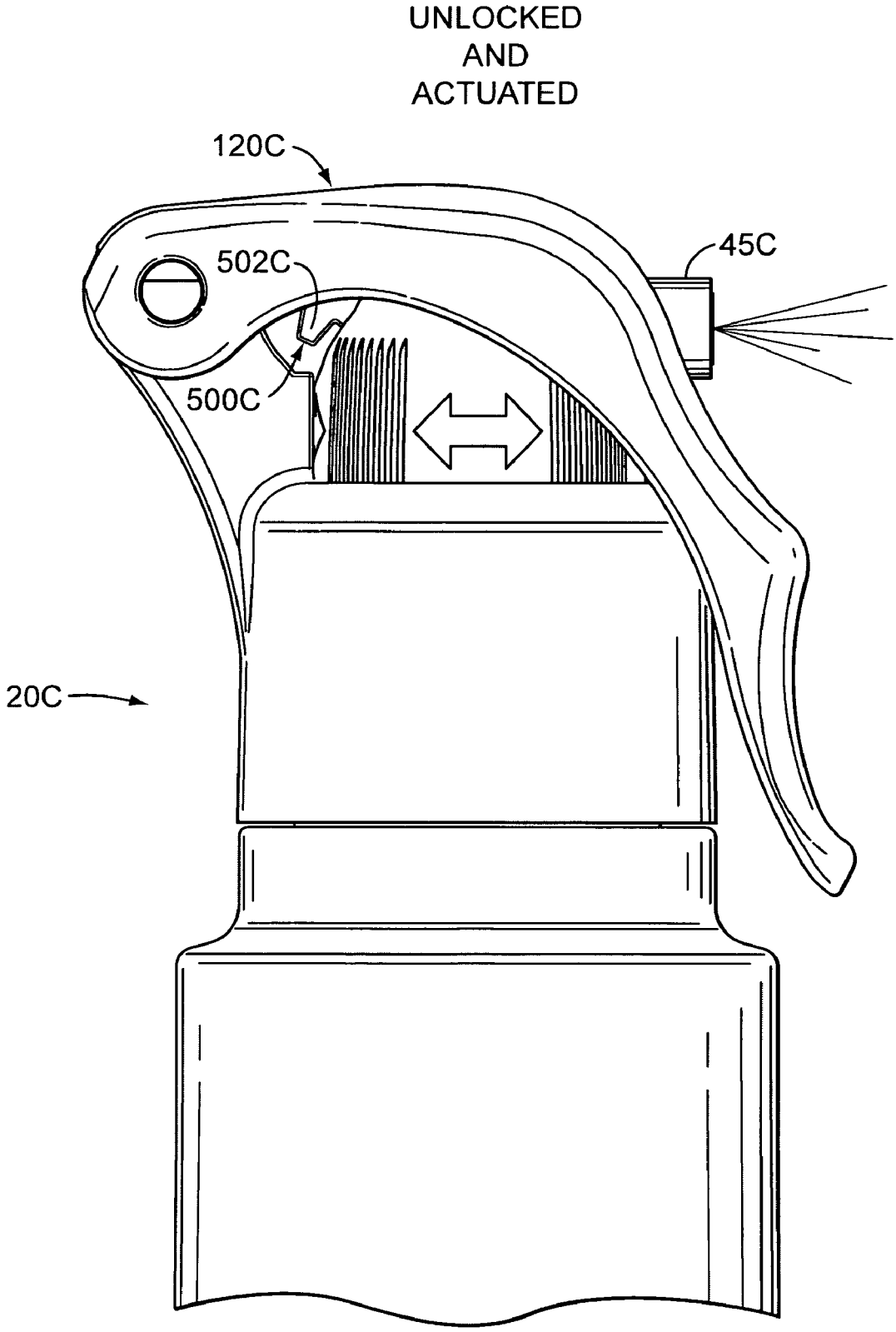
FIG. 33 is a view similar to FIG. 13, but FIG. 33 shows the fifth embodiment of the dispensing assembly with the trigger in a depressed position on the unlocked package to effect actuation of the dispensing assembly with consequent discharge of a spray of fluent material.
Figure 34:
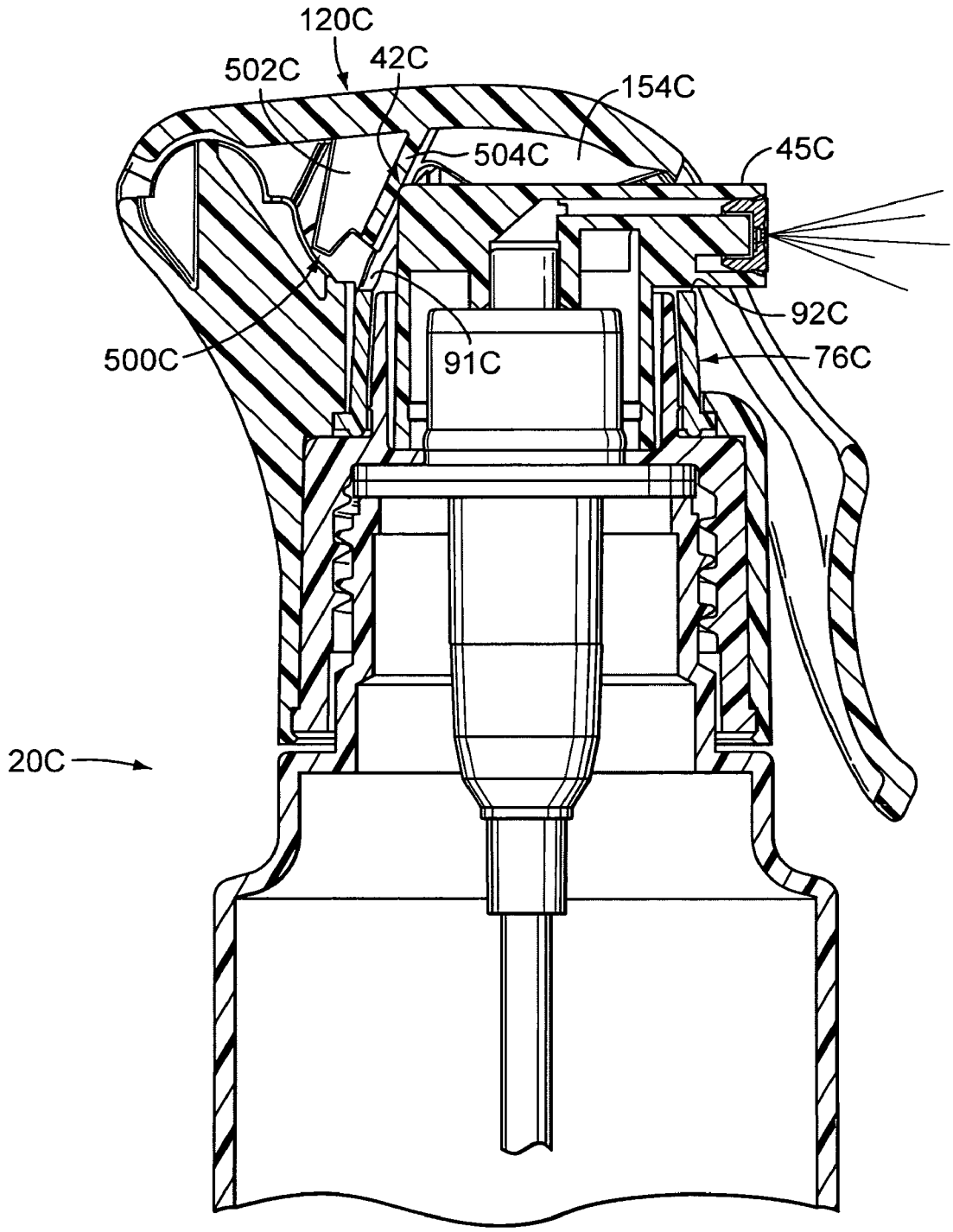
FIG. 34 is a cross-sectional view similar to FIG. 14, but FIG. 34 shows the fifth embodiment of the dispensing assembly with the trigger depressed as in FIG. 33 on the unlocked package to actuate the dispensing assembly to dispense the fluent material in an atomized spray.
Figure 35:
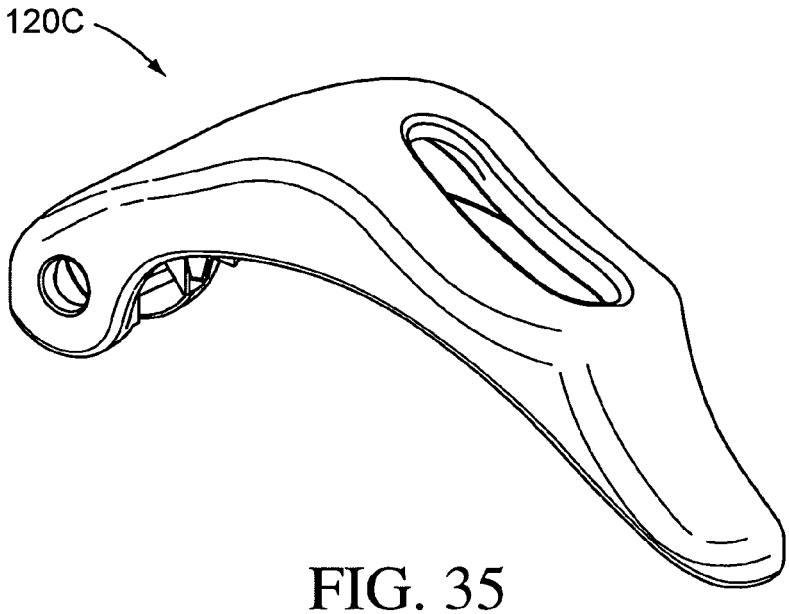
FIG. 35 is an isometric view of the trigger for the fifth embodiment of the present invention.

If the locking sleeve 76C is rotated only 90 degrees (either clockwise or counterclockwise), then the locking sleeve first or second recess 91C or 92C, respectively, is positioned below the trigger arm 500C. FIG. 32 shows the locking sleeve 76C rotated so as to position the first recess 91C below the trigger arm 500C. The trigger 120C can then be depressed, as shown in FIGS. 33 and 34, to force the actuator 42C downwardly to actuate the dispensing assembly. As shown in FIG. 34, the recesses 91C and 92C of the locking sleeve 76C are sufficiently deep so that the actuator nozzle 45C does not hit the edge of the locking sleeve at the bottom of either recess.

Owing to the unique design of the trigger 120C in the fifth embodiment of the dispensing assembly, the likelihood of the actuator 42C and its nozzle 45C being damaged if the package 20C is accidentally dropped is substantially minimized. This is because the actuator nozzle 45C does not engage the edge of the locking sleeve 76C when the locking sleeve 76C is in the locked orientation (FIGS. 29 and 30), or in the unlocked, but unactuated orientation (FIGS. 31 and 32), or in the unlocked and actuated orientation (FIGS. 34 and 33). Thus, if the package 20C is inadvertently dropped upside down and lands on the trigger 120C, the trigger 120C cannot cause the actuator to move the nozzle 45C against the locking sleeve 76C. In either the locked condition or unlocked condition, such an inadvertent dropping of the package 20C upside down on the trigger 120C cannot result in an impact load being applied to the nozzle 45C by the locking sleeve 76C or by the trigger 120C. This minimizes the likelihood that the nozzle 45C could be inadvertently sheered off during such an impact.

The fifth embodiment illustrated in FIGS. 29-37 offers a further advantage over the first embodiment design illustrated in FIGS. 1-14, or the alternate form illustrated in FIGS. 15-17. In particular, in the embodiments illustrated in FIGS. 1-17, the trigger cam ribs 154 have the potential to cause the actuator 42 to become cocked or toggled at an angle if an attempt is made to depress the trigger 120 very forcefully when the locking sleeve 76 is in the locked orientation (FIG. 8). In particular, as can be seen in FIG. 8, if a force is applied to the trigger 120, the cam ribs 154 will initially tend to push down on the rear portion of the actuator 42. The actuator 42 is forced downwardly until the underside of the nozzle 45 engages the upper abutment edge of the locking sleeve 76. However, if the user continues to apply a large force to the trigger 120, then the force exerted on the top rear portion of the actuator 42 by the cam ribs 154 might cause the actuator 42 to twist or angle somewhat downwardly on the stem 40 as the actuator 42 pivots slightly about the point of engagement between the underside of the actuator nozzle 45 and the engaging upper abutment edge of the locking sleeve 76.

In contrast, with the design employed in the fifth embodiment illustrated in FIGS. 29-37, depression of the trigger 120C, while the locking sleeve is in the locking condition, does not apply a downward force to the actuator 42C that would cause the actuator 42C to become angled or pivoted about the locking sleeve 76C because the trigger arm 500C engages the adjacent upper abutment edge of the locking sleeve 76C to prevent further movement of the trigger 120C and prevent the actuator nozzle 45C from engaging the locking sleeve 76C.

The trigger 120C, as employed in the fifth embodiment described above with reference to FIGS. 29-37, can also be employed with an aerosol dispenser cartridge, such as the aerosol dispensing valve 224 and actuator 242 which is illustrated in FIGS. 18-25 (or in the alternate embodiment thereof illustrated in FIGS. 26-28). The trigger 320 in the aerosol embodiment illustrated in FIGS. 18-25 and the trigger illustrated in the aerosol embodiment illustrated in FIGS. 26-28 could each be replaced by a new trigger similar to the trigger 120C described above with reference to FIGS. 29-37, but with an adjustment to the angle of the orientation of the trigger stop lock arm 500C so that the arm will properly engage the upper edge of the aerosol dispenser locking sleeve in the locked condition. The use of such a trigger in an aerosol dispenser would provide the same types of advantages as described above for the pump dispenser cartridge dispensing assembly illustrated in FIGS. 29-37.

Although some desirable features of the present invention have been illustrated and described with respect to presently preferred embodiments used with a trigger-actuated pump dispenser cartridge or a trigger-actuated aerosol dispenser cartridge (i.e., an aerosol dispensing valve), it will be appreciated that some features of some aspects or embodiments of the invention can be employed in other types of dispensing assemblies, including those without a trigger.

Further, in the preferred forms of the dispensing assembly of the present invention, the various components of the assembly may be conveniently made entirely, or at least in part, from thermoplastic materials that are injection molded.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing assembly in the form of a dispensing pump assembly for a container of fluent material, said assembly comprising:

(A) a pump cartridge that (1) has an outwardly projecting, reciprocatable, product-dispensing stem biased to an elevated rest position, and (2) is adapted to be installed in a mouth of a container that has a connection feature adjacent the mouth;

(B) a closure for mounting on said container at said mouth and having (1) a connection feature for mating with said container connection feature to connect said closure to said container, (2) a retention feature for engaging a portion of said pump cartridge to retain said pump cartridge on said container, and (3) an opening into which said pump cartridge projects, (4) an annular shoulder, and (5) an annular shroud that extends (a) upwardly from the inner periphery of said annular shoulder, and (b) laterally around a portion of said pump cartridge;

(C) an actuator mounted on said stem and that has (1) a laterally projecting spout defining a dispensing passage for establishing fluid communication between said stem and the exterior of said actuator, and (2) a top end defining a force-bearing actuation region for being subjected to an actuation force to depress said actuator to urge said stem further into said pump cartridge to actuate said pump assembly;

(D) a non-removable locking sleeve rotatably mounted on said closure around both said stem and actuator, said locking sleeve defining at least a first upper abutment edge for engaging an underside of said spout to prevent downward movement of said actuator when said locking sleeve is in a first rotated position to lock said pump assembly from being actuated, said locking sleeve defining at least a first recess for accommodating downward movement of said actuator spout when said locking sleeve is in a second rotated position while said actuator is depressed to actuate said pump assembly, said locking sleeve being disposed around said closure annular shroud, said locking sleeve having a bottom end supporting said locking sleeve on said closure annular shoulder for rotation about said closure annular shroud, said locking sleeve including a radially outwardly extending peripheral flange adjacent said locking sleeve bottom end;

(E) an exterior housing that is mounted around at least a portion of said closure and fixed thereto, said housing having an open upper end receiving said locking sleeve bottom end and said locking sleeve peripheral flange, said housing having a radially inwardly projecting retention lip at said open upper end of said housing for overlying and engaging said locking sleeve outwardly extending peripheral flange so as to retain said locking sleeve around said housing shroud and to maintain said locking sleeve bottom end on said housing annular shoulder to accommodate rotation of said locking sleeve around said closure shroud;

(F) a trigger support extending from said housing rearwardly of said spout; and (G) a trigger that (1) is pivotally mounted to said trigger support, (2) extends over a portion of said actuator, (3) defines an aperture located at least partly around said spout to accommodate dispensing of fluent material from said spout through said aperture;

(4) engages said actuator top end, and (5) has a finger-grippable lever portion extending from said aperture generally downwardly.

2. The dispensing pump assembly in accordance with claim 1 in which said closure has a plurality of radially outwardly extending, circumferentially spaced vertical ribs below said housing annular shoulder; and said housing has at least one radially inwardly projecting internal vertical rib adapted to be received between two of said closure ribs to prevent relative rotation between said housing and said closure.

3. The dispensing pump assembly in accordance with claim 1 in which said closure has an open bottom end defining said closure opening into which said pump cartridge can project;

said closure has an annular retention bead projecting radially outwardly adjacent said closure bottom end;

said exterior housing has a bottom end; and said exterior housing has an annular groove that is adjacent said housing bottom end and that faces radially inwardly for receiving said closure retention bead in a snap-fit engagement to retain said housing on said closure.

4. The dispensing pump assembly in accordance with claim 1 in which said locking sleeve and said housing have interengageable features accommodating rotation of said locking sleeve relative to said closure between (1) at least one unlocked actuatable position corresponding to said second rotated position permitting reciprocation of said actuator, and (2) at least one releasably locked position corresponding to said first rotated position preventing reciprocation of said actuator.

5. The dispensing pump assembly in accordance with claim 4 in which said interengageable features include at least one arcuate tab that is on said housing and that projects radially inwardly; and at least two arcuate notches that are circumferentially spaced apart on said locking sleeve and that each opens radially outwardly for releasably receiving said housing tab in a releasable detent engagement to releasably hold said locking sleeve selectively in one of said first rotated position and said second rotated position.

6. The dispensing pump assembly in accordance with claim 4 in which said interengageable features include at least one tab that is on said housing and that projects radially inwardly; and at least one pair of spaced-apart ramps on said locking sleeve, each said ramp having a tapered long surface and an angled shorter retention wall generally facing the angled shorter retention wall of the other ramp to define a radially outward opening for releasably receiving said housing tab in a releasable detent engagement between said retention walls to releasably hold said locking sleeve selectively in one of said first rotated position and said second rotated position.

7. The dispensing pump assembly in accordance with claim 1 adapted to be installed in a mouth of a container having an external male thread around said mouth, and in which said closure has an internal female thread for mating with said container external male thread.

8. The dispensing pump assembly in accordance with claim 1 in which said assembly is adapted for use with a container having an upwardly facing, annular rim around said container mouth;

said pump cartridge includes a peripheral flange extending radially outwardly; and said closure has a radially inwardly projecting flange to define said retention feature on said closure wherein said radially inwardly projecting flange is adapted to overlie said pump cartridge flange and to clamp said pump cartridge flange against said container rim.

9. The dispensing pump assembly in accordance with claim 1 in which said locking sleeve has a third rotated position and fourth rotated position;

said locking sleeve defines a second upper abutment edge for engaging the underside of said actuator spout to prevent downward movement of said actuator when said locking sleeve is in said third rotated position; and said locking sleeve defines a second recess for accommodating downward movement of said actuator spout when said locking sleeve is in said fourth rotated position while said actuator is depressed.

10. The dispensing pump in accordance with claim 1 in which said actuator top end defines spaced-apart, linear, parallel grooves aligned generally parallel; and said trigger defines two spaced-apart, linear cam ribs aligned generally parallel to said actuator grooves for each being received in one of said grooves.

11. A dispensing assembly for a container of fluent material, said assembly comprising:

(A) a dispenser cartridge that (1) has an upwardly projecting, reciprocatable, product-dispensing stem biased to an elevated rest position, and (2) is adapted to be installed in a mouth of a container;

(B) an actuator that (1) is mounted on said stem for establishing fluid communication between said stem and the exterior of said actuator for dispensing said fluent material, (2) has a force-bearing actuation region for being subjected to an actuation force to depress said actuator to urge said stem further into said dispenser cartridge to actuate said dispensing assembly, and (3) has a lateral projection; and (C) a locking sleeve rotatably mounted around both said stem and actuator, said locking sleeve having a first rotated position, a second rotated position, a third rotated position, and a fourth rotated position, said locking sleeve defining a first upper abutment edge for engaging an underside of said actuator lateral projection to prevent downward movement of said actuator when said locking sleeve is in a first rotated position to lock said dispensing assembly from being actuated, said locking sleeve defining a first recess for accommodating downward movement of said actuator lateral projection when said locking sleeve is in a second rotated position while said actuator is depressed to actuate said dispensing assembly, said locking sleeve defining a second upper abutment edge for engaging the underside of said actuator lateral projection to prevent downward movement of said actuator when said locking sleeve is in said third rotated position, and said locking sleeve defining a second recess for accommodating downward movement of said actuator lateral projection when said locking sleeve is in said fourth rotated position while said actuator is depressed.

12. The dispensing assembly in accordance with claim 11 in which said actuator lateral projection is a spout having a dispensing passage that functions to define at least part of said fluid communication between said stem and the exterior of said actuator.

13. The assembly in accordance with claim 12 in which said actuator is generally cylindrical except for said laterally projecting spout; and said actuator has a generally cylindrical skirt which extends below said spout.

14. The dispensing assembly in accordance with claim 11 in which said dispensing assembly is adapted to be installed in a mouth of said container that has a connection feature adjacent the mouth; and said dispensing assembly further includes a closure for mounting on said container at said mouth and having (1) a connection feature for connecting with said container connection feature to connect said closure to said container, (2) a retention feature for engaging a portion of said dispenser cartridge to retain said dispenser cartridge on said container, and (3) an opening into which said dispenser cartridge can project.

15. The dispensing assembly in accordance with claim 11 in which said actuator includes a top end that defines said force-bearing actuation region;

said actuator lateral projection is a spout having a dispensing passage that functions to define at least part of said fluid communication between said stem and the exterior of said actuator;

said dispensing assembly further includes (1) a trigger support defined on said housing rearwardly of said spout; and (2) a trigger that (a) is pivotally mounted to said trigger support, (b) extends over a portion of said actuator, (c) defines an aperture located at least partly around said spout to accommodate dispensing of fluent material from said spout through said aperture, (d) engages said actuator top end, and (e) has a finger-grippable lever portion extending generally downwardly from said aperture below the elevation of said spout.

16. The dispensing pump in accordance with claim 15 in which said actuator top end defines spaced-apart, linear, parallel grooves aligned generally parallel to said actuator spout; and said trigger defines two spaced-apart, linear cam ribs aligned generally parallel to said actuator spout for each being received in one of said grooves.

17. A dispensing assembly for a container of fluent material, said assembly comprising:

(A) a dispenser cartridge that (1) has an upwardly projecting, reciprocatable, product-dispensing stem biased to an elevated rest position, and (2) is adapted to be installed in a mouth of a container;

(B) an actuator that (1) is mounted on said stem for establishing fluid communication between said stem and the exterior of said actuator for dispensing said fluent material, (2) has a force-bearing actuation region that can be subjected to an actuation force to depress said actuator to urge said stem further into said dispenser cartridge to actuate said dispensing assembly, and (3) has a lateral projection; and (C) a locking sleeve rotatably mounted around both said stem and actuator, said locking sleeve defining at least a first upper abutment edge for engaging an underside of said actuator lateral projection to prevent downward movement of said actuator when said locking sleeve is in a first rotated position to lock said dispensing assembly from being actuated, said locking sleeve defining at least a first recess for accommodating downward movement of said actuator lateral projection when said locking sleeve is in a second rotated position while said actuator is depressed to actuate said dispensing assembly; and wherein said dispensing assembly is adapted to be installed in a mouth of a container that has a connection feature adjacent the mouth;

said dispensing assembly further includes a closure for mounting on said container at said mouth and having (1) a connection feature for connecting with said container connection feature to connect said closure to said container, (2) a retention feature for engaging a portion of said dispenser cartridge to retain said dispenser cartridge on said container, and (3) an opening into which said dispenser cartridge can project;

said dispenser cartridge is an aerosol dispensing valve; and said closure is a valve mounting cup having (1) a peripheral mounting flange for mounting said cup to said container; and (2) an annular inner wall that (a) defines said closure opening, and (b) engages said aerosol dispensing valve to retain said aerosol dispensing cartridge on said container.

18. A dispensing assembly for a container of fluent material, said assembly comprising:

(A) a dispenser cartridge that (1) has an upwardly projecting, reciprocatable, product-dispensing stem biased to an elevated rest position, and (2) is adapted to be installed in a mouth of a container;

(B) an actuator that (1) is mounted on said stem for establishing fluid communication between said stem and the exterior of said actuator for dispensing said fluent material, (2) has a force-bearing actuation region that can be subjected to an actuation force to depress said actuator to urge said stem further into said dispenser cartridge to actuate said dispensing assembly, and (3) has a lateral projection; and (C) a locking sleeve rotatably mounted around both said stem and actuator, said locking sleeve defining at least a first upper abutment edge for engaging an underside of said actuator lateral projection to prevent downward movement of said actuator when said locking sleeve is in a first rotated position to lock said dispensing assembly from being actuated, said locking sleeve defining at least a first recess for accommodating downward movement of said actuator lateral projection when said locking sleeve is in a second rotated position while said actuator is depressed to actuate said dispensing assembly; and wherein said dispensing assembly is adapted to be installed in a mouth of a container that has a connection feature adjacent the mouth;

said dispensing assembly further includes a closure for mounting on said container at said mouth and having (1) a connection feature for connecting with said container connection feature to connect said closure to said container;

(2) a retention feature for engaging a portion of said dispenser cartridge to retain said dispenser cartridge on said container, and (3) an opening into which said dispenser cartridge can project;

said dispenser cartridge is a dispensing pump cartridge for being disposed in a mouth of said container having an external male thread around said mouth;

said closure has an internal female thread for mating with said container external male thread;

said closure includes an annular shoulder;

said closure includes an annular shroud that extends (1) upwardly from the inner periphery of said annular shoulder, and (2) laterally around a portion of said pump cartridge; said locking sleeve is disposed exterior of, and around, said closure annular shroud; and said locking sleeve bottom end supports said locking sleeve on said closure annular shoulder for rotation about said closure annular shroud.

19. A dispensing assembly for a container of fluent material, said assembly comprising:

(A) a dispenser cartridge that (1) has an upwardly projecting, reciprocatable, product-dispensing stem biased to an elevated rest position, and (2) is adapted to be installed in a mouth of a container;

(B) an actuator that (1) is mounted on said stem for establishing fluid communication between said stem and the exterior of said actuator for dispensing said fluent material, (2) has a force-bearing actuation region that can be subjected to an actuation force to depress said actuator to urge said stem further into said dispenser cartridge to actuate said dispensing assembly, and (3) has a lateral projection; and (C) a locking sleeve rotatably mounted around both said stem and actuator, said locking sleeve defining at least a first upper abutment edge for engaging an underside of said actuator lateral projection to prevent downward movement of said actuator when said locking sleeve is in a first rotated position to lock said dispensing assembly from being actuated, said locking sleeve defining at least a first recess for accommodating downward movement of said actuator lateral projection when said locking sleeve is in a second rotated position while said actuator is depressed to actuate said dispensing assembly; and wherein said dispensing assembly is adapted to be installed in a mouth of a container that has a connection feature adjacent the mouth;

said dispensing assembly further includes a closure for mounting on said container at said mouth and having (1) a connection feature for connecting with said container connection feature to connect said closure to said container, (2) a retention feature for engaging a portion of said dispenser cartridge to retain said dispenser cartridge on said container, and (3) an opening into which said dispenser cartridge can project;

said locking sleeve has a bottom end on which said locking sleeve is supported for rotation relative to said dispenser cartridge, actuator, and closure;

said locking sleeve includes a radially outwardly extending peripheral flange adjacent said locking sleeve bottom end; and said dispensing assembly further includes an exterior housing that is mounted around at least a portion of said closure and is fixed thereto, said housing having a housing opening that receives said locking sleeve bottom end and said locking sleeve peripheral flange, and said housing having a retention lip at said housing opening for overlying and engaging said locking sleeve peripheral flange so as to retain said locking sleeve around said stem and actuator to accommodate rotation of said locking sleeve.

20. The dispensing pump assembly in accordance with claim 19 in which said locking sleeve and said housing have interengageable features accommodating rotation of said locking sleeve relative to said housing between (1) at least one unlocked actuatable position corresponding to said second rotated position permitting reciprocation of said actuator, and (2) at least one releasably locked position corresponding to said first rotated position preventing reciprocation of said actuator.

21. The dispensing pump assembly in accordance with claim 20 in which said interengageable features include at least one arcuate tab that is on said housing and that projects radially inwardly; and at least two arcuate notches that are circumferentially spaced apart on said locking sleeve and that each opens radially outwardly for releasably receiving said housing tab in a releasable detent engagement to releasably hold said locking sleeve selectively in one of said first rotated position and said second rotated position.

22. The dispensing pump assembly in accordance with claim 20 in which said interengageable features include at least one tab that is on said housing and that projects radially inwardly; and at least one pair of spaced-apart ramps on said locking sleeve, each said ramp having a tapered long surface and an angled shorter retention wall generally facing the angled shorter retention wall of the other ramp to define a radially outward opening for releasably receiving said housing tab in a releasable detent engagement between said retention walls to releasably hold said locking sleeve selectively in one of said first rotated position and said second rotated position.

23. A dispensing assembly for a container of fluent material, said assembly comprising:

(A) a dispenser cartridge that (1) has an upwardly projecting, reciprocatable, product-dispensing stem biased to an elevated rest position, and (2) is adapted to be installed in a mouth of a container;

(B) an actuator that (1) is mounted on said stem for establishing fluid communication between said stem and the exterior of said actuator for dispensing said fluent material, and (2) has a top end defining a force-bearing actuation region for being subjected to an actuation force to depress said actuator to urge said stem further into said dispenser cartridge to actuate said dispensing assembly;

(C) an exterior housing outwardly of and surrounding, said dispenser cartridge, said housing including a trigger support located rearwardly of said actuator;

(D) a trigger that (1) is pivotally mounted to said trigger support for movement between an elevated, unactuated position and a lowered, actuated position, (2) extends over a portion of said actuator and rearwardly beyond said actuator to said trigger support, (3) defines an aperture located adjacent said actuator to accommodate dispensing of fluent material from said actuator through said aperture, (4) engages said actuator top end, (5) has a finger-grippable lever portion extending from said aperture, and (6) has an arm that extends a from said trigger at (a location between said trigger support and said actuator, and (b) downwardly alongside said actuator; and (E) a locking sleeve rotatably mounted around both said stem and actuator, said locking sleeve defining at least a first upper abutment edge for engaging said trigger arm to prevent downward movement of said trigger and actuator when said locking sleeve is in a first rotated position to lock said dispensing assembly from being actuated, said locking sleeve defining at least a first recess for receiving said arm to accommodate downward movement of said trigger and actuator when said locking sleeve is in a second rotated position while said trigger is lowered to depress said actuator to actuate said dispensing assembly.

24. The dispensing assembly in accordance with claim 23 in which said actuator has a lateral projection in the form of a spout having a dispensing passage that functions to define at least part of said fluid communication between said stem and the exterior of said actuator.

25. The assembly in accordance with claim 24 in which said actuator is generally cylindrical except for said laterally projecting spout; and said actuator has a generally cylindrical skirt which extends below said spout.

26. The dispensing assembly in accordance with claim 23 in which said dispensing assembly is adapted to be installed in a mouth of a container that has a connection feature adjacent the mouth; and said dispensing assembly further includes a closure extending within said housing for mounting on said container at said mouth and having (1) a connection feature for connecting with said container connection feature to connect said closure to said container, (2) a retention feature for engaging a portion of said dispenser cartridge to retain said dispenser cartridge on said container, and (3) an opening into which said dispenser cartridge projects.

27. The dispensing assembly in accordance with claim 26 in which said locking sleeve has a bottom end on which said locking sleeve is supported for rotation relative to said dispenser cartridge, actuator, and closure;

said locking sleeve includes a radially outwardly extending peripheral flange adjacent said locking sleeve bottom end; and said exterior housing is mounted around at least a portion of said closure and is fixed thereto, said housing having a housing opening that receives said locking sleeve bottom end and said locking sleeve peripheral flange, and said housing having a retention lip at said housing opening for overlying and engaging said locking sleeve peripheral flange so as to retain said locking sleeve around said stem and actuator to accommodate rotation of said locking sleeve.

28. A dispensing assembly for a container of fluent material, said assembly comprising:

(A) a dispenser cartridge that (1) has an upwardly projecting, reciprocatable, product-dispensing stem biased to an elevated rest position, and (2) is adapted to be installed in a mouth of a container;

(B) an actuator that (1) is mounted on said stem for establishing fluid communication between said stem and the exterior of said actuator for dispensing said fluent material, and (2) has a top end defining a force-bearing actuation region that can be subjected to an actuation force to depress said actuator to urge said stem further into said dispenser cartridge to actuate said dispensing assembly;

(C) an exterior housing outwardly of, and surrounding, said dispenser cartridge, said housing including a trigger support located rearwardly of said actuator;

(D) a trigger that (1) is pivotally mounted to said trigger support for movement between an elevated, unactuated position and a lowered, actuated position, (2) extends over a portion of said actuator, (3) defines an aperture located adjacent said actuator to accommodate dispensing of fluent material from said actuator through said aperture, (4) engages said actuator top end, (5) has a finger-grippable lever portion extending from said aperture, and (6) an arm that extends downwardly alongside said actuator; and (E) a locking sleeve rotatably mounted around both said stem and actuator, said locking sleeve defining at least a first upper abutment edge for engaging said trigger arm to prevent downward movement of said trigger and actuator when said locking sleeve is in a first rotated position to lock said dispensing assembly from being actuated, said locking sleeve defining at least a first recess for accommodating downward movement of said trigger and actuator when said locking sleeve is in a second rotated position while said trigger is lowered to depress said actuator to actuate said dispensing assembly; and wherein said dispensing assembly is adapted to be installed in a mouth of a container that has a connection feature adjacent the mouth;

said dispensing assembly further includes a closure extending within said housing for mounting on said container at said mouth and having (1) a connection feature for connecting with said container connection feature to connect said closure to said container, (2) a retention feature for engaging a portion of said dispenser cartridge to retain said dispenser cartridge on said container, and (3) an opening into which said dispenser cartridge can project;

said dispenser cartridge is an aerosol dispensing valve; and said closure is a valve mounting cup having (1) a peripheral mounting flange for mounting said cup to said container; and (2) an annular inner wall that (a) defines said closure opening, and (b) engages said aerosol dispensing valve to retain said aerosol dispensing cartridge on said container.

29. A dispensing assembly for a container of fluent material, said assembly comprising:

(A) a dispenser cartridge that (1) has an upwardly projecting, reciprocatable, product-dispensing stem biased to an elevated rest position, and (2) is adapted to be installed in a mouth of a container;

(B) an actuator that (1) is mounted on said stem for establishing fluid communication between said stem and the exterior of said actuator for dispensing said fluent material, and (2) has a top end defining a force-bearing actuation region that can be subjected to an actuation force to depress said actuator to urge said stem further into said dispenser cartridge to actuate said dispensing assembly;

(C) an exterior housing outwardly of, and surrounding, said dispenser cartridge, said housing including a trigger support located rearwardly of said actuator;

(D) a trigger that (1) is pivotally mounted to said trigger support for movement between an elevated, unactuated position and a lowered, actuated position, (2) extends over a portion of said actuator, (3) defines an aperture located adjacent said actuator to accommodate dispensing of fluent material from said actuator through said aperture, (4) engages said actuator top end, (5) has a finger-grippable lever portion extending from said aperture, and (6) an arm that extends downwardly alongside said actuator; and (E) a locking sleeve rotatably mounted around both said stem and actuator, said locking sleeve defining at least a first upper abutment edge for engaging said trigger arm to prevent downward movement of said trigger and actuator when said locking sleeve is in a first rotated position to lock said dispensing assembly from being actuated, said locking sleeve defining at least a first recess for accommodating downward movement of said trigger and actuator when said locking sleeve is in a second rotated position while said trigger is lowered to depress said actuator to actuate said dispensing assembly; and wherein said dispensing assembly is adapted to be installed in a mouth of a container that has a connection feature adjacent the mouth;

said dispensing assembly further includes a closure extending within said housing for mounting on said container at said mouth and having (1) a connection feature for connecting with said container connection feature to connect said closure to said container, (2) a retention feature for engaging a portion of said dispenser cartridge to retain said dispenser cartridge on said container, and (3) an opening into which said dispenser cartridge can project;

said dispenser cartridge is a dispensing pump cartridge for being disposed in a mouth of a container having an external male thread around said mouth;

said closure has an internal female thread for mating with said container external male thread;

said closure includes an annular shoulder;

said closure includes an annular shroud that extends (1) upwardly from the inner periphery of said annular shoulder, and (2) laterally around a portion of said pump cartridge;

said locking sleeve is disposed exterior of, and around, said closure annular shroud; and said locking sleeve bottom end supports said locking sleeve on said closure annular shoulder for rotation about said closure annular shroud.

30. A dispensing assembly for a container of fluent material, said assembly comprising:

(A) a dispenser cartridge that (1) has an upwardly projecting, reciprocatable, product-dispensing stem biased to an elevated rest position, and (2) is adapted to be installed in a mouth of a container;

(B) an actuator that (1) is mounted on said stem for establishing fluid communication between said stem and the exterior of said actuator for dispensing said fluent material, and (2) has a top end defining a force-bearing actuation region that can be subjected to an actuation force to depress said actuator to urge said stem further into said dispenser cartridge to actuate said dispensing assembly;

(C) an exterior housing outwardly of, and surrounding, said dispenser cartridge, said housing including a trigger support located rearwardly of said actuator;

(D) a trigger that (1) is pivotally mounted to said trigger support for movement between an elevated, unactuated position and a lowered, actuated position, (2) extends over a portion of said actuator, (3) defines an aperture located adjacent said actuator to accommodate dispensing of fluent material from said actuator through said aperture, (4) engages said actuator top end, (5) has a finger-grippable lever portion extending from said aperture, and (6) an arm that extends downwardly alongside said actuator; and (E) a locking sleeve rotatably mounted around both said stem and actuator, said locking sleeve defining at least a first upper abutment edge for engaging said trigger arm to prevent downward movement of said trigger and actuator when said locking sleeve is in a first rotated position to lock said dispensing assembly from being actuated, said locking sleeve defining at least a first recess for accommodating downward movement of said trigger and actuator when said locking sleeve is in a second rotated position while said trigger is lowered to depress said actuator to actuate said dispensing assembly; and wherein said locking sleeve and said exterior housing have interengageable features accommodating rotation of said locking sleeve relative to said housing between (1) at least one unlocked actuatable position corresponding to said second rotated position permitting reciprocation of said actuator, and (2) at least one releasably locked position corresponding to said first rotated position preventing reciprocation of said actuator; and said interengageable features include at least one arcuate tab that is on said housing and that projects radially inwardly; and at least two arcuate notches that are circumferentially spaced apart on said locking sleeve and that each opens radially outwardly for releasably receiving said housing tab in a releasable detent engagement to releasably hold said locking sleeve selectively in one of said first rotated position and said second rotated position.

31. A dispensing assembly for a container of fluent material, said assembly comprising:

(A) a dispenser cartridge that (1) has an upwardly projecting, reciprocatable, product-dispensing stem biased to an elevated rest position, and (2) is adapted to be installed in a mouth of a container;

(B) an actuator that (1) is mounted on said stem for establishing fluid communication between said stem and the exterior of said actuator for dispensing said fluent material, and (2) has a top end defining a force-bearings actuation region that can be subjected to an actuation force to depress said actuator to urge said stem further into said dispenser cartridge to actuate said dispensing assembly;

(C) an exterior housing outwardly of, and surrounding, said dispenser cartridge, said housing including a trigger support located rearwardly of said actuator;

(D) a trigger that (1) is pivotally mounted to said trigger support for movement between an elevated, unactuated position and a lowered, actuated position, (2) extends over a portion of said actuator, (3) defines an aperture located adjacent said actuator to accommodate dispensing of fluent material from said actuator through said aperture, (4) engages said actuator top end, (5) has a finger-grippable lever portion extending from said aperture, and (6) an arm that extends downwardly alongside said actuator; and (E) a locking sleeve rotatably mounted around both said stem and actuator, said locking sleeve defining at least a first upper abutment edge for engaging said trigger arm to prevent downward movement of said trigger and actuator when said locking sleeve is in a first rotated position to lock said dispensing assembly from being actuated, said locking sleeve defining at least a first recess for accommodating downward movement of said trigger and actuator when said locking sleeve is in a second rotated position while said trigger is lowered to depress said actuator to actuate said dispensing assembly; and wherein said locking sleeve and said exterior housing have interengageable features accommodating rotation of said locking sleeve relative to said housing between (1) at least one unlocked actuatable position corresponding to said second rotated position permitting reciprocation of said actuator, and (2) at least one releasably locked position corresponding to said first rotated position preventing reciprocation of said actuator; and said interengageable features include at least one tab that is on said housing and that projects radially inwardly; and at least one pair of spaced-apart ramps on said locking sleeve, each said ramp having a tapered long surface and an angled shorter retention wall generally facing the angled shorter retention wall of the other ramp to define a radially outward opening for releasably receiving said housing tab in a releasable detent engagement between said retention walls to releasably hold said locking sleeve selectively in one of said first rotated position and said second rotated position.

32. A dispensing assembly for a container of fluent material, said assembly comprising:

(A) a dispenser cartridge that (1) has an upwardly projecting, reciprocatable, product-dispensing stem biased to an elevated rest position, and (2) is adapted to be installed in a mouth of a container;

(B) an actuator that (1) is mounted on said stem for establishing fluid communication between said stem and the exterior of said actuator for dispensing said fluent material, and (2) has a top end defining a force-bearing actuation region that can be subjected to an actuation force to depress said actuator to urge said stem further into said dispenser cartridge to actuate said dispensing assembly;

(C) an exterior housing outwardly of, and surrounding, said dispenser cartridge, said housing including a trigger support located rearwardly of said actuator;

(D) a trigger that (1) is pivotally mounted to said trigger support for movement between an elevated, unactuated position and a lowered, actuated position, (2) extends over a portion of said actuator, (3) defines an aperture located adjacent said actuator to accommodate dispensing of fluent material from said actuator through said aperture, (4) engages said actuator top end, (5) has a finger-grippable lever portion extending from said aperture, and (6) an arm that extends downwardly alongside said actuator; and (E) a locking sleeve rotatably mounted around both said stem and actuator, said locking sleeve defining at least a first upper abutment edge for engaging said trigger arm to prevent downward movement of said trigger and actuator when said locking sleeve is in a first rotated position to lock said dispensing assembly from being actuated, said locking sleeve defining at least a first recess for accommodating downward movement of said trigger and actuator when said locking sleeve is in a second rotated position while said trigger is lowered to depress said actuator to actuate said dispensing assembly; and wherein said locking sleeve has a third rotated position and fourth rotated position;

said locking sleeve defines a second upper abutment edge for engaging said trigger arm to prevent downward movement of said trigger when said locking sleeve is in said third rotated position; and said locking sleeve defines a second recess for receiving said arm to accommodate downward movement of said trigger arm when said locking sleeve is in said fourth rotated position while said actuator is depressed.

33. The dispensing pump in accordance with claim 32 in which said actuator top end force-bearing actuation region defines spaced-apart, linear, parallel grooves; and said trigger defines two spaced-apart, linear cam ribs for each being received in one of said grooves.

* * * * *

UNITED STATES PATENT AND TRADEMARK OFFICE

CERTIFICATE OF CORRECTION

PATENT NO. : 7,249,692 B2
APPLICATION NO. : 11/268445
DATED : July 31, 2007
INVENTOR(S) : Peter J. Walters et al.

It is certified that error appears in the above-identified patent and that said Letters Patent is hereby corrected as shown below:

Claim 18, column 30, line 20, “said” should start a new paragraph.

Claim 23, column 32, line 9, “a” (first occurrence) should be --(a)--, and “(a” should be --a--.

Claim 31, column 36, line 11, “bearings” should be --bearing--.

Signed and Sealed this

Thirtieth Day of October, 2007

JON W. DUDAS
*Director of the United States Patent and Trademark Office*